US009840364B2

(12) United States Patent
Savenok

(10) Patent No.: US 9,840,364 B2
(45) Date of Patent: Dec. 12, 2017

(54) CONTAINER LID AND DAMMING INSERT CONSTRUCTIONS

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 30 days.

(21) Appl. No.: 14/599,038

(22) Filed: Jan. 16, 2015

(65) Prior Publication Data

US 2015/0196149 A1 Jul. 16, 2015

Related U.S. Application Data

(60) Provisional application No. 61/928,298, filed on Jan. 16, 2014.

(51) Int. Cl.

| | |
|---|---|
| ***B65D 85/72*** | (2006.01) |
| ***B65D 43/02*** | (2006.01) |
| ***B65D 47/06*** | (2006.01) |
| ***B65D 47/20*** | (2006.01) |
| ***B65D 47/14*** | (2006.01) |
| ***B65D 51/16*** | (2006.01) |
| ***B65D 51/18*** | (2006.01) |
| ***A47G 19/22*** | (2006.01) |

(52) U.S. Cl.

CPC ..... *B65D 85/72* (2013.01); *B65D 47/06* (2013.01); *B65D 2205/02* (2013.01); *Y10T 29/49826* (2015.01)

(58) Field of Classification Search

CPC ..... B65D 85/72; B65D 43/02; B65D 47/06; B65D 47/2018; B65D 47/14; B65D 2205/02; B65D 51/16; B65D 51/18; B65D 51/16387

USPC ..... 220/713

See application file for complete search history.

(56) References Cited

U.S. PATENT DOCUMENTS

| | | | | |
|---|---|---|---|---|
| 3,262,612 | A * | 7/1966 | Tabor | B65D 47/14 220/254.2 |
| 3,360,161 | A | 12/1967 | Smith | |
| 3,727,808 | A | 4/1973 | Fitzgerald | |
| 4,347,946 | A * | 9/1982 | Nichols | A61M 1/0001 215/309 |
| 4,361,249 | A * | 11/1982 | Tuneski | B65D 47/2018 215/317 |
| 4,503,992 | A * | 3/1985 | Sitko | B65D 47/06 220/713 |
| 4,703,873 | A * | 11/1987 | Geren | B65D 47/147 220/740 |
| 5,054,808 | A | 10/1991 | Sherman et al. | |
| 5,325,780 | A | 7/1994 | Matsuda et al. | |

(Continued)

*Primary Examiner* — Andrew T Kirsch

(74) *Attorney, Agent, or Firm* — Christopher J. Scott

(57) ABSTRACT

Hot consumable container lid constructions and damming insert constructions enable a user/drinker to selectively transfer heat from a relatively hot assembly-contained beverage so as to cool the beverage before it enters the user's/drinker's mouth, and/or prevent inadvertent spillage of the hot consumable so as to avoid scalding of the user. A consumable damming formation is formed in adjacency to the primary outlet for redirecting liquid movement(s) and/or preventing spillage of the liquid before it exits the primary outlet. Certain lid assembly methodologies are also described, which methodologies provide the reader with a more thorough understanding of how the invention functions to achieve the objectives here briefly described.

17 Claims, 56 Drawing Sheets

(56) References Cited

U.S. PATENT DOCUMENTS

| | | | | |
|---|---|---|---|---|
| 5,454,379 | A | 10/1995 | Shepherd | |
| 5,529,202 | A | 6/1996 | Shamis | |
| 5,873,493 | A | 2/1999 | Robinson | |
| 6,076,450 | A | 6/2000 | DiGiorgio, Jr. | |
| 6,176,390 | B1 | 1/2001 | Kemp | |
| 6,488,173 | B2 | 12/2002 | Milan | |
| 7,156,253 | B2 | 1/2007 | Ziegler | |
| 7,448,510 | B2 | 11/2008 | Pavlopoulos | |
| 7,537,129 | B2 | 5/2009 | Bayss et al. | |
| 7,806,044 | B2 | 10/2010 | Lin | |
| 2005/0087539 | A1* | 4/2005 | Waller | A47G 19/2272 220/713 |
| 2005/0205588 | A1 | 9/2005 | Pitts | |
| 2006/0087743 | A1 | 4/2006 | Taylarides | |
| 2007/0053276 | A1 | 3/2007 | Guerrero | |
| 2007/0062943 | A1 | 3/2007 | Bosworth, Sr. | |
| 2008/0156817 | A1 | 7/2008 | Roseblade et al. | |
| 2008/0217345 | A1 | 9/2008 | Hanson | |
| 2009/0206089 | A1 | 8/2009 | Mueller | |
| 2009/0261095 | A1 | 10/2009 | Akram | |
| 2009/0283533 | A1 | 11/2009 | Hemminger et al. | |
| 2010/0018981 | A1 | 1/2010 | Hyde et al. | |
| 2010/0243652 | A1 | 9/2010 | Ritchey | |
| 2010/0264150 | A1 | 10/2010 | Leon et al. | |
| 2010/0308046 | A1 | 12/2010 | Serra | |
| 2010/0320220 | A1 | 12/2010 | Hussey et al. | |

* cited by examiner

CONTAINER LID AND DAMMING INSERT CONSTRUCTIONS

PRIOR HISTORY

This patent application claims the benefit of, and priority to pending U.S. Patent Application No. 61/928,298 filed in the U.S. Patent and Trademark Office on 16 Jan. 2014, the specifications and drawings of which are hereby incorporated by reference thereto.

BACKGROUND OF THE INVENTION

Field of the Invention

The present invention relates generally to lid constructions for outfitting a hot beverage container. More particularly, the present invention relates to certain lid constructions and/or damming inserts usable in combination with lid constructions for outfitting a hot beverage container for enabling the drinker to selectively transfer heat from a hot beverage prior to consumption, and for preventing inadvertent spillage by blocking direct liquid flow from a container via a liquid outlet formed in the lid construction such as when the user is walking, driving, or engaged in other movements while holding the beverage container.

Brief Description of the Prior Art

The broad field of lids for hot beverage containers and hot beverage container assemblies inclusive of lids is exceedingly well-developed. The art relating to means for cooling hot beverages prior to consumption is a bit more limited. In any case, it is most difficult to pinpoint the most pertinent art relevant to the present invention given the wide swath of art swept by beverage container constructions and developments. Nevertheless, some of the more pertinent prior is believed to be briefly described hereinafter.

U.S. Pat. No. 5,873,493 ('493 Patent), which issued to Robinson, for example, discloses an Integrally Molded Measurer Dispenser. The '493 Patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 Patent), which issued to Kemp, discloses a Container Lid with Cooling Reservoir. The '390 Patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 7,448,510 ('510 Patent), which issued to Pavlopoulos, discloses a Cup Assembly having a Cooling Compartment. The '510 Patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

U.S. Patent Application No. 2007/0062943, which was authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

U.S. Patent Application No. 2010/0264150, which was authored by Leon et al., describes a disposable beverage cup comprising a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

U.S. Patent Application No. 2010/0320220, which was authored by Hussey et al., describes a plastic lid for a drinks container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover.

The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure. From a consideration of the foregoing, it will be noted that the prior art perceives a need for a low cost, disposable hot beverage lid construction for use in combination with a container for enabling the user to selectively transfer heat from the hot beverage via the lid and/or insert construction so as to avoid scalding prior to beverage consumption, and for preventing spillage by blocking direct liquid flow from a container a liquid outlet formed in the lid construction due to movements that may occur while walking, driving and other movements on the go, by killing oscillation on liquid which is an unavoidable consequence of a cup with a liquid on the go. By providing a slight delay before liquid exits the primary outlet and a predictable liquid flow in time of consumption on the go is important benefit of damming insert structure according to the present invention. The prior art further perceives a need for various lid constructions and damming insert constructions as summarized in more detail hereinafter.

SUMMARY OF THE INVENTION

To achieve the aforementioned and other readily apparent objectives, the present invention essentially discloses various hot beverage container lid constructions and damming insert constructions for enabling a user/drinker to selectively transfer heat from a relatively hot assembly-contained beverage so as to cool the beverage before it enters the user's/drinker's mouth; and for preventing inadvertent spillage as previously described. The present invention is thus contemplated to provide certain low-cost, disposable means for transferring thermal energy from a relatively hot liquid beverage to relatively cool surroundings so as to prevent scalding before consumption thereof.

The following specifications are believed to support a number of inventive concepts, which concepts may be said to essentially define certain lid constructions for enhancing heat transfer from a relatively hot (container-contained) liquid; and for preventing inadvertent spillage as previously described and/or enabling a user to select a differing means for accessing container contents for expediting or slowing consumption of container contents as the use may elect.

The various lid constructions according to the present invention may be said to essentially comprise a lid rim, an outer lid wall as variously referenced, and an inner lid wall opposite the outer lid wall as variously referenced. A primary outlet as various referenced may be preferably formed in the inner lid wall. The lid rim preferably extends in a rim plane, and the primary outlet may preferably function to outlet liquid in directions substantially parallel to the rim plane. The various lid constructions being attachable to a liquid container, and the primary outlet basically functions to increase air with liquid or air-liquid turbulence for increasing heat transfer from the liquid as said liquid exits the primary outlet.

A damming depression, formation, or structure as variously depicted and referenced may be preferably formed in adjacency to the primary outlet for redirecting liquid movement and enhancing heat transfer therefrom before it exits the primary outlet; and for preventing inadvertent spillage as previously described. The damming structure may preferably comprise a resilient portion, which resilient portion enables the damming structure to be placed into either an actuated position or a relaxed position. Certain figures, for example, depict an actuated position for providing a liquid outlet via the primary outlet, while certain other figures, by contrast, generally depict the damming structure returned to a relaxed position.

The reader will consider that the primary outlet may be formed by way of a spring-biasable material construction or damming structure, which spring-biasable material construction is preferably displaceable intermediate a relaxed configuration and an actuated configuration such that the actuated configuration functions to provide a primary outlet. In certain preferred embodiments, the lid construction may further preferably comprise certain (lower) stop structure formed in inferior adjacency to the spring-biasable material construction.

A lower stop structure preferably functions to prevent downward displacement of the spring-biasable material construction and thus to restrict (excessive) liquid flow. The spring-biasable material construction may be further preferably contoured or formed for cooperative engagement with a user's upper lip. The spring-biasable material construction may thus enable the user to more effectively depress the spring-biasable material construction by way of the user's upper lip.

The lid constructions according to the present invention may further preferably comprise a liquid-trapping reservoir. The liquid-trapping reservoir may be preferably located in adjacency to the primary outlet for receiving and pooling liquid exiting the primary outlet, and basically functions to enable heat transfer from the pooled liquid prior to liquid consumption.

Further, the lid constructions may preferably comprise a lip-receiving indentation. The lip-receiving indentation is preferably located in adjacency to the primary liquid-trapping reservoir for receiving and pooling liquid exiting the primary liquid-trapping reservoir thereby forming a secondary liquid-trapping reservoir, and form-fitting the lid construction to the upper lip of a user's mouth for preventing spillage of liquid during liquid consumption.

Certain embodiments of the lid constructions further function to provide plural container access points, and thus may be said to preferably comprise a primary outlet as variously referenced, a secondary outlet and a lid rim. The primary and secondary outlets are preferably formed opposite one another within the circular lid construction(s). The primary outlet comprises a first aperture, and the secondary outlet comprises a second aperture, which second aperture is preferably relatively larger than the first aperture for enabling a user to selectively access consumable material via the lid construction via a select outlet, the select outlet being selected from the group consisting of the primary and secondary outlets.

In this last regard, it is contemplated that the primary outlet may well function to dispense or outlet relatively low viscosity consumable material such as hot coffee and the like while the secondary outlet may well function to dispense or outlet relatively high viscosity consumable material such as soup or stew type material. These types of lid constructions may preferably further comprise a flap construction, which flap construction may well function to selectively cover the secondary outlet as the user may elect.

The flap construction may preferably comprise certain means for selectively retaining the flap in an open position, which means may be exemplified by a gripping bump or protrusion. The protrusion preferably mates with structure at an opening formed at the damming insert side of the lid construction(s). The secondary outlet may be preferably formed in first lower material layer, and the flap construction may be preferably formed or hingedly connected to a second upper material layer.

Certain other lid constructions according to the present invention preferably comprise certain particularly formed damming formations as preferably exemplified by formations for enhancing heat transfer from a relatively hot container-contained liquid; and for preventing inadvertent spillage as previously described. These lid constructions may be said to essentially comprise a lid rim, a primary outlet, and a damming formation, such that the damming formation is preferably located intermediate the lid rim and the primary outlet for redirecting liquid flow prior to outletting through the primary outlet. By redirecting liquid around the damming formation so formed, heat may be effecting transferred from the liquid prior to exiting the primary outlet and consumption by the user. The damming depressions or formations may either extend in a radially outward direction or a radially inward direction.

Certain other lid constructions according to the present invention comprise an upper lid construction and a lower damming insert. In these embodiments the upper lid construction comprises a primary outlet, and the lower damming insert is attached to the upper lid construction in inferior adjacency to the primary outlet for defining liquid-letting apertures intermediate the upper lid construction and lower damming insert. Together, the damming insert and liquid-letting apertures slow liquid flow prior to outletting through the primary outlet, and thus the damming insert(s) basically function to enhance or increase heat transfer(s) from the liquid prior to its exiting the primary outlet, and for preventing inadvertent spillage as previously described. The present invention further contemplates certain lid construction methodologies whereby a central portion of a state of the art lid construction is removed to expose a central void in the state of the art lid construction; and a damming insert construction according to the present invention is utilized to fill that void for forming an improved lid construction. Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures, and the appended claims and drawings.

BRIEF DESCRIPTION OF THE DRAWINGS

Other features of my invention will become more evident from a consideration of the following brief descriptions of patent drawings:

FIG. 2A is a cross-sectional view of the first lid construction otherwise shown in FIG. 1 showing a liquid or beverage outlet aperture formed in a vertical wall of the lid construction.

DETAILED DESCRIPTION OF PREFERRED EMBODIMENTS

Figure 1:
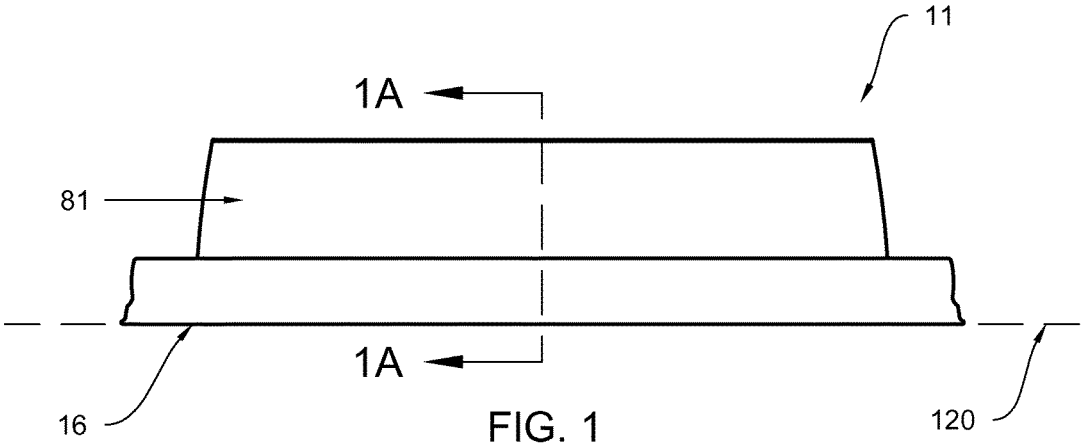
FIG. 1 is a side or edge elevational view of a first lid construction according to the present invention.

Referring now to the drawings with more specificity, the preferred embodiments of the present invention primarily concern a (hot) beverage container lid construction for preventing scalding of the user from accidentally spilled hot beverage. A further objective of the present disclosures is to provide a lid construction for enabling a user/drinker to effectively transfer heat (as generically referenced at 100) from a relatively hot assembly-contained beverage 101 so as to cool the beverage 101 before it enters the user's/drinker's mouth.

The present inventions and disclosures are thus contemplated to provide certain low-cost, disposable container-based means for safeguarding a user or hot beverage consumer from accidental spillage of hot beverage 101 from a lid-outfitted beverage container for transferring thermal energy from a relatively hot liquid beverage 101 to relatively cool surroundings so as to prevent scalding primarily and/or spillage secondarily.

When viewed in combination with a hot beverage container assembly, the present invention is believed to comprise a container structure as at 10 and a lid structure or construction as variously referenced hereinafter. The essential container structure 10 is believed to preferably comprise a container bottom 12, a container wall as at 13, and an upper container rim as at 14. The upper container rim 14 has a rim perimeter, which rim perimeter preferably extends in a container rim plane.

FIG. 1 depicts a lid construction 11 usable in connection with SOLO brand or type lid constructions having an outer wall portion as at 81 and an inner wall portion as at 79 at a beverage or consumable outlet site of the lid construction 11. The main or primary opening or beverage-consumable outlet 15 is formed in the inner wall portion 79 having a vertical or non-horizontal orientation when the lid construction 11 is situated horizontally as generally depicted in FIGS. 1 and 1A.

Figure 1A:
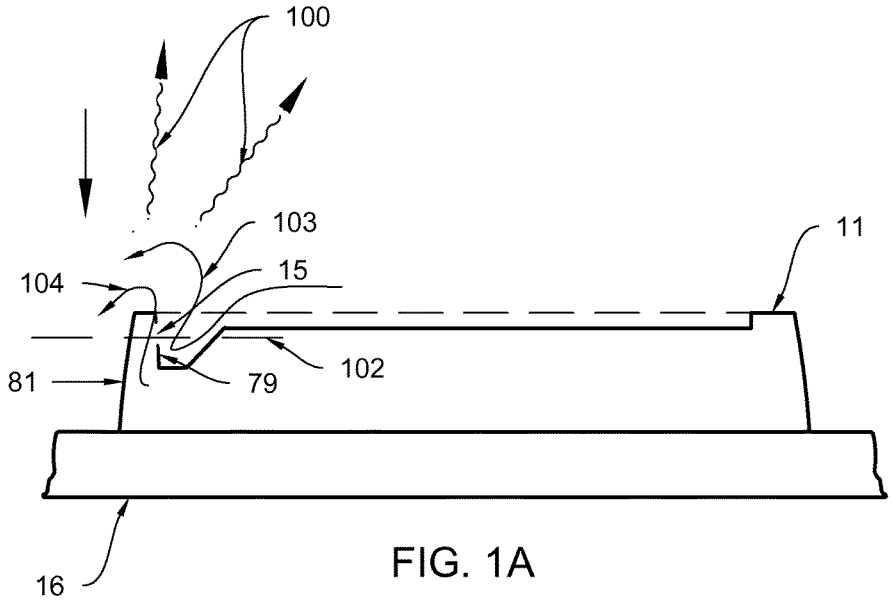

A horizontal plane as at 102 is referenced in FIG. 1A and the main or primary outlet 15 is formed for outletting beverage or consumable(s) in directions substantially parallel to plane 102 instead of being formed in a horizontal wall as is most common in the state of the art. This beverage or consumable outlet 15 thus renders flow dynamics more restricted and liquid flows as at 104 up perpendicular to air flow as at 103 when air is inhaled with liquid.

Figure 3:
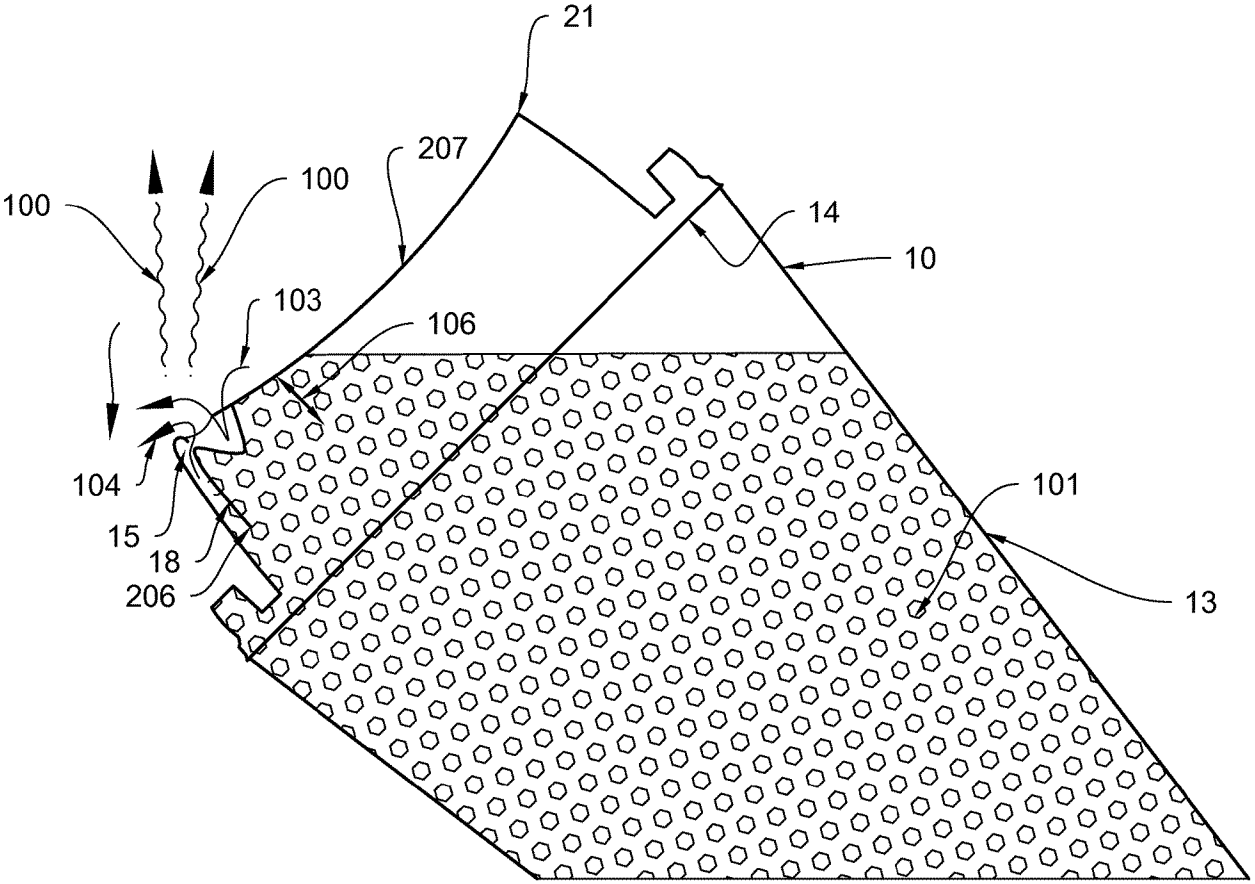
FIG. 3 is a diagrammatic depiction of a fragmentary hot beverage container outfitted with the second lid construction according to the present invention, the hot liquid or beverage container and second lid construction being depicted in cross-section to show the liquid or beverage outlet aperture formed by way of a spring-biasable or displaceable vertical wall of the lid construction.
Figure 4:
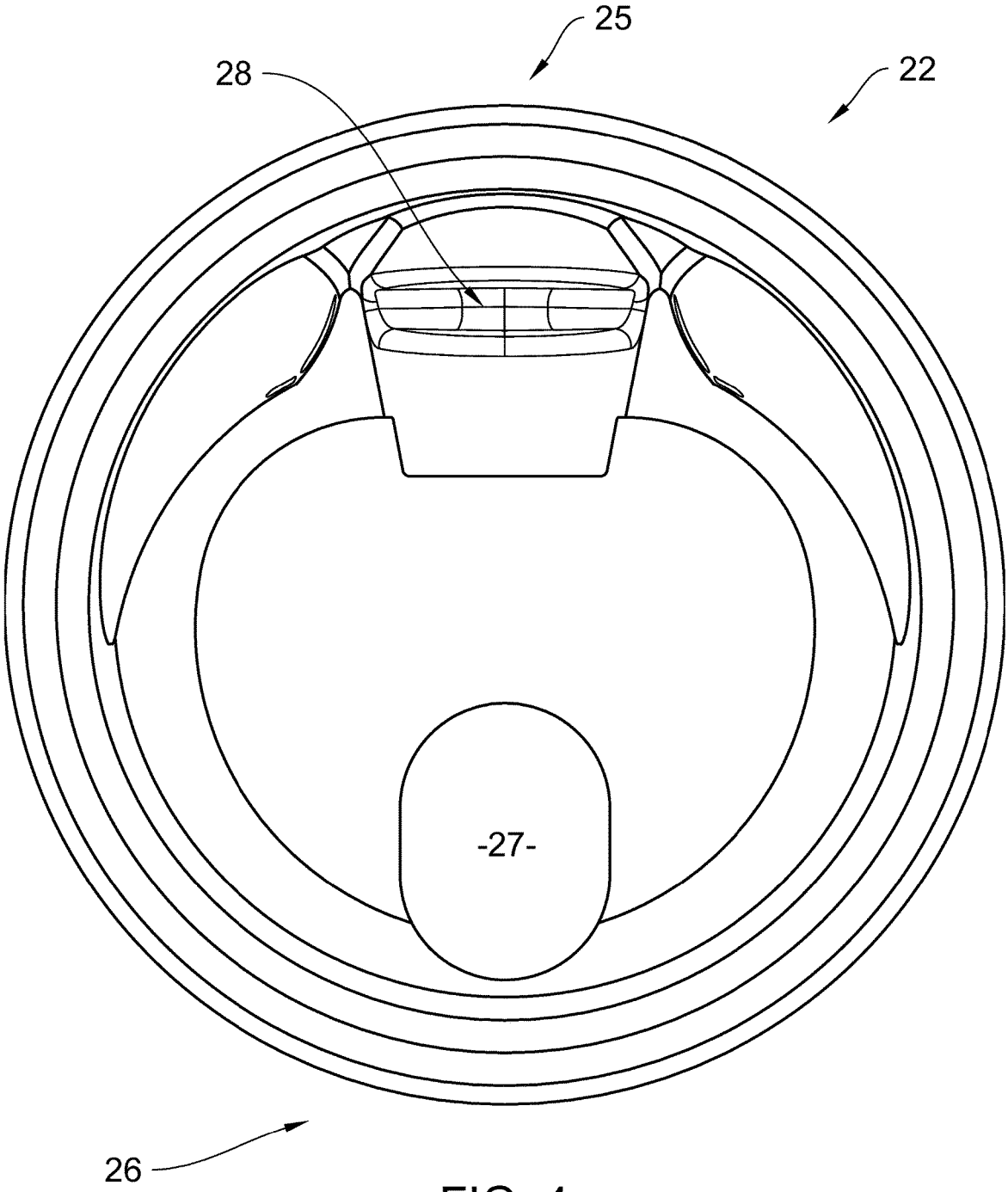
FIG. 4 is a bottom plan view of a third lid construction according to the present invention showing a damming feature and a relatively large opening or aperture formed opposite the damming feature.
Figure 5:
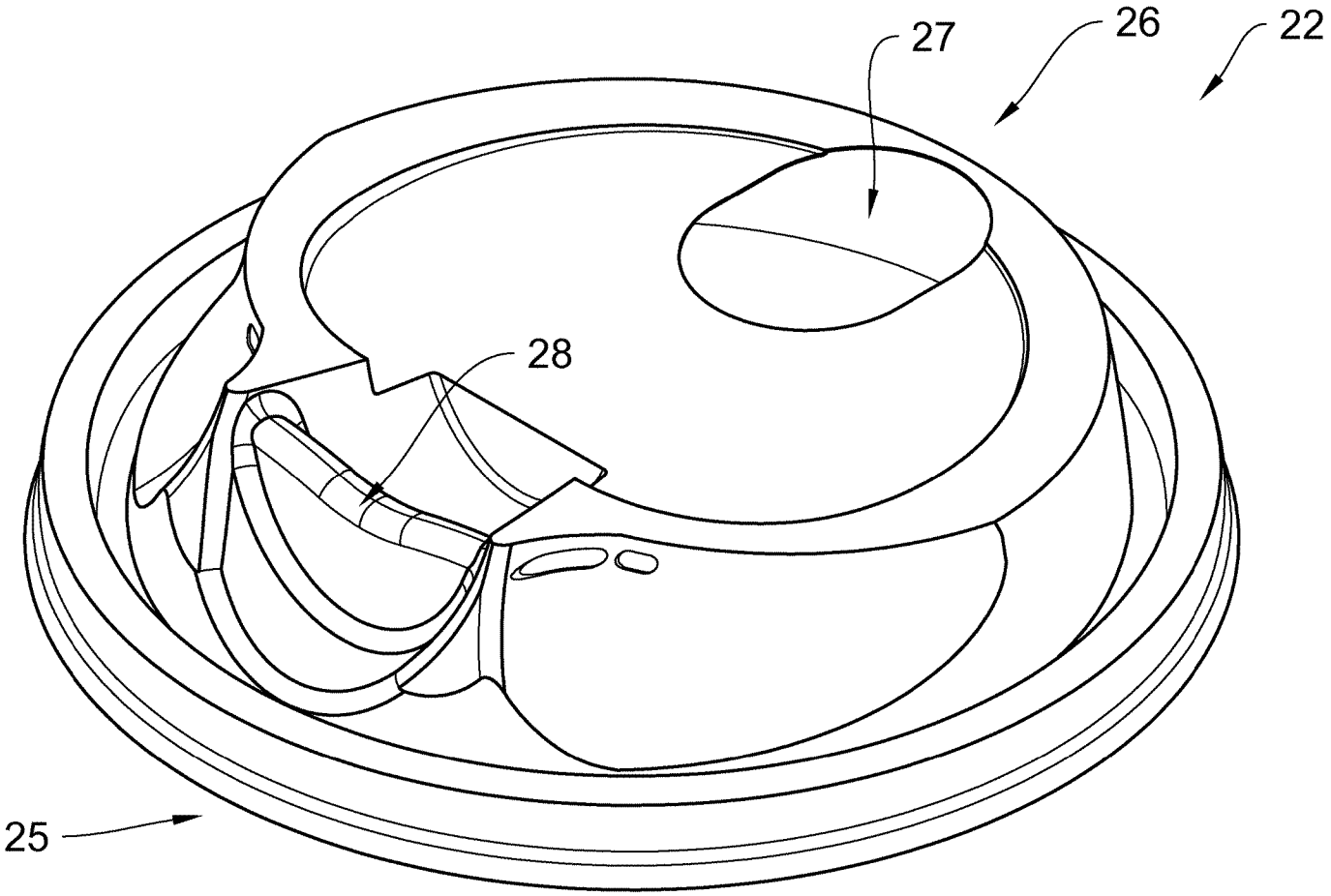
FIG. 5 is a top perspective view of the third lid construction according to the present invention showing the damming feature and the relatively large opening or aperture formed opposite the damming feature.
Figure 6:
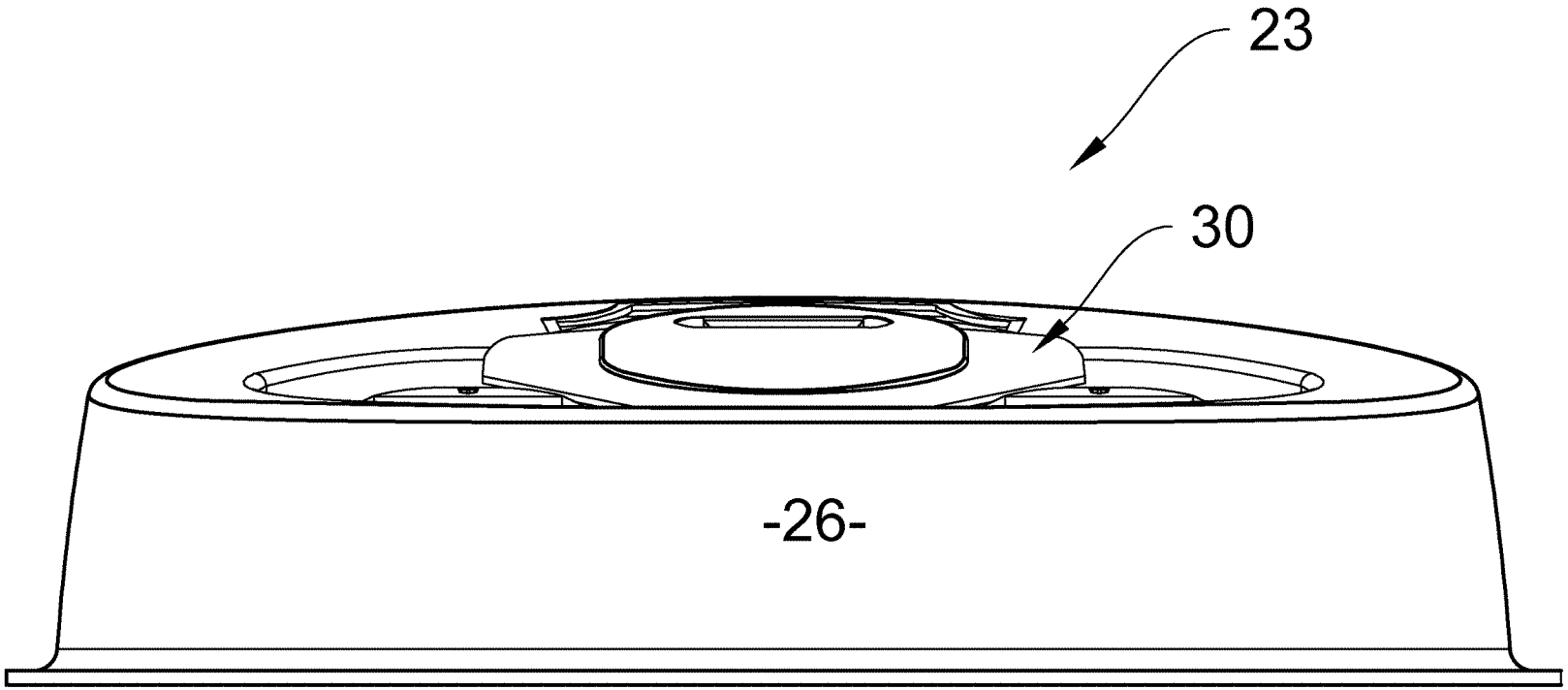
FIG. 6 is a rear of posterior edge elevational view of a fourth lid construction according to the present invention.
Figure 7:
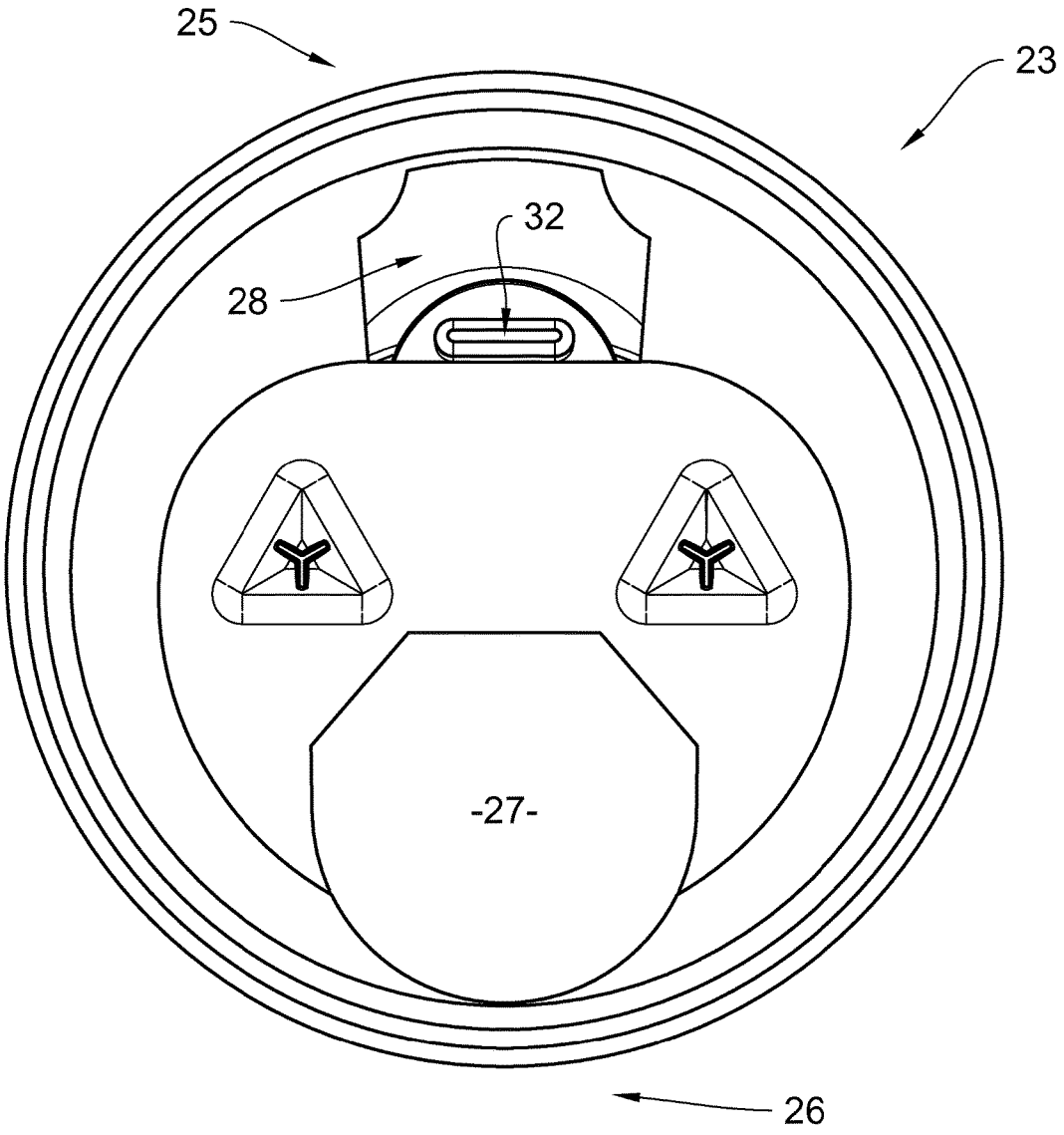
FIG. 7 is a first top plan view of the fourth lid construction according to the present invention showing a relatively large first opening opposite a relatively small second opening.
Figure 8:
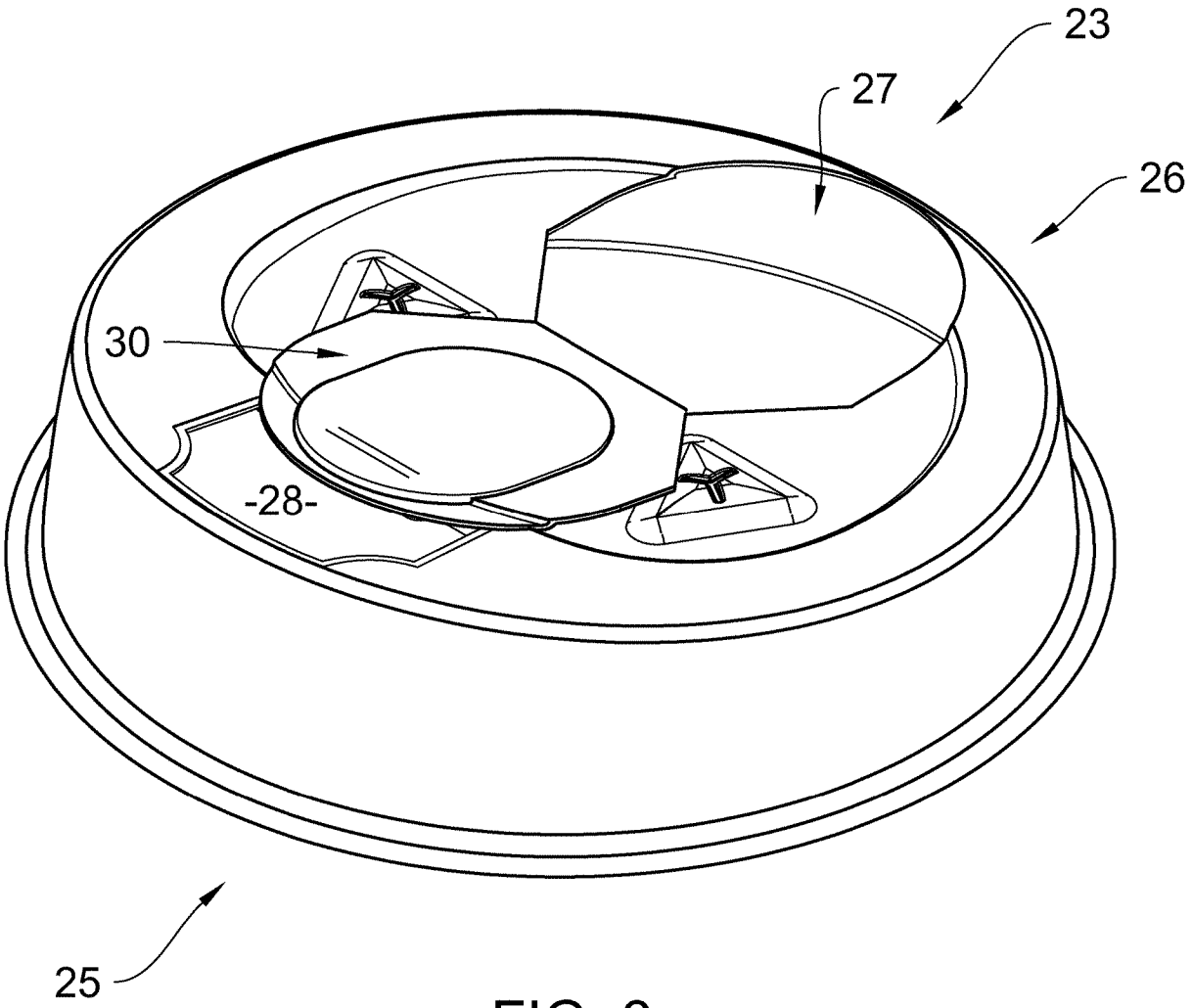
FIG. 8 is a first top perspective view of the fourth lid construction according to the present invention showing the relatively large first opening with a flap positioned adjacent the first opening, the flap being positioned in superior adjacency to the second opening.
Figure 9:
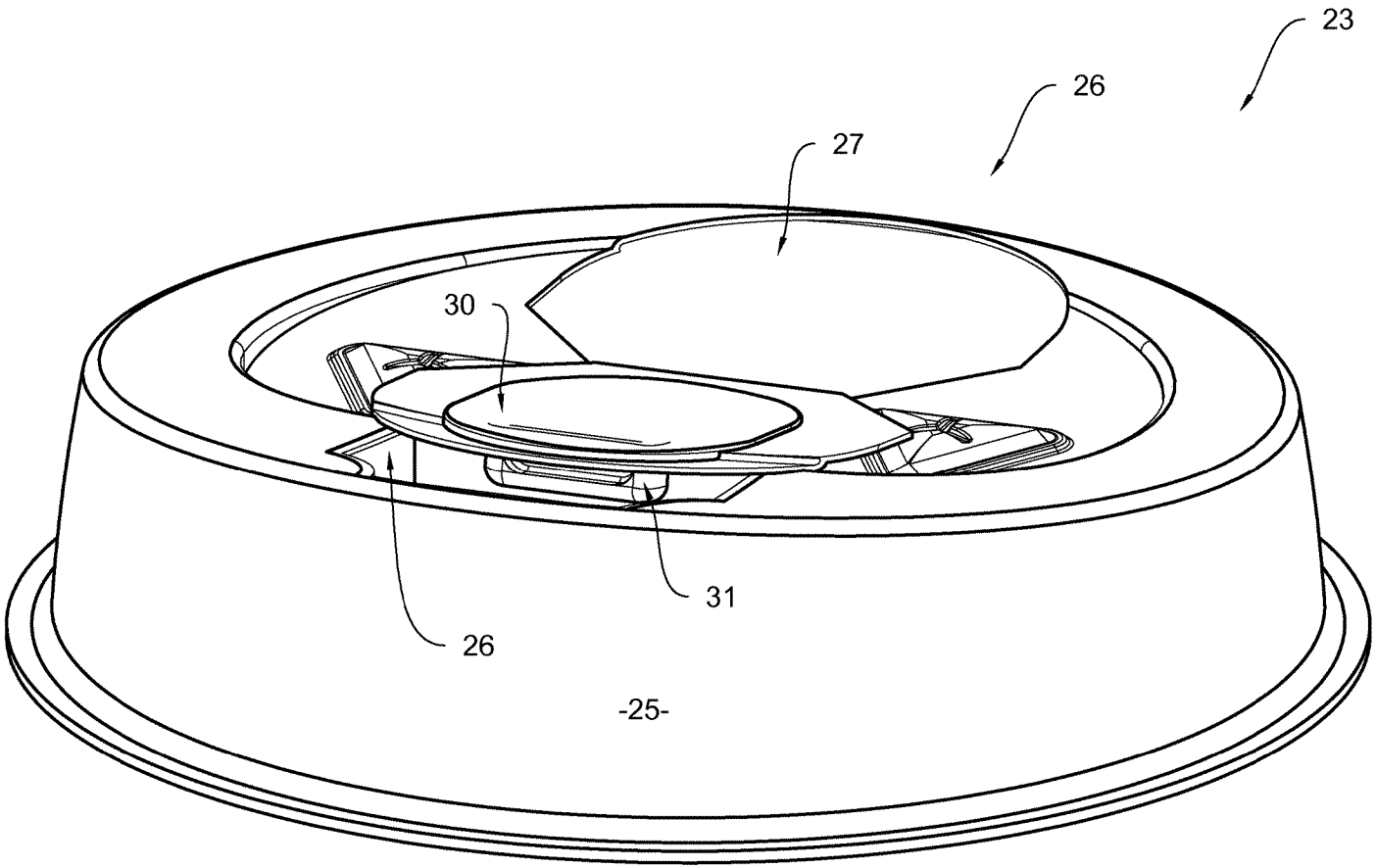
FIG. 9 is a second top perspective view of the fourth lid construction according to the present invention showing the relatively large first opening with a flap positioned adjacent the first opening, the flap being positioned in superior adjacency to the second opening.
Figure 10:
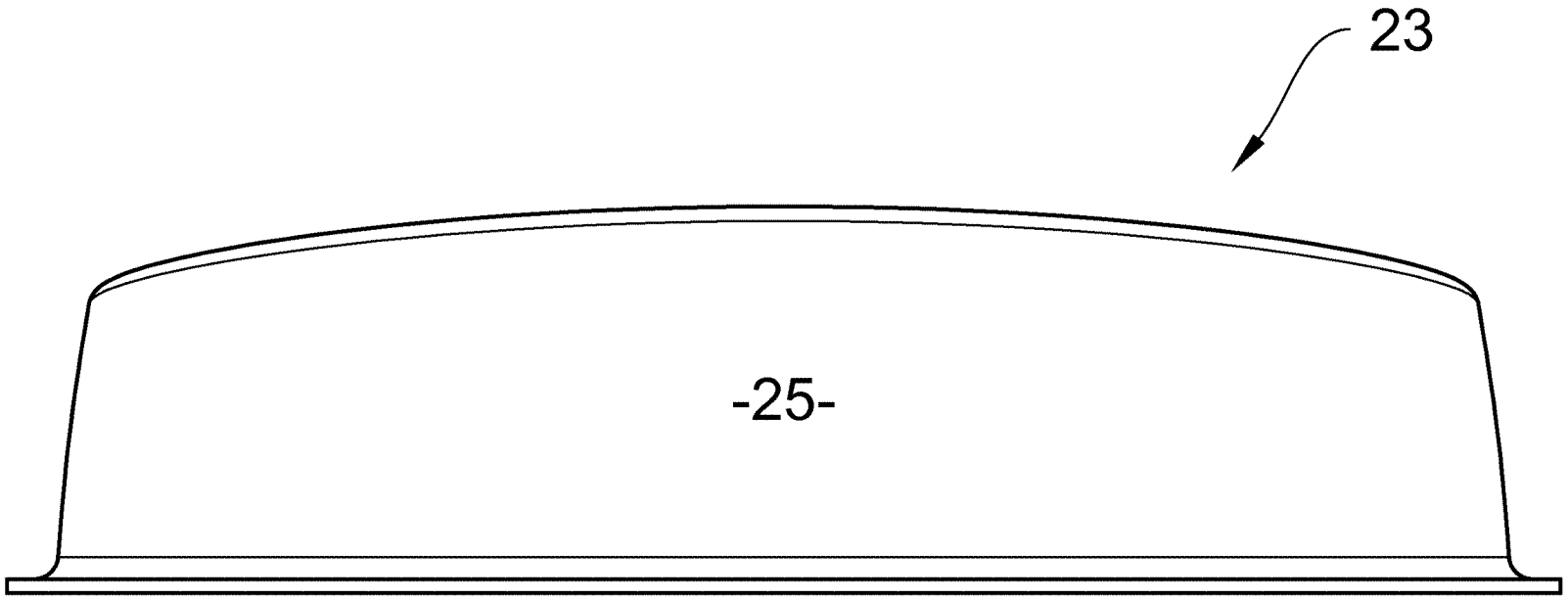
FIG. 10 is a frontal or anterior edge elevational view of the fourth lid construction according to the present invention.
Figure 11:
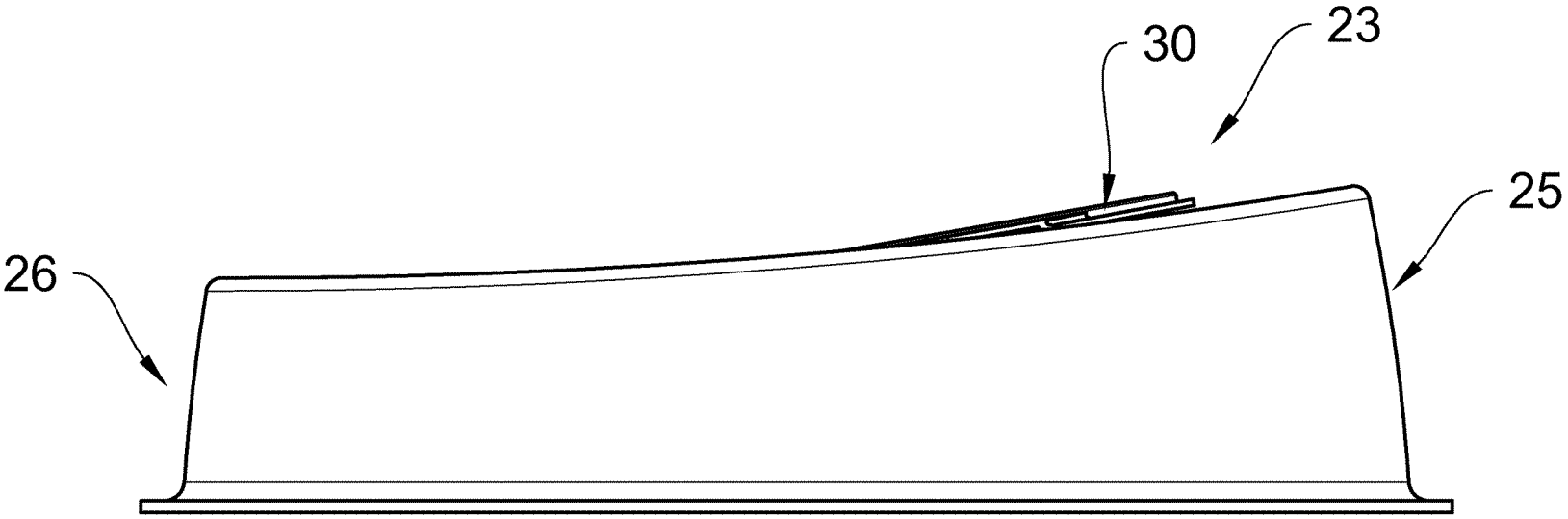
FIG. 11 is a right lateral edge elevational view of the fourth lid construction according to the present invention.
Figure 12:
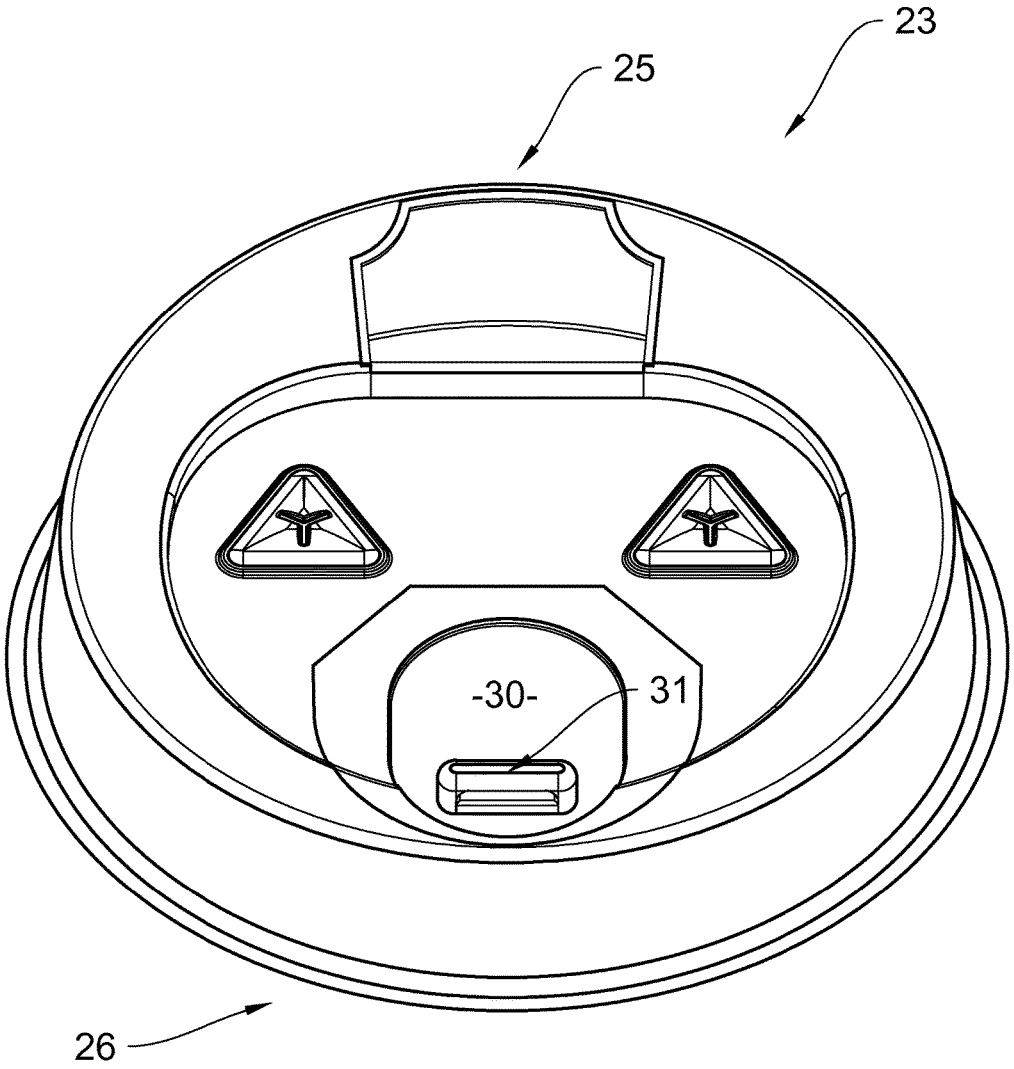
FIG. 12 is a third top perspective view of the fourth lid construction according to the present invention showing a first opening-covering flap closing the relatively large first opening opposite the relatively small second opening.

This provides an air mixing function with air mixing and the attendant heat transfers via such action more effective. This opening or aperture 15 is preferably formed as a relatively thin prolonged hole or aperture as generally depicted in FIG. 3 at shape 205 instead of a round or circular or oval shape as is most common in the state of the art. This type of opening shape forces the liquid flow 104 to be spread thinner which increases air to beverage or consumable contact area greater thereby enabling enhanced air mixing activity for creating a greater cooling effect.

Figure 2:
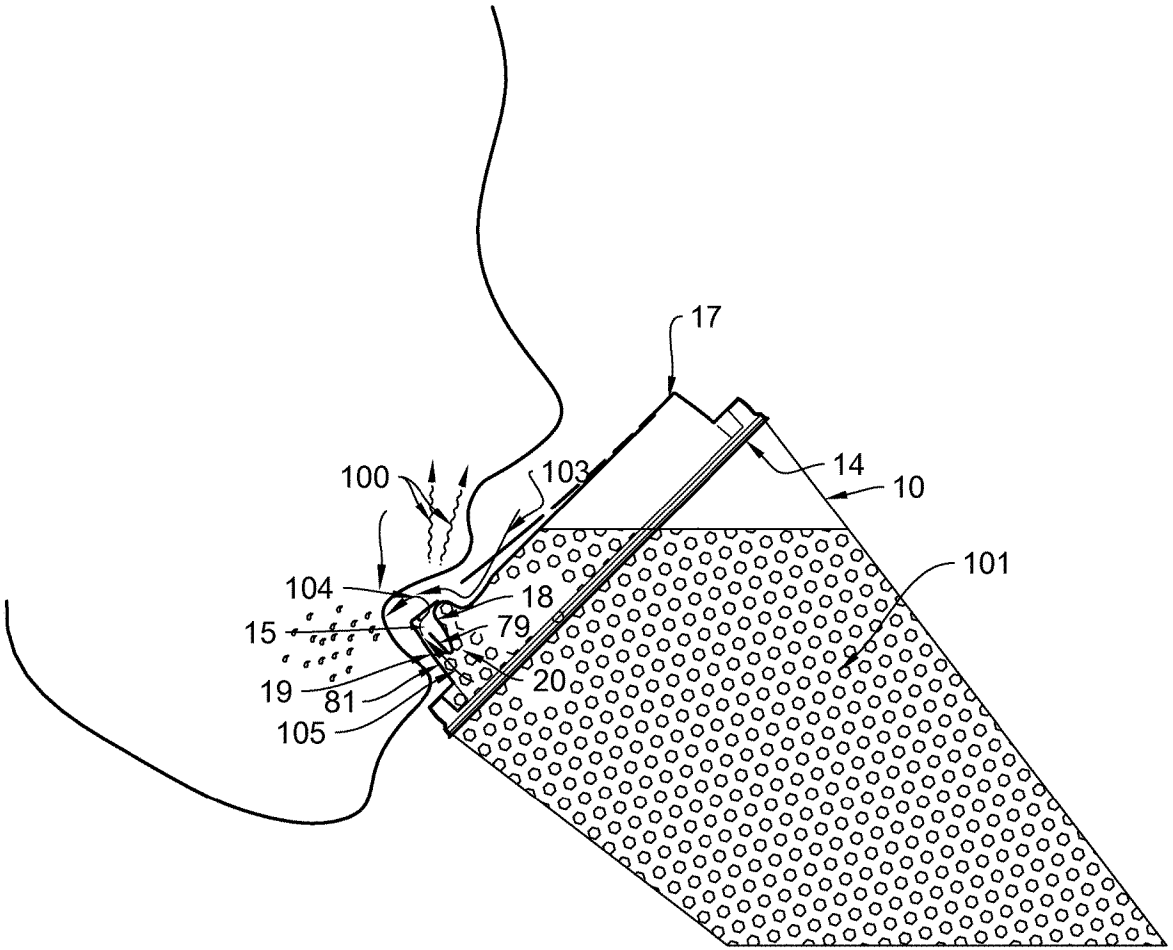
FIG. 2 is a diagrammatic depiction of a user drinking from a hot liquid or beverage container outfitted with a second lid construction according to the present invention, the hot liquid or beverage container and second lid construction being depicted in cross-section to show the liquid or beverage outlet aperture formed in a vertical wall of the lid construction.

Referencing FIG. 2, the illustration depicts a damming structure 18 imbedded in the main body of the lid construction 17 by configuration of formed plastic or polymeric material. The embodiment of the damming structure 18 is cost effective, does not require an additional insert into the lid construction 17, and acts as effective damming structure for liquid flow. In cooperation with the thinly sliced horizontally oriented opening (as at shape 205) formed in the inner lid wall 79 instead of oval shaped on the top, the primary consumable opening or outlet 15 creates a mixing effect with air as the consumable is consumed.

The damming effects occurs between the outer lid wall 81 and the inner lid wall 79 of formed plastic or polymeric material when consumable liquid rushes towards the main or primary opening or outlet 15 it enters as at 105 a narrow channel 19 which restricts amount of liquid that passes through this channel 19. The relatively narrow space or channel 19 may be preferably formed by stamping or by vacuum molding.

A relatively small, liquid-trapping reservoir as at 20 is preferably defined by and formed next to the damming structure 18 in inferior adjacency to the outlet 15. The liquid-trapping reservoir 20 adds to cooling effect as trapped liquid cools quickly and sequential sips add or revert cooled liquid back to the reservoir 20.

Besides the primary damming effect, the damming structure 18 according to the present invention makes it easier to control liquid flow towards the main opening 15. FIG. 3 depicts a damming structure 18, but in the lid construction 21 shown in FIG. 3, the damming structure 18 is disconnected at the bottom as at disconnected portion 206, and thus has a resilient action or acts like a spring to enable back and forth (e.g. up and down) displacements of the lid top 207 as at 106.

Referencing FIGS. 4-14, the reader is directed to lid constructions 22, 23, and 24, according to the present invention showing a first, damming-insert side 25 of the lid construction(s) 22-24 and a second relatively large opening side 26 of the lid construction(s) 22-24. The relatively large opening 27 on the second side(s) 26 of the lid construction(s) 22-24 is/are opposite the (attached) damming feature as generically referenced at 28 in the noted figures.

The relatively large opening 27 is an option that enables users to use the relatively larger opening 27 if desirable or for condiment additions to the container. Further, the relatively large opening 27 may effectively function as an outlet for soup-like consumables or beverages or for beverages or consumables having high viscosity such as milkshakes or the like. The same lid construction(s) 22-24 may thus be used for either coffee-like beverages or for thicker liquids such as soup or the like as the user may elect.

Figure 13:
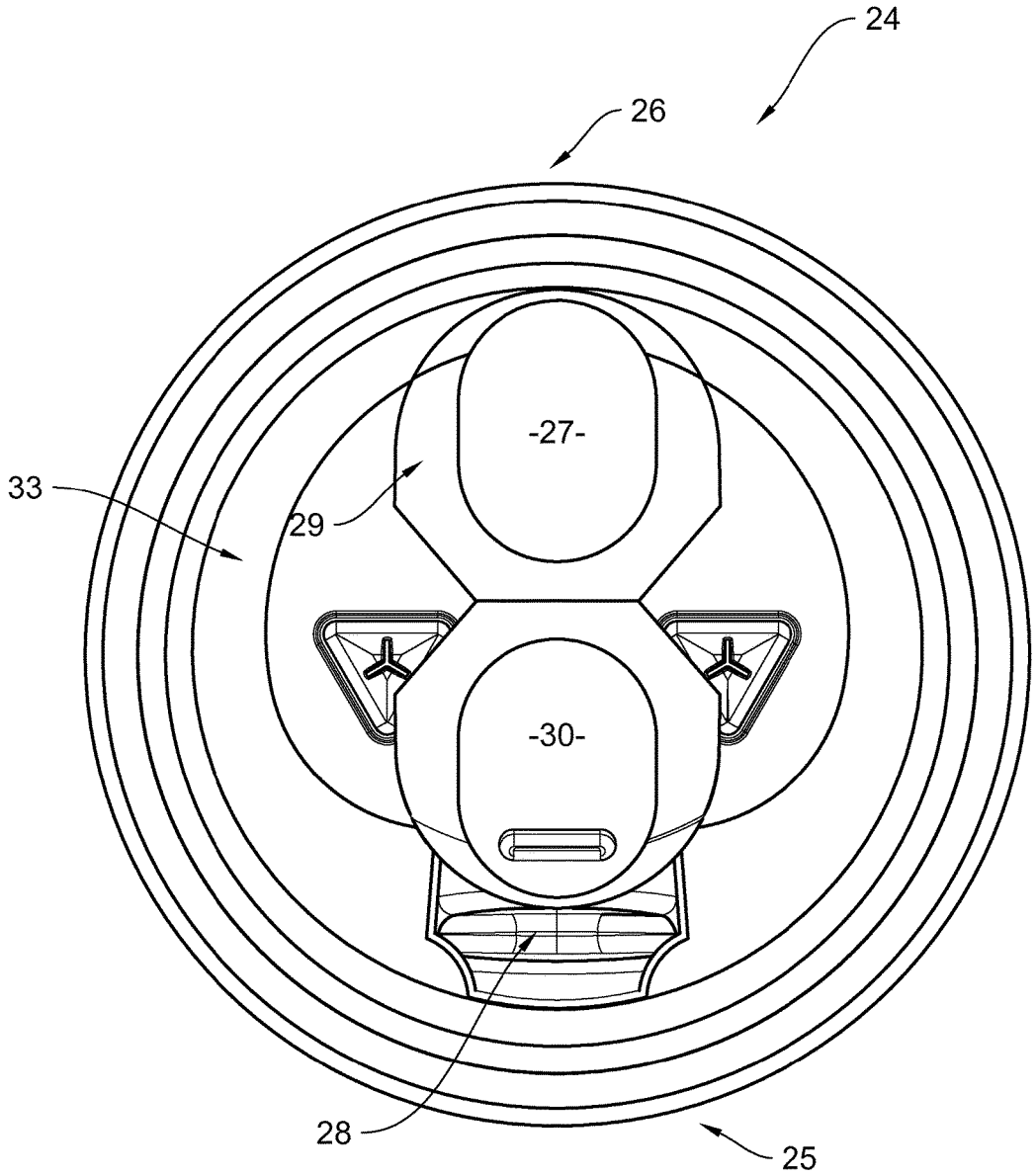
FIG. 13 is a first top plan view of a fifth lid construction according to the present invention depicting a lower damming feature (as otherwise depicted in FIGS. 4 and 5) inserted into an upper lid body (as depicted in FIGS. 6, 8, 10, 11 and 12) (the method of assembly being generally depicted in FIGS. 73 and 74) and a relatively large opening or aperture formed opposite the damming feature in a first lower layer of lid material and an opened flap construction hingedly connected to a second upper layer of lid material and extending toward the damming feature.

The lid constructions according to the present invention may preferably comprise a separate material layer construction as at 29 in FIG. 13, and thus the damming insert may have a relatively large hole or aperture formed in a first lower material layer 29 to render the relatively large aperture 27. The second or upper material layer 33 may preferably comprise a hingedly connected flap construction 30 for selectively closing and/or covering the relative large opening 27. The flap construction 30 is preferably shaped in such a way that it mates with the relatively large opening 27 formed in the insert layer 29 and locks therewith.

The flap construction 30 preferably may preferably comprise certain means for selectively retaining the flap construction 30 in an open position. Said means may be preferably exemplified by a gripping bump or protrusion 31, which bump or protrusion 31 may well function as (1) a manual-gripping device to open the flap construction 30 and (2) a locking device when the flap construction 30 is opened.

The gripping device 31 locks in to the opening 32 formed at the damming insert side 25 of the lid construction(s) 22-24. In this case to prevent leakage, it is preferable that the lid construction(s) 22-24 preferably be outfitted with certain lid-to-container retention means as may be exemplified by more detailed descriptions appearing in U.S. patent application Ser. No. 61/908,013.

Figure 14:
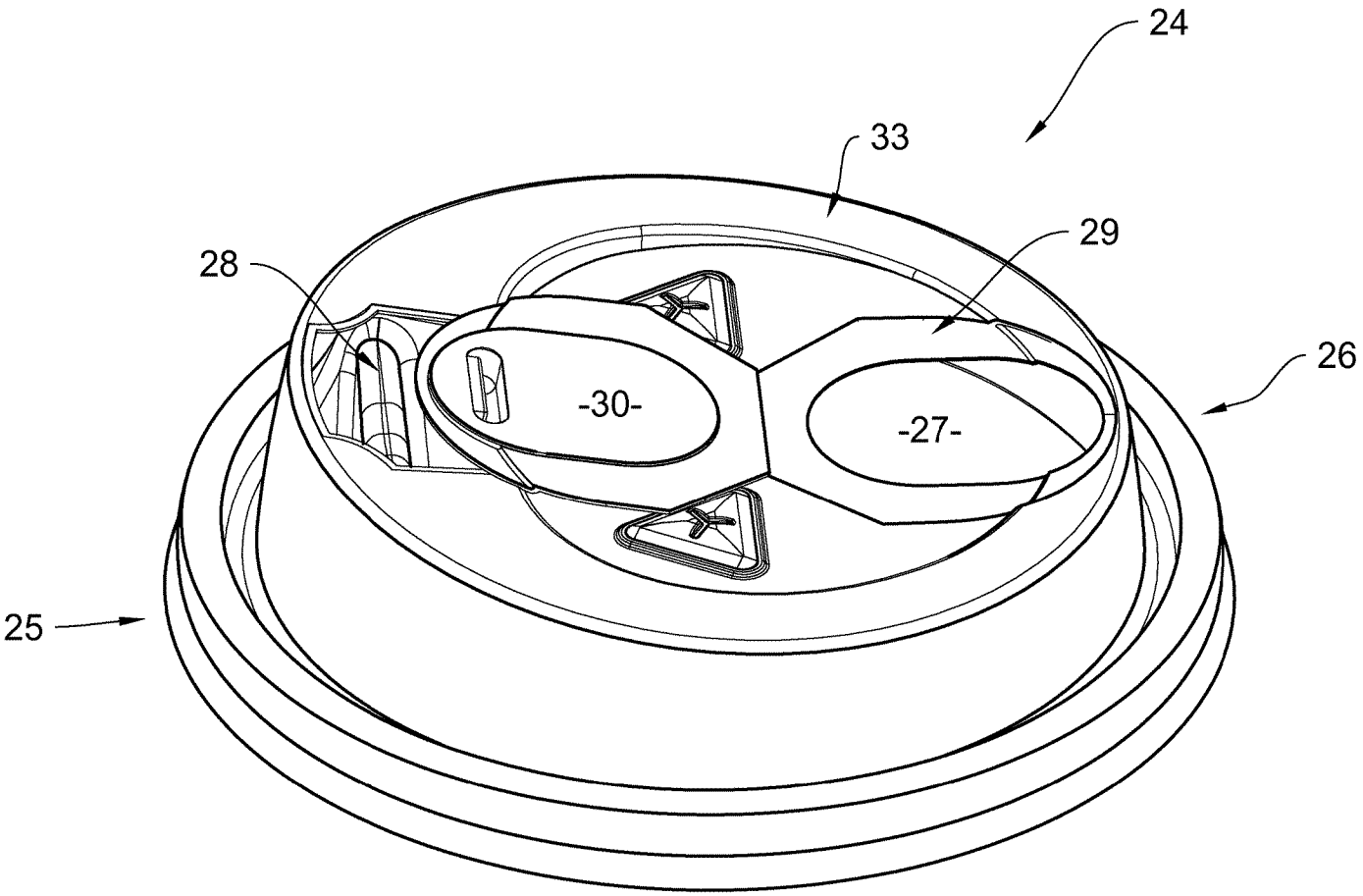
FIG. 14 is a top perspective view of the fifth lid construction according to the present invention depicting the lower damming feature (as otherwise depicted in FIGS. 4 and 5) inserted into an upper lid body (as depicted in FIGS. 6, 8, 10, 11 and 12) (the method of assembly being generally depicted in FIGS. 73 and 74) and a relatively large opening or aperture formed opposite the damming feature in a first lower layer of lid material and an opened flap construction hingedly connected to a second upper layer of lid material and extending toward the damming feature.
Figure 14A:
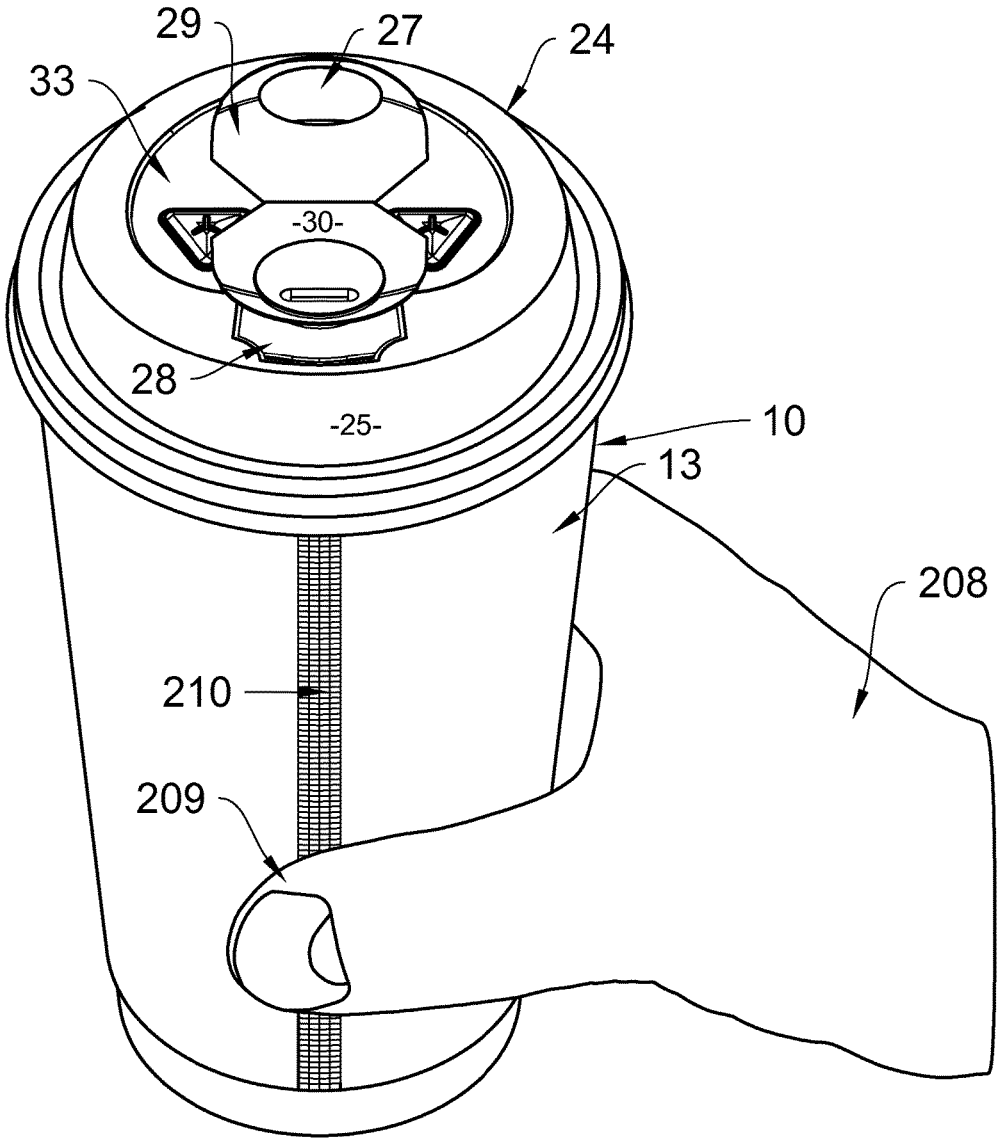
FIG. 14A is an enlarged top perspective type depiction of a user's fragmentary hand holding a beverage container according to the present invention, a thumb of the user's fragmentary hand covering a vertically-oriented tactile reference point structure for providing the user with tactile sensory information outfitted upon the beverage container, which beverage container is further outfitted with fifth lid construction according to the present invention, which fifth lid construction comprises the lower damming feature (as otherwise depicted in FIGS. 4 and 5) inserted into an upper lid body (as depicted in FIGS. 6, 8, 10, 11 and 12) (the method of assembly being generally depicted in FIGS. 73 and 74).

Referencing FIG. 14A, the reader will there see a depiction of a user's fragmentary hand 208 holding a beverage container 10 according to the present invention, a thumb 209 of the user's fragmentary hand 208 covering a vertically-oriented tactile reference point structure 210 for providing the user with tactile sensory information. The tactile sensory information provided by the structure 210 helps the user orient the container 10 about its axis such that the user may align the sides 25 or 26 as the user may elect.

Figure 15:
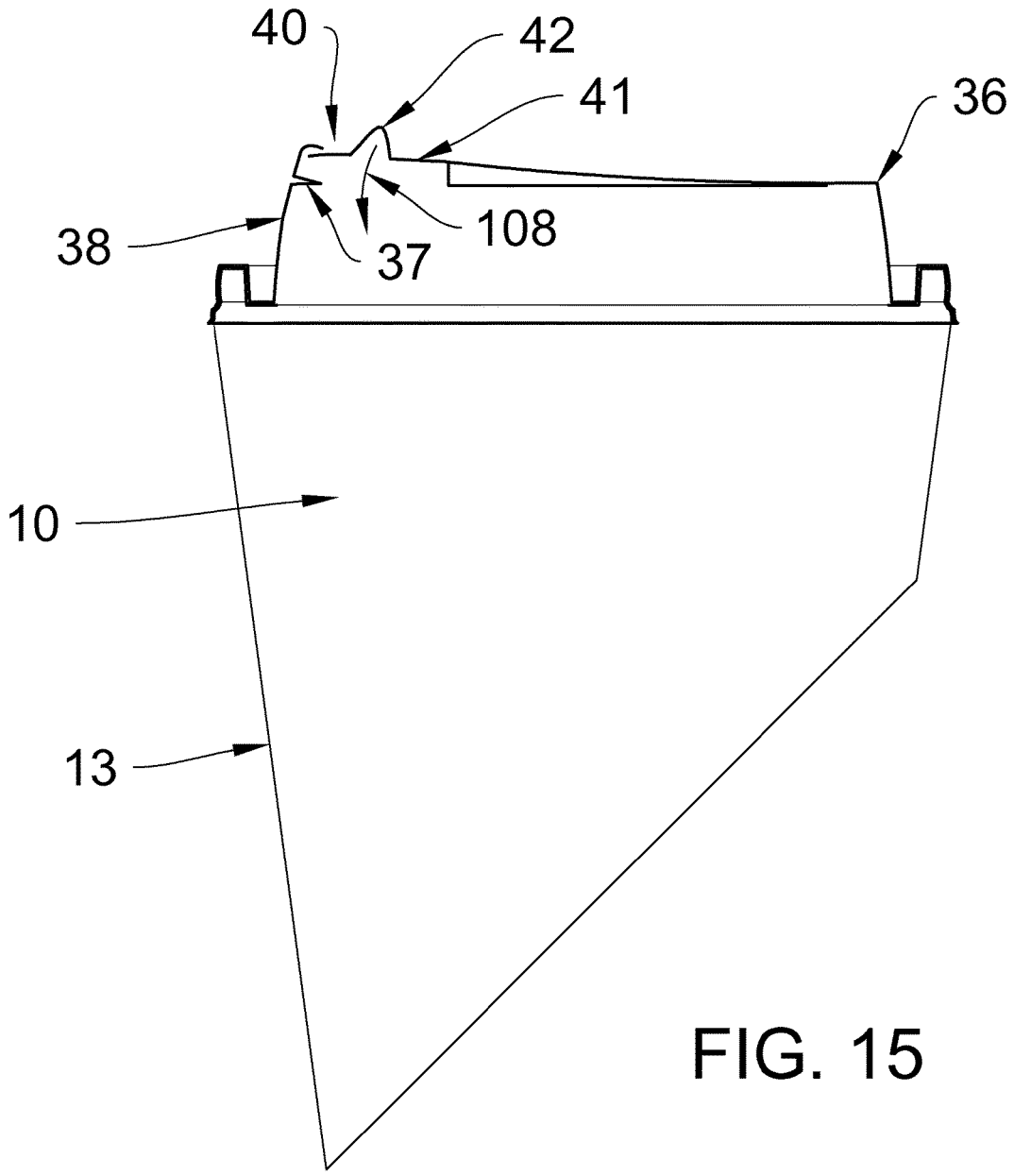
FIG. 15 is a first fragmentary longitudinal cross-sectional diagrammatic type depiction of a sixth lid construction according to the present invention attached to a beverage container assembly, the sixth lid construction comprising an imbedded self-closing damming feature in a relaxed configuration with a separate stopper structure being inserted into an opening to prevent leakage therethrough.
Figure 16:
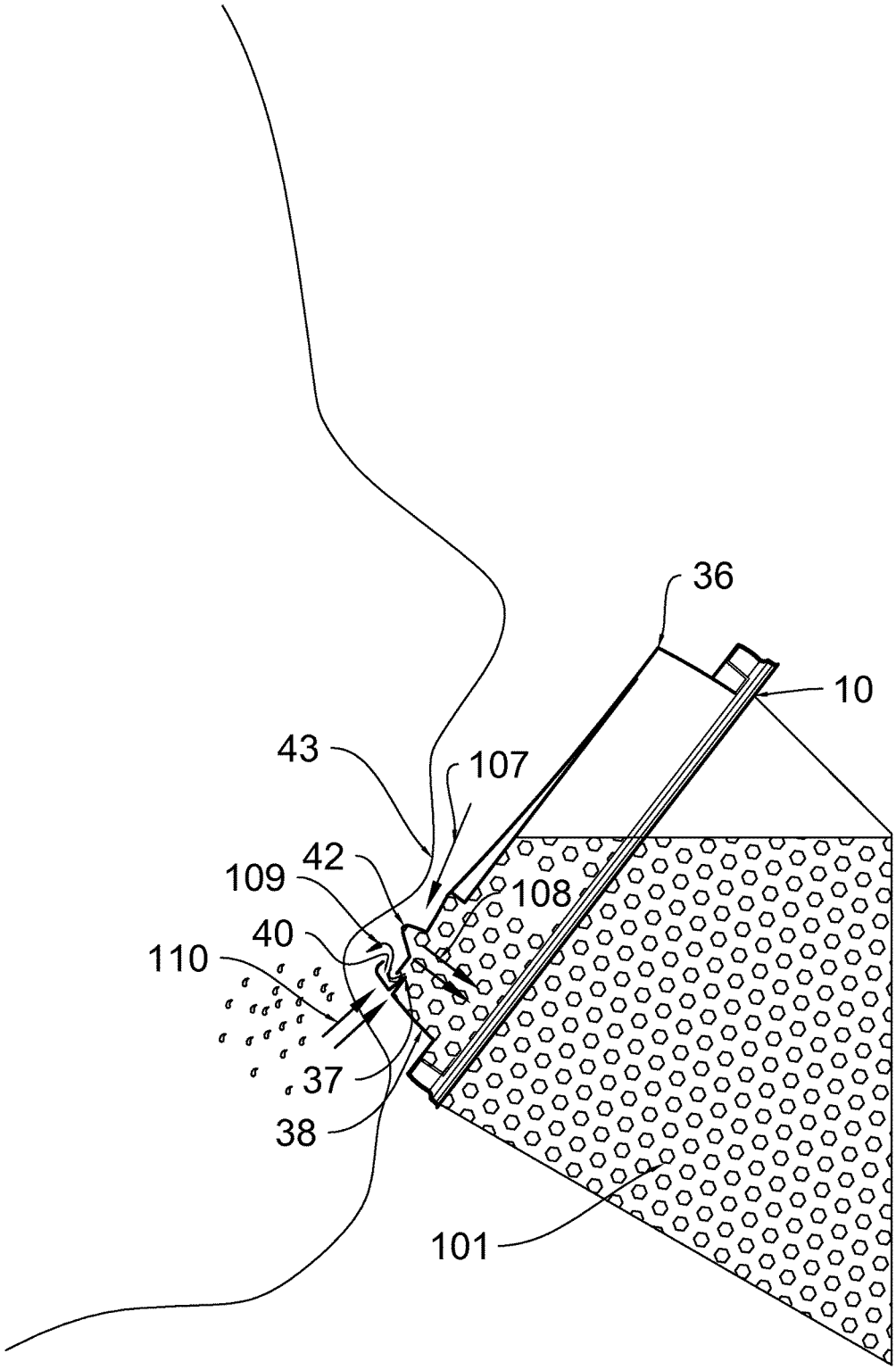
FIG. 16 is a second fragmentary longitudinal cross-sectional diagrammatic type depiction of the sixth lid construction according to the present invention attached to a beverage container assembly, the sixth lid construction comprising an imbedded self-closing damming feature in an actuated configuration for enabling beverage flow therefrom into a user's mouth.
Figure 17:
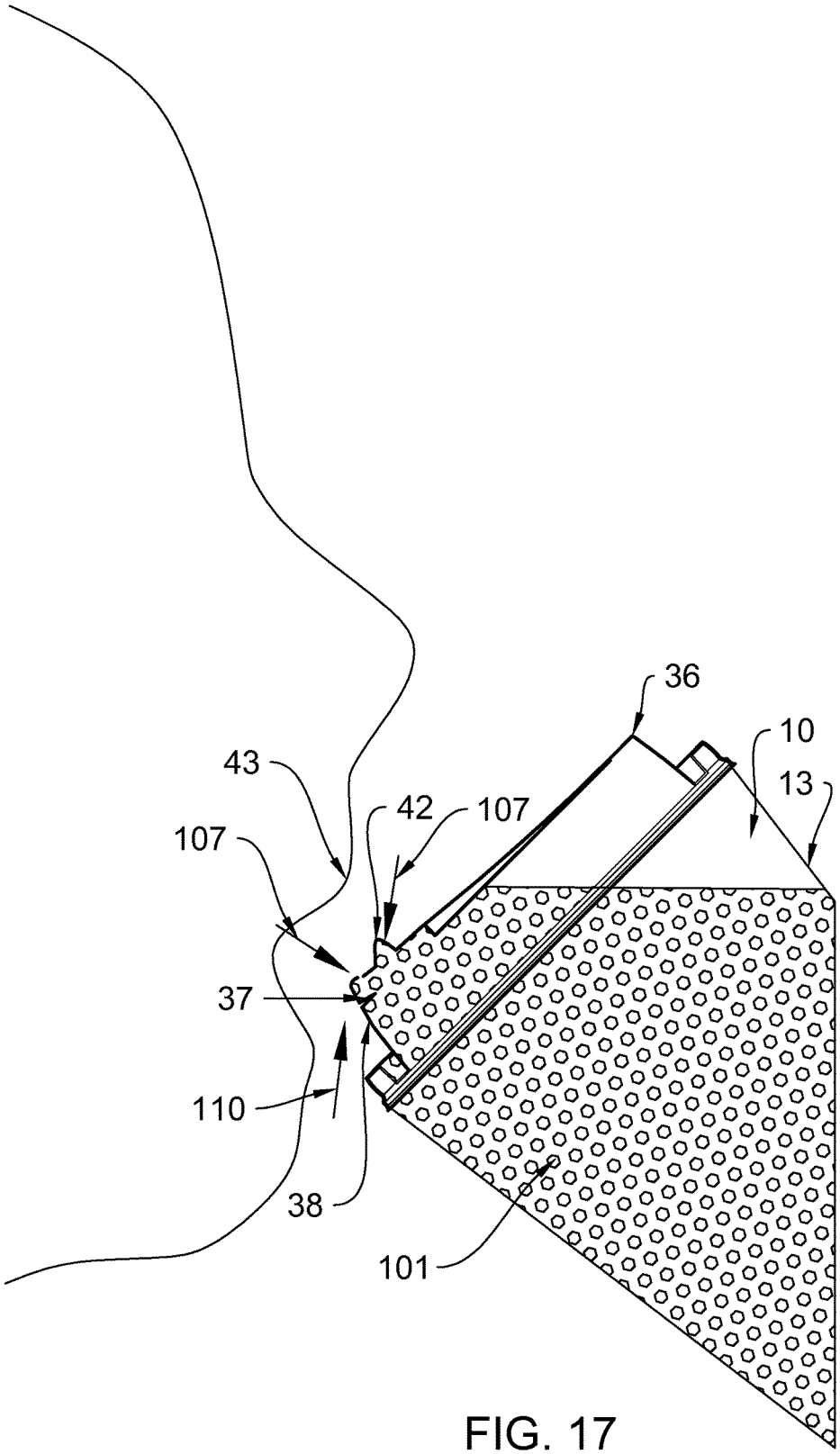
FIG. 17 is a third fragmentary longitudinal cross-sectional diagrammatic type depiction of the sixth lid construction according to the present invention attached to a beverage container assembly, the sixth lid construction comprising an imbedded self-closing damming feature in a relaxed configuration prior to beverage consumption via a user's mouth.

Referencing FIGS. 15-17, the reader will consider a sixth lid construction 36 according to the present invention, which lid construction 36 preferably comprises an imbedded self-closing (under resilient spring-like return force) damming structure or feature as at 41. The lid construction 36 preferably comprises a stopper 37 molded into outer side wall 38 of the lid construction 36. In order to prevent an inadvertent or accidental large opening by downward depression (as at 108) of resilient damming structure 41, the stopper 37 is formed at a point in the wall 38 so as to provide a stop structure for preventing any further movement past the stopper 37 of damming structure 41.

The bump 42 on the top of the spring like damming structure 41 is designed to be pushed down (as at 108) by upper lip 43 of the drinker to open the gap or opening between the lid body and the damming feature 41 and make controllable flow 109 of the consumable liquid or beverage 101. Because the opening 40 is narrow and liquid flow 109 is restricted, the reader should understand that the spring like damming structure 41 acts to dam liquid flow. Air flow 110 from the between top lid and the cap creates additional cooling effect. When the drinker is finished sipping beverage 101, the spring like cap or damming structure 41 is released to its original position thereby closing the outlet or opening 40.

Figure 18:
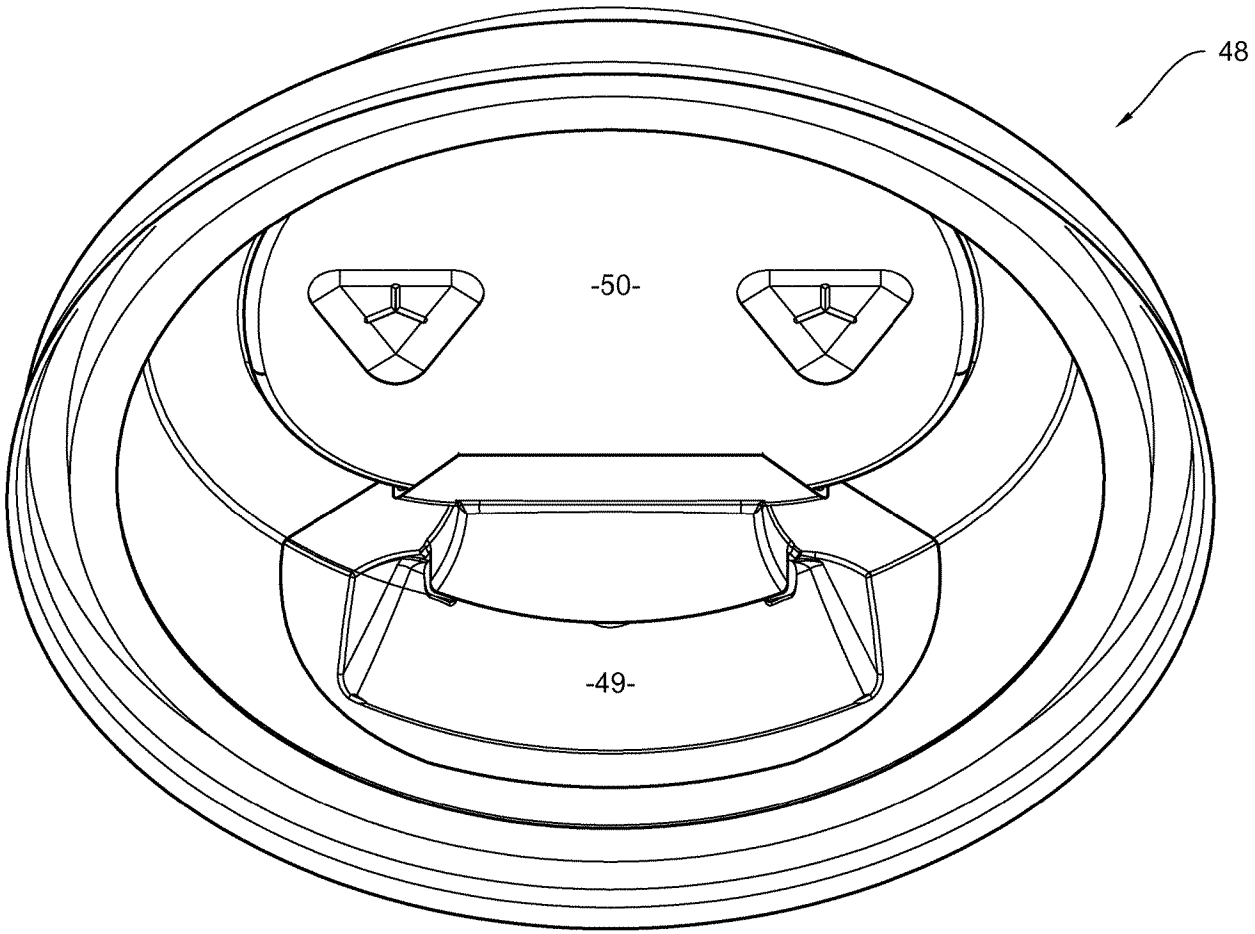
FIG. 18 is a bottom perspective view of a seventh lid construction according to the present invention showing a lower damming insert construction attached to the upper material construction of the ninth lid construction.
Figure 19A:
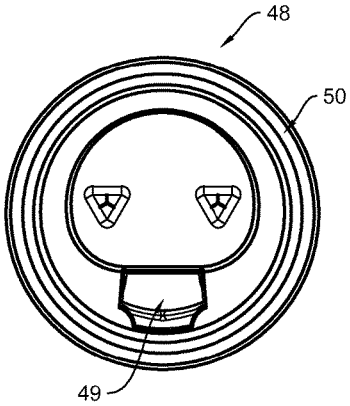
FIG. 19A is a reduced top plan view of the seventh lid construction according to the present invention.
Figure 19B:
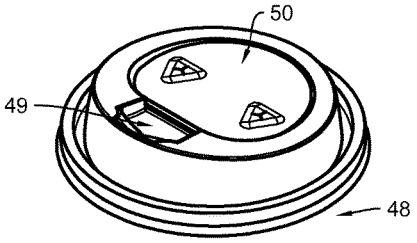
FIG. 19B is a reduced top perspective view of the seventh lid construction according to the present invention.
Figure 19C:
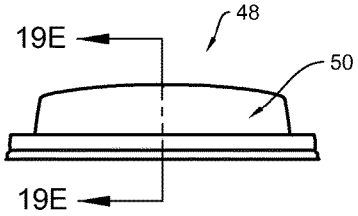
FIG. 19C is a reduced anterior edge elevational view of the seventh lid construction according to the present invention.
Figure 19E:
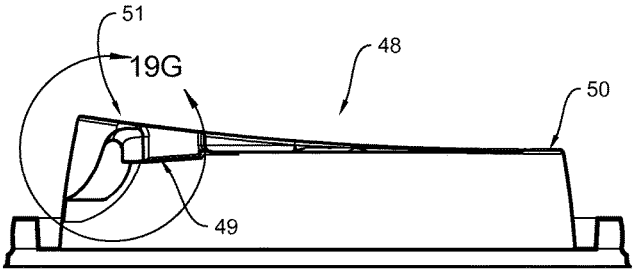
FIG. 19E is a longitudinal cross-sectional view of the seventh lid construction according to the present invention as sectioned from FIG. 19C.
Figure 19D:
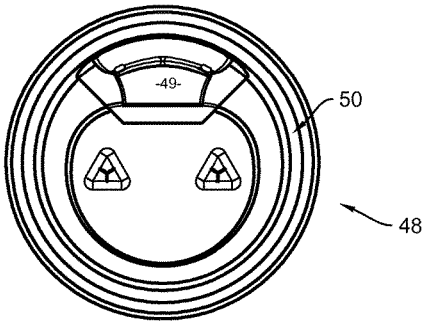
FIG. 19D is a reduced bottom plan view of the seventh lid construction according to the present invention showing the lower damming insert construction attached to the upper material construction of the ninth lid construction.
Figure 19G:
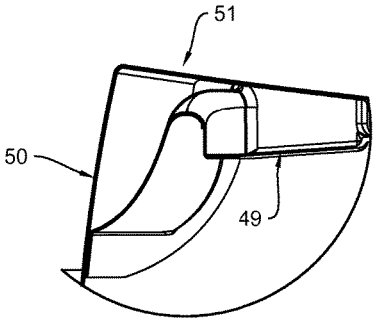
FIG. 19G is an enlarged sectional view of the junction site where the lower damming insert construction is attached to the upper material construction of the seventh lid construction as sectioned from FIG. 19E.
Figure 20:
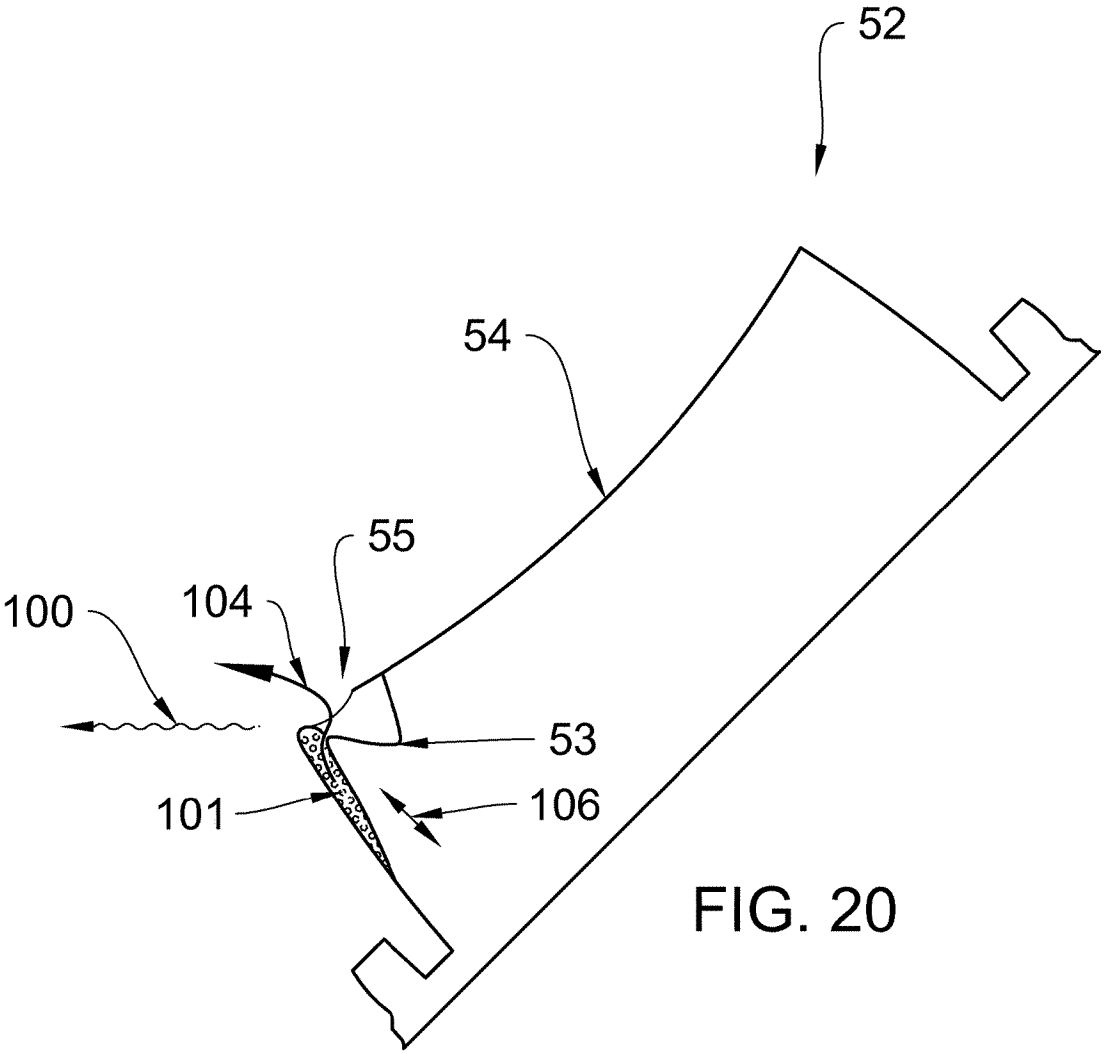
FIG. 20 is a longitudinal cross-sectional diagrammatic type depiction of an eighth lid construction according to the present invention showing a lower spring-like damming insert attached to an anterior wall of the lid construction in inferior adjacency to the primary beverage outlet.
Figure 21:
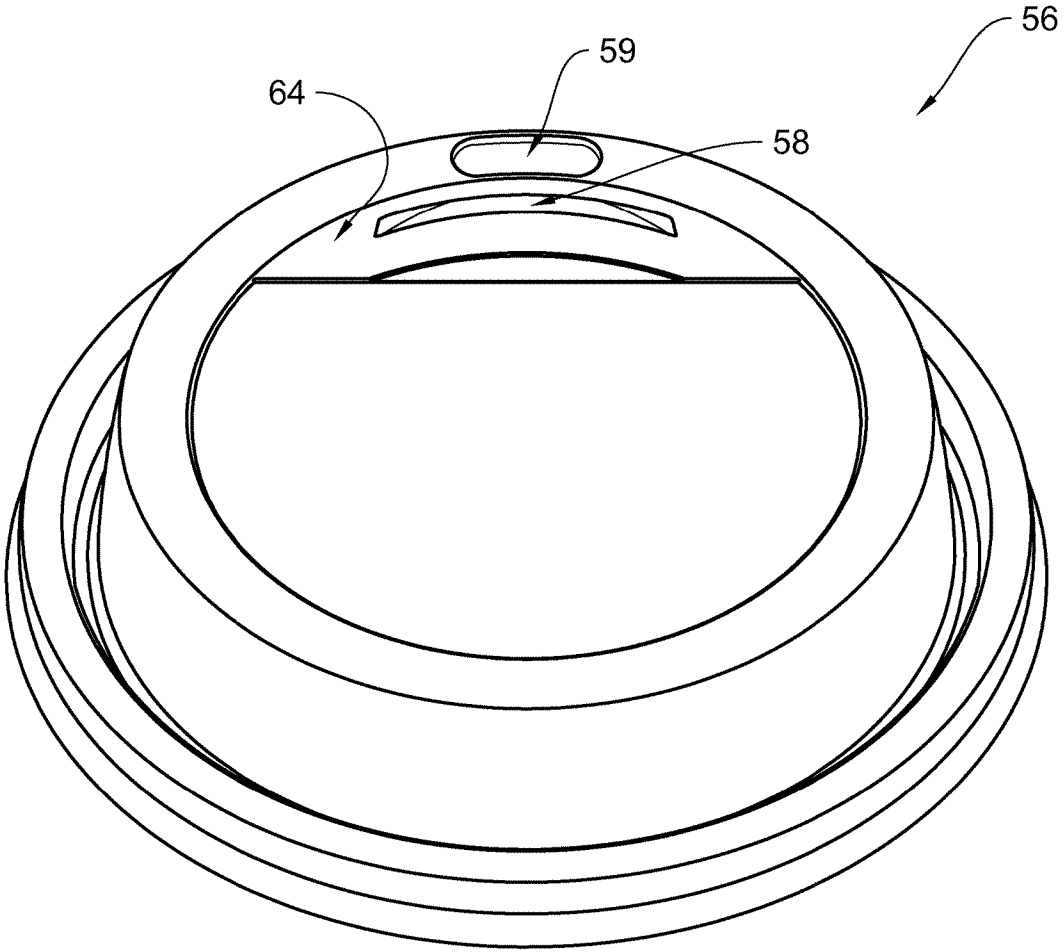
FIG. 21 is a first top perspective view of a ninth lid construction according to the present invention showing a damming depression formed in an inner wall of the lid construction in inferior adjacency to the primary beverage outlet.
Figure 22:
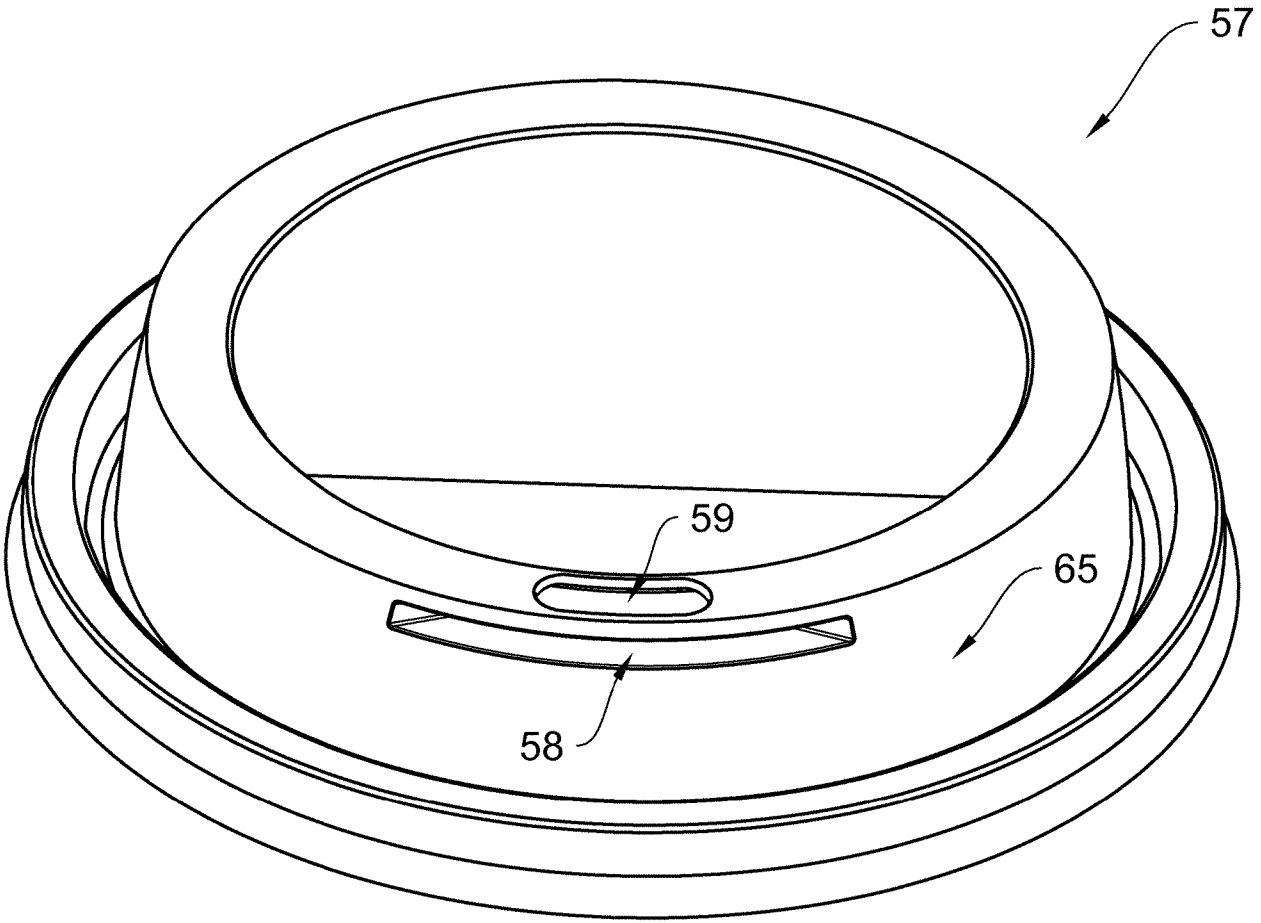
FIG. 22 is a first top perspective view of a tenth lid construction according to the present invention showing a damming depression formed in an outer wall of the lid construction in inferior adjacency to the primary beverage outlet.
Figure 23:
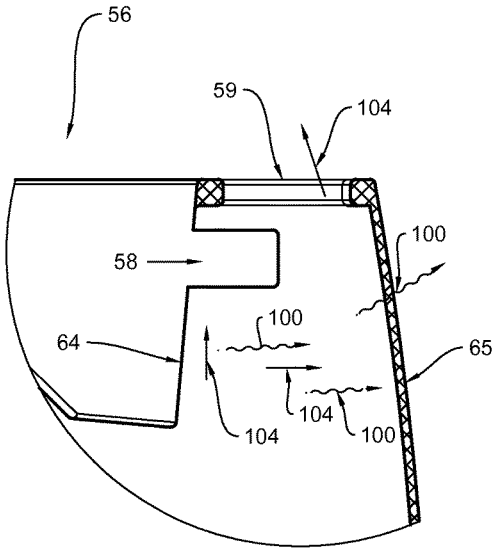
FIG. 23 is a first enlarged diagrammatic type fragmentary longitudinal cross-sectional view of the primary beverage outlet site of the ninth lid construction according to the present invention presented to depict beverage flow diversion around the damming depression formed in an inner wall inferior adjacency to the primary beverage outlet.
Figure 24:
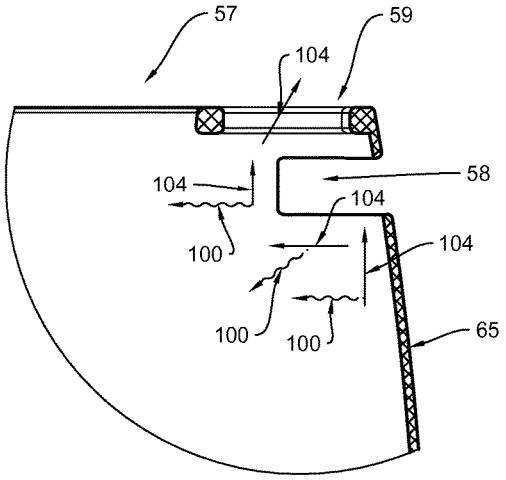
FIG. 24 is a first enlarged diagrammatic type fragmentary longitudinal cross-sectional view of the primary beverage outlet site of the tenth lid construction according to the present invention presented to depict beverage flow diversion around the damming depression formed in an outer wall in inferior adjacency to the primary beverage outlet.

Referencing FIGS. 18-19G, the reader will note that a seventh lid construction as at 48 according to the present invention. The lid construction 48 provides a reduced cost version for the lid construction whereby a lower damming insert construction 49 is attached to an upper lid body 50 in inferior adjacency to a primary beverage or consumable outlet formed as at 51. An eighth lid construction 52 according to the present invention is diagrammatically depicted in FIG. 20. The eighth lid construction 52 attempts to depict a spring-like lower or inner damming insert 53 attached to the upper or outer lid body 54, which insert 53 is attached in inferior adjacency to the primary beverage or consumable outlet as at 55.

Referencing FIGS. 21-24, the reader is directed to ninth and tenth lid constructions 56 and 57 respectively as may be exemplified by altered SOLO® brand and DART® brand lid constructions. The lid constructions 56 and 57 according to the present invention preferably comprise damming depressions or formations 58 formed in inferior adjacency to primary beverage or consumable liquid outlets 59. The damming depressions or formations 58 may be formed either in the inner lid wall 64 (as in the ninth lid construction 56) or in the outer lid wall 65 (as in the tenth lid construction 57).

The damming depressions or formations 58 are horizontally oriented in inferior adjacency to the primary beverage outlet(s) 59 for directing beverage flow 104 around the structural formations or damming bridges formed by the depressions or formations 58 so as to delay the final outlet of beverage or consumable liquid for enabling heat 100 to transfer from the beverage or consumable beverage flow 104 during the redirective movements as at 104' and 104", and for preventing inadvertent spillage as previously described. The reader is directed to FIGS. 30-33 for added details/disclosures relating to this structural development.

Figure 25:
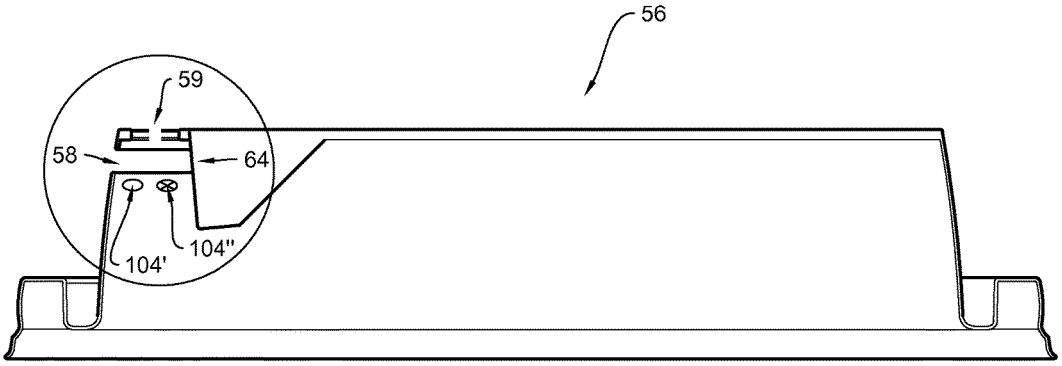
FIG. 25 is a longitudinal cross-sectional view of the tenth lid construction according to the present invention presented to depict beverage flow diversion around the damming depression formed in an outer wall inferior adjacency to the primary beverage outlet.
Figure 26:
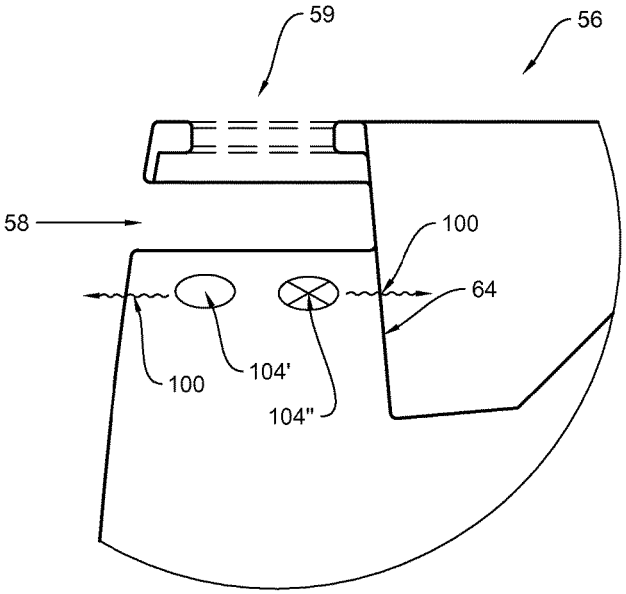
FIG. 26 is an enlarged fragmentary longitudinal cross-sectional view of the primary beverage outlet site of the tenth lid construction otherwise depicted in FIG. 25.
Figure 27:
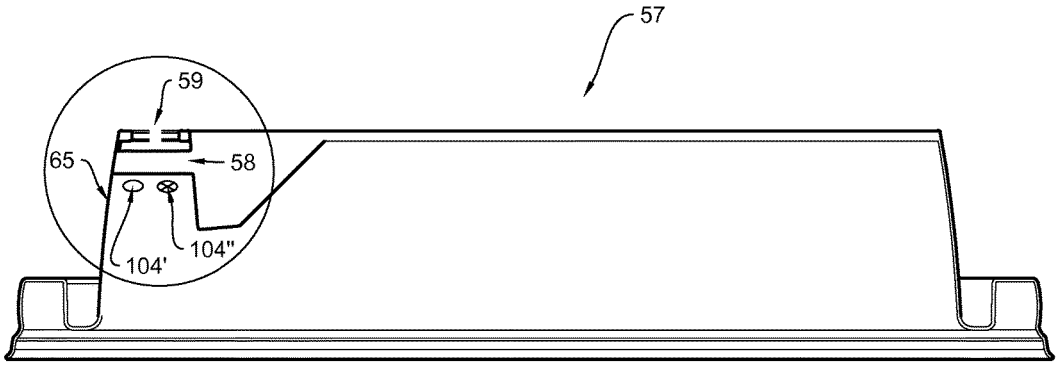
FIG. 27 is a longitudinal cross-sectional view of the ninth lid construction according to the present invention presented to depict beverage flow diversion around the damming depression formed in an inner wall inferior adjacency to the primary beverage outlet.
Figure 28:
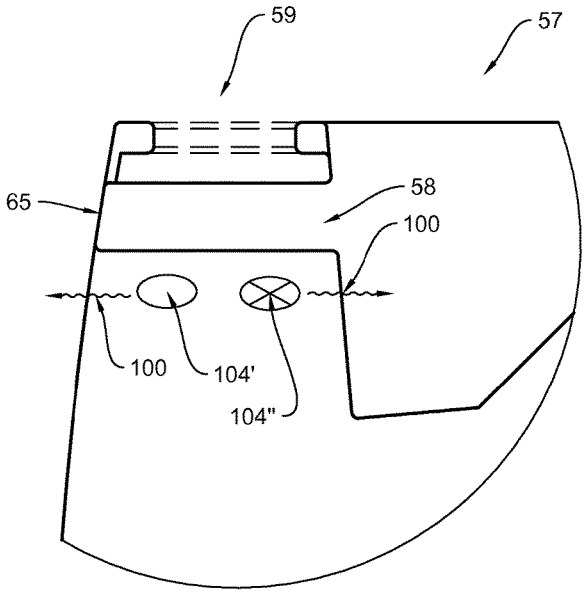
FIG. 28 is an enlarged fragmentary longitudinal cross-sectional view of the primary beverage outlet site of the ninth lid construction otherwise depicted in FIG. 27.

FIGS. 25 and 26 depict a depression or formation or structure 58 extending inwardly in inferior adjacency to the primary beverage or consumable beverage outlet 59 toward an inner lid wall 64 of lid construction 56. It will be noted that the depression or formation or structure 58 extends to the inner lid wall 64 and thus that liquid flow (as at 104) may be preferably redirected laterally either out of the page as at vector 104' or into the page as at vector 104" for enabling heat 100 transfer from the liquid flow(s) 104' and/or 104", and for preventing inadvertent spillage as previously described. FIGS. 27 and 28 depict a depression or formation or structure 58 extending outwardly in inferior adjacency to the primary beverage outlet 59 toward an outer lid wall 65 of lid construction 57. It will be noted that the depression or formation or structure 58 extends to the outer lid wall 65 and thus that liquid flow (as at 104) may be preferably redirected laterally either out of the page as at vector 104' or into the page as at vector 104" for enabling heat 100 transfer from the liquid flow(s) 104' and/or 104", and for preventing inadvertent spillage as previously described.

Figure 29:
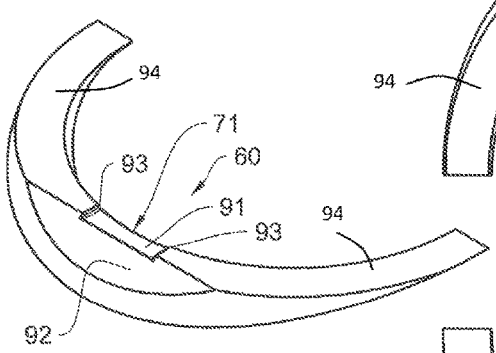
FIG. 29 is a top perspective view of a first damming insert construction that is insertable into or otherwise cooperable with a SOLO® brand lid construction for slowing beverage flow from the outfitted beverage container assembly.
Figure 30:
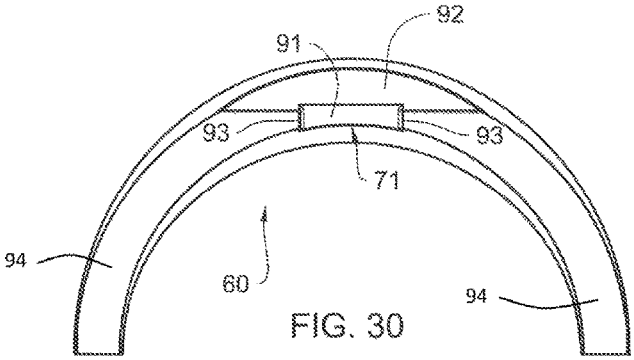
FIG. 30 is a bottom plan view of the first damming insert construction that is insertable into or otherwise cooperable with a SOLO® brand lid construction for slowing beverage flow from the outfitted beverage container assembly.
Figure 31:
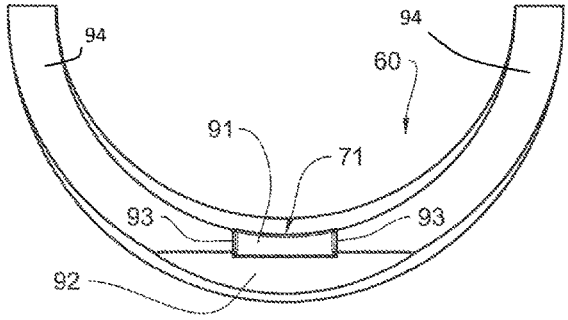
FIG. 31 is a top plan view of the first damming insert construction that is insertable into or otherwise cooperable with a SOLO® brand lid construction for slowing beverage flow from the outfitted beverage container assembly.

Referencing FIGS. 29-31, the reader is directed to a damming insert construction 60 designed to outfit a SOLO® brand lid construction. The damming insert construction 60 may be preferably inserted into a SOLO® brand lid construction in inferior adjacency to the primary beverage or consumable liquid outlet as at 59 for slowing beverage or consumable liquid flow 104 from the primary beverage or consumable liquid outlet 59 for enabling heat 100 to transfer therefrom prior to consumption by the user/drinker, and for preventing inadvertent spillage as previously described.

Figure 32:
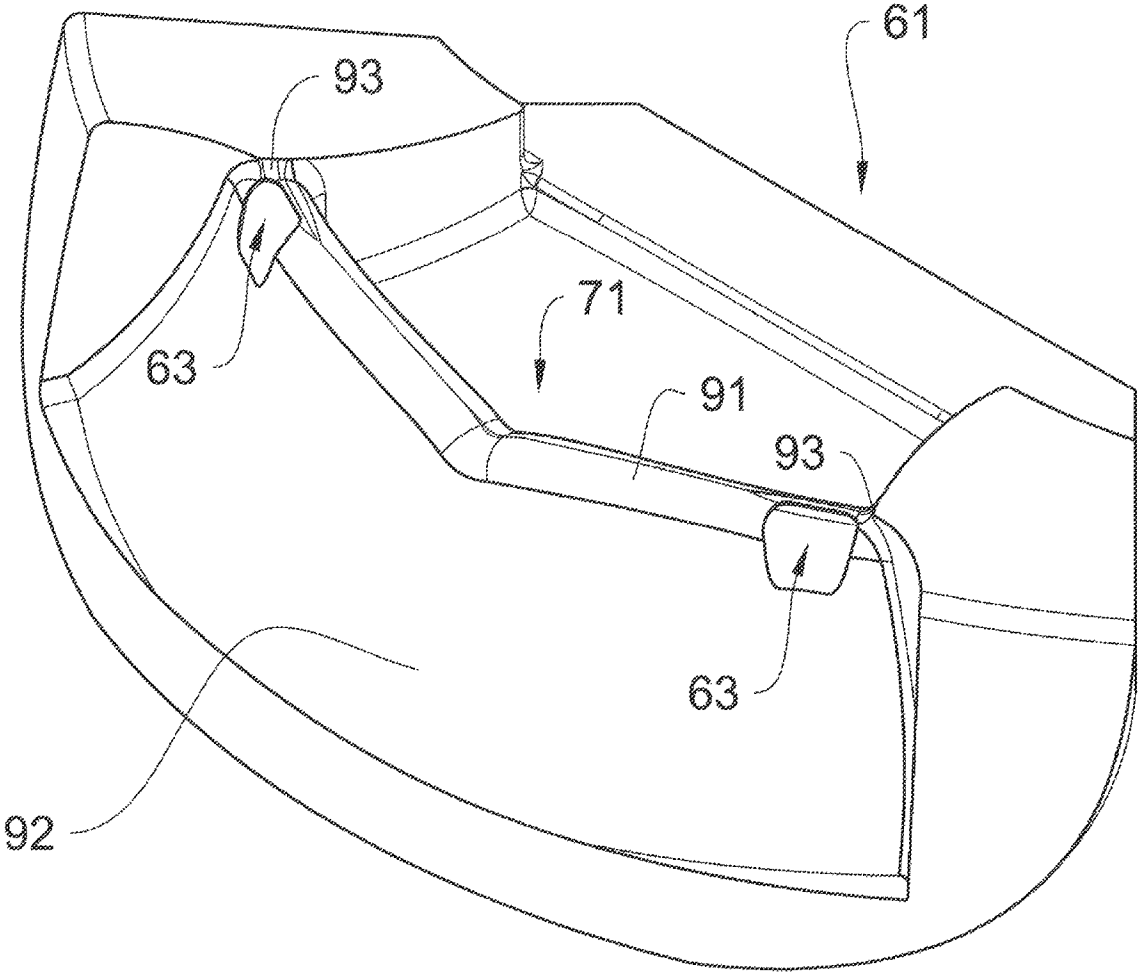
FIG. 32 is an enlarged fragmentary top perspective view of a second damming insert construction that is insertable into or otherwise cooperable with brand name lid construction(s) for slowing beverage flow from the outfitted beverage container assembly.
Figure 33:
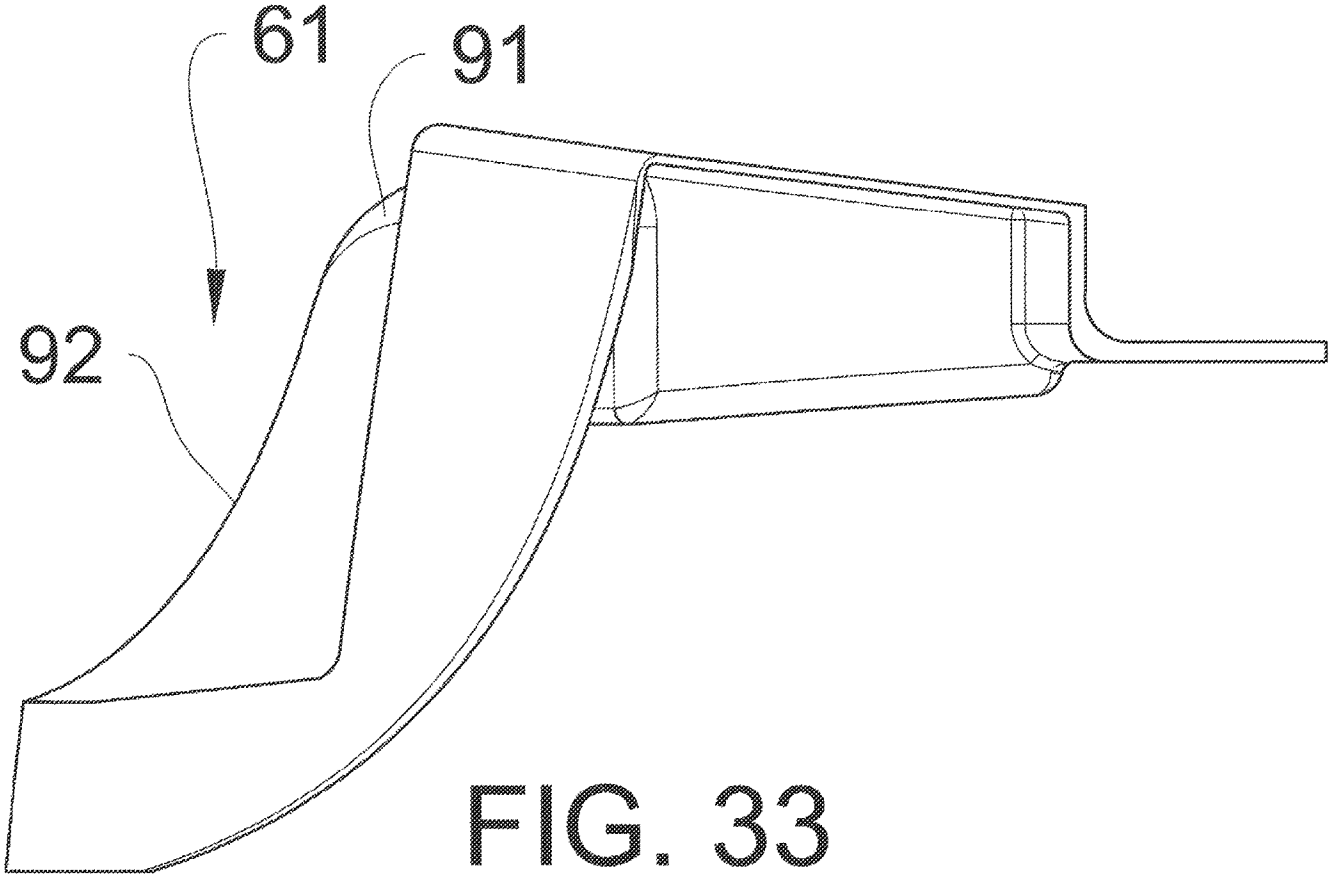
FIG. 33 is an enlarged fragmentary lateral view of the second damming insert construction that is insertable into or otherwise cooperable with brand name lid construction(s) for slowing beverage flow from the outfitted beverage container assembly.

Referencing FIGS. 32 and 33, the reader is directed to a second damming insert construction 61 designed to outfit other brand name lid constructions. The reader is particularly directed to laterally-opposed beverage-letting apertures 63 formed in the construction 61. The damming insert construction 61 may be inserted into brand name lid construction(s) in inferior adjacency to the primary beverage or consumable liquid outlet(s) (e.g. outlet 59) for slowing beverage or consumable liquid flow from the primary beverage or consumable beverage outlet for enabling heat 100 to transfer therefrom prior to consumption by the user/drinker, and for preventing inadvertent spillage as previously described.

Figure 34:
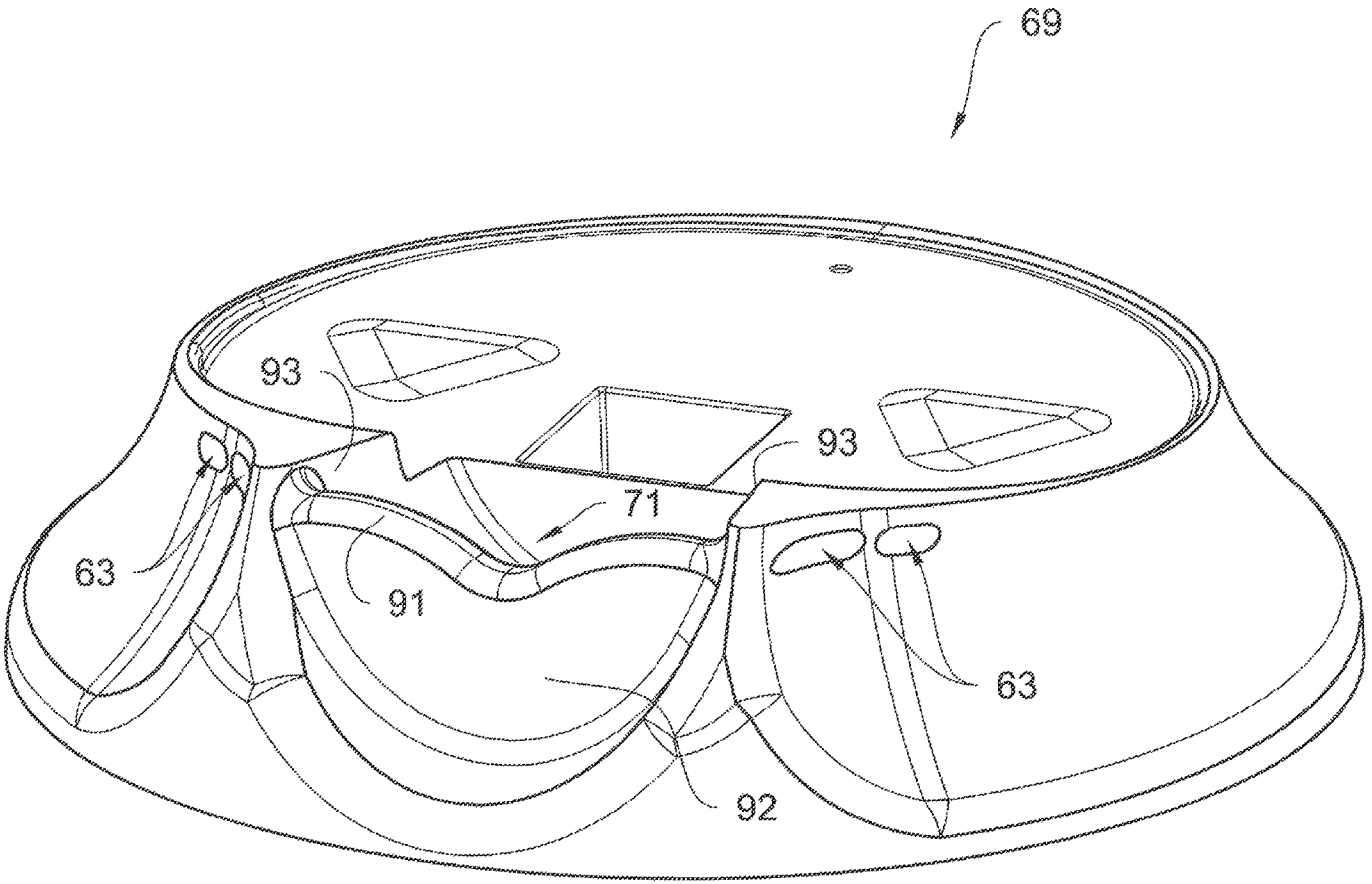
FIG. 34 is a top perspective view of a third damming insert construction according to the present invention.
Figure 35:
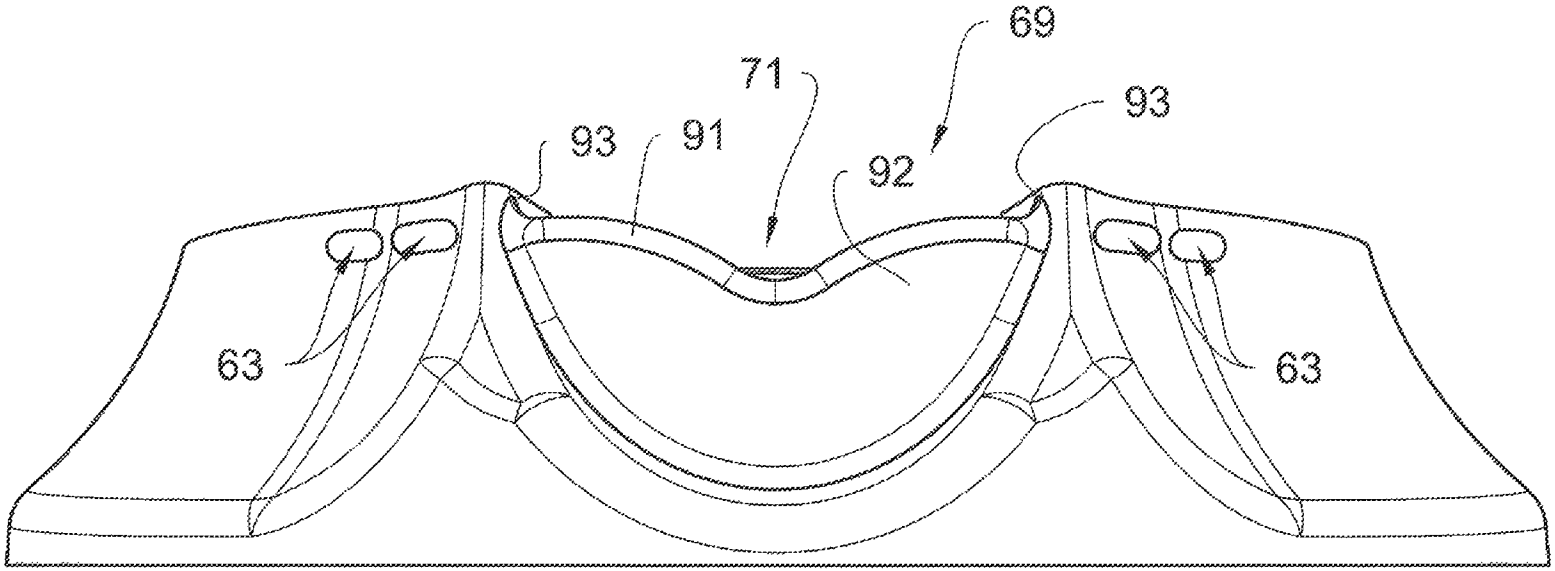
FIG. 35 is a frontal or anterior edge elevational view of the third damming insert construction according to the present invention.
Figure 36:
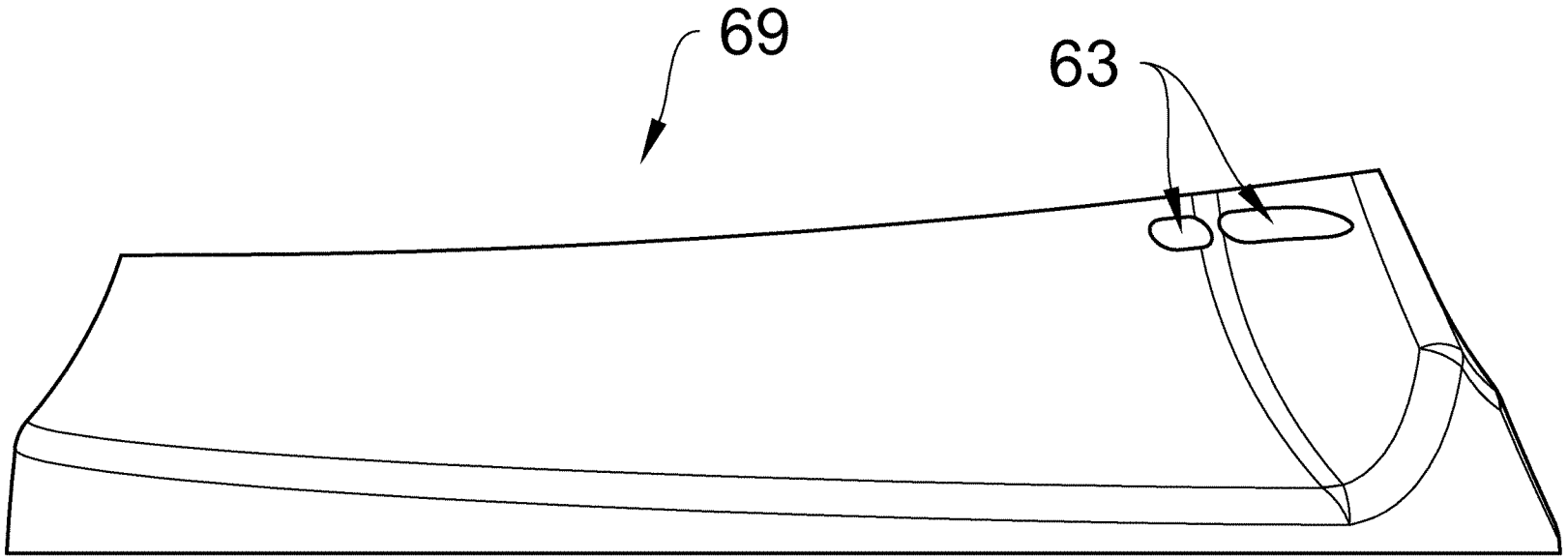
FIG. 36 is a lateral edge elevational view of the third damming insert construction according to the present invention.

FIGS. 34-38 depict certain other damming insert constructions usable in connection with certain brand name lid constructions, including those currently used by McDonald's Corporation. FIGS. 34-36 depict a relatively more elaborate damming insert construction 69 for effecting various consumable liquid flow cooling channels when fastened in inferior adjacency to an upper lid body. The various contours of the damming insert construction 69 are specifically contoured so as to direct and/or slow consumable liquid flow 104 for transferring heat therefrom, and for preventing inadvertent spillage as previously described. Laterally opposed beverage/air-letting apertures 63 enable transfer of hot consumable liquid 101 from the beverage- or consumable liquid-containing compartment into the cooling channels and formations enabled by the damming insert construction 69.

Figure 37:
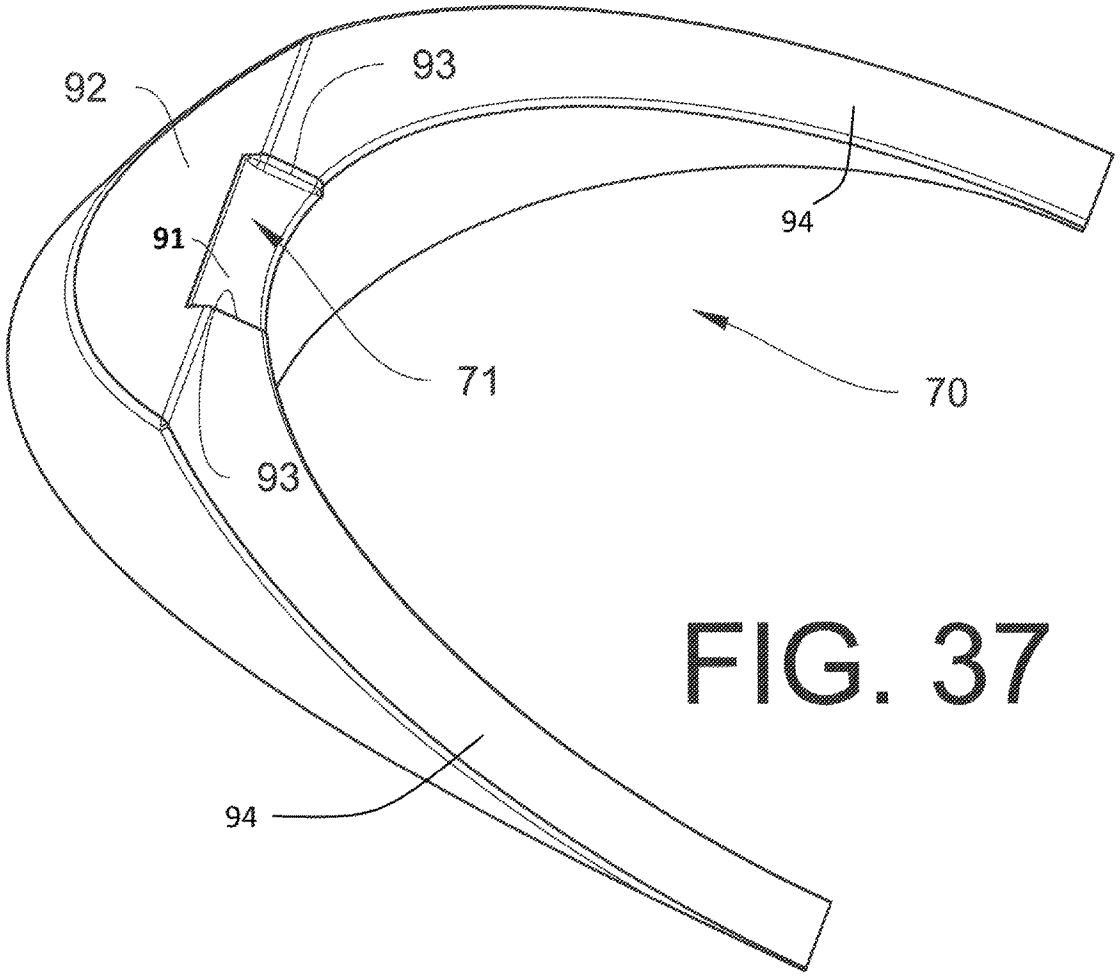
FIG. 37 is a first enlarged top perspective view of the first damming insert construction according to the present invention.
Figure 38:
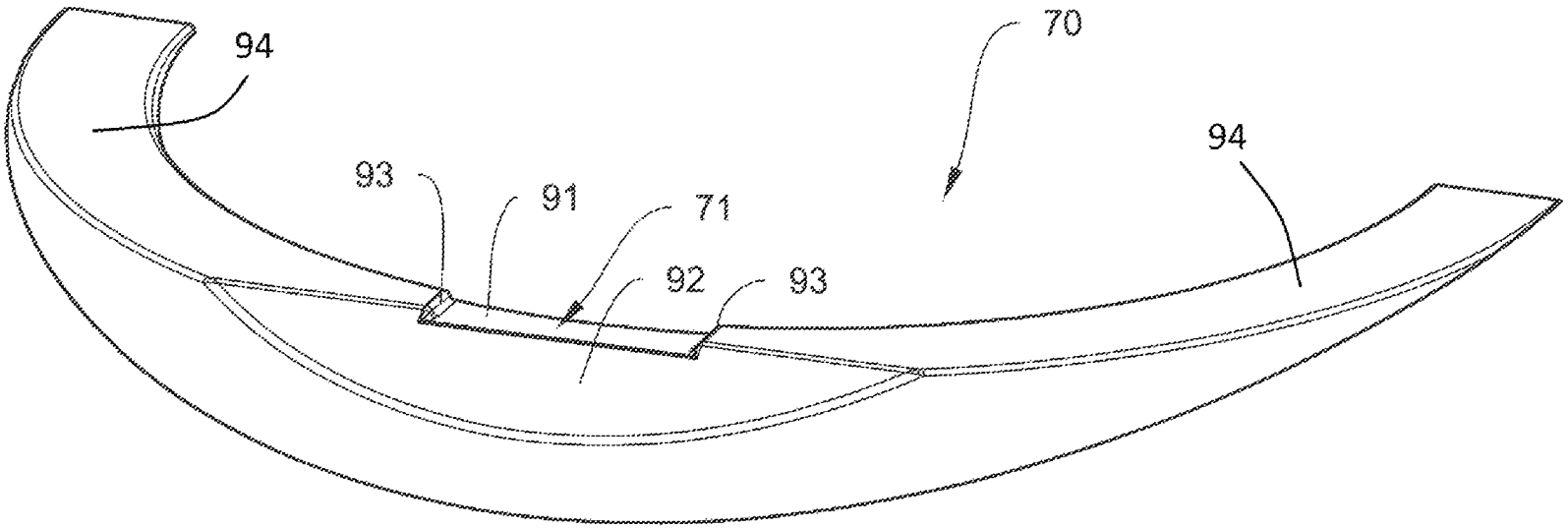
FIG. 38 is a second enlarged top perspective view of the first damming insert construction according to the present invention.

FIGS. 37 and 38 depict a relatively more basic damming insert construction 70 for basically effecting a liquid damming effect (at relatively reduced manufacturing costs) when fastened in inferior adjacency to an upper lid body. The various contours of the damming insert construction 70 are specifically contoured so as to dam beverage or consumable liquid flow 104 for transferring heat therefrom, and for preventing inadvertent spillage as previously described. For example, an upper liquid spillway 71 enables transfers of hot beverage or consumable liquid 101 from the beverage- or consumable liquid-containing compartment through the primary beverage or consumable liquid outlet (e.g. outlet 59).

A forward, central, and upper liquid spillway 71 is generally depicted and referenced as such in FIG. Nos. 29-32, 34, 35, 37, and 38. The forward, central, and upper liquid spillway 71 preferably comprises an upper sloped region as at 91 and a lower sloped region as at 92 and is preferably positioned centrally intermediate opposed lid-engaging portions 94 extending laterally and rearwardly from the forward, central, and upper liquid spillway 71. The upper and lower sloped regions 91 and 92 are differently sloped relative to one another as is readily understood from a comparative inspection of the noted figures. The upper sloped region 91 is preferably laterally bound by laterally opposed upright structures 93 for defining at least one free-flow, liquid-letting pathway over or around the lower damming insert elements there illustrated. Laterally-opposed beverage-letting apertures 63 may preferably be formed in laterally opposed relation relative to the central upper liquid spillway 71 as further depicted in certain embodiments.

Figure 39:
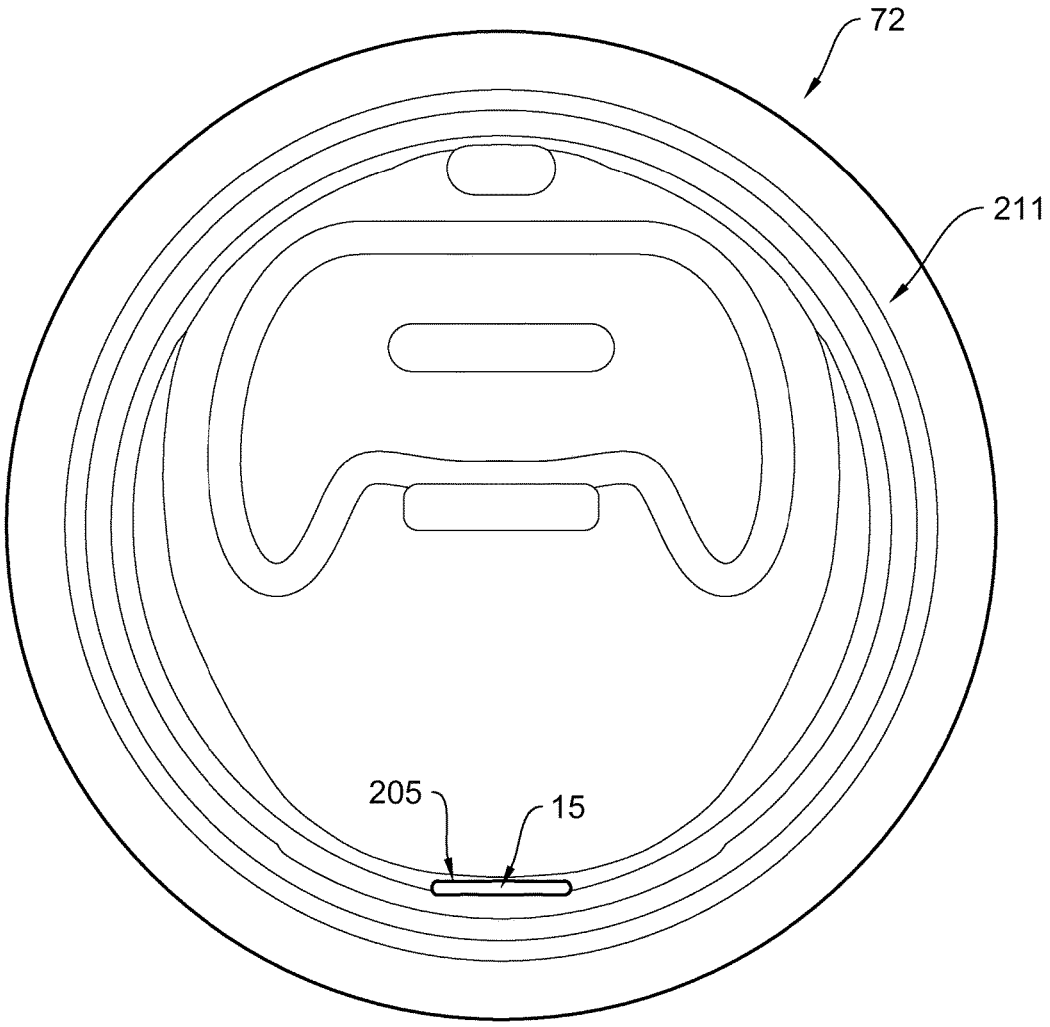
FIG. 39 is a top plan view of an eleventh lid construction according to the present invention showing a relatively narrow, laterally-extending primary beverage outlet.
Figure 40:
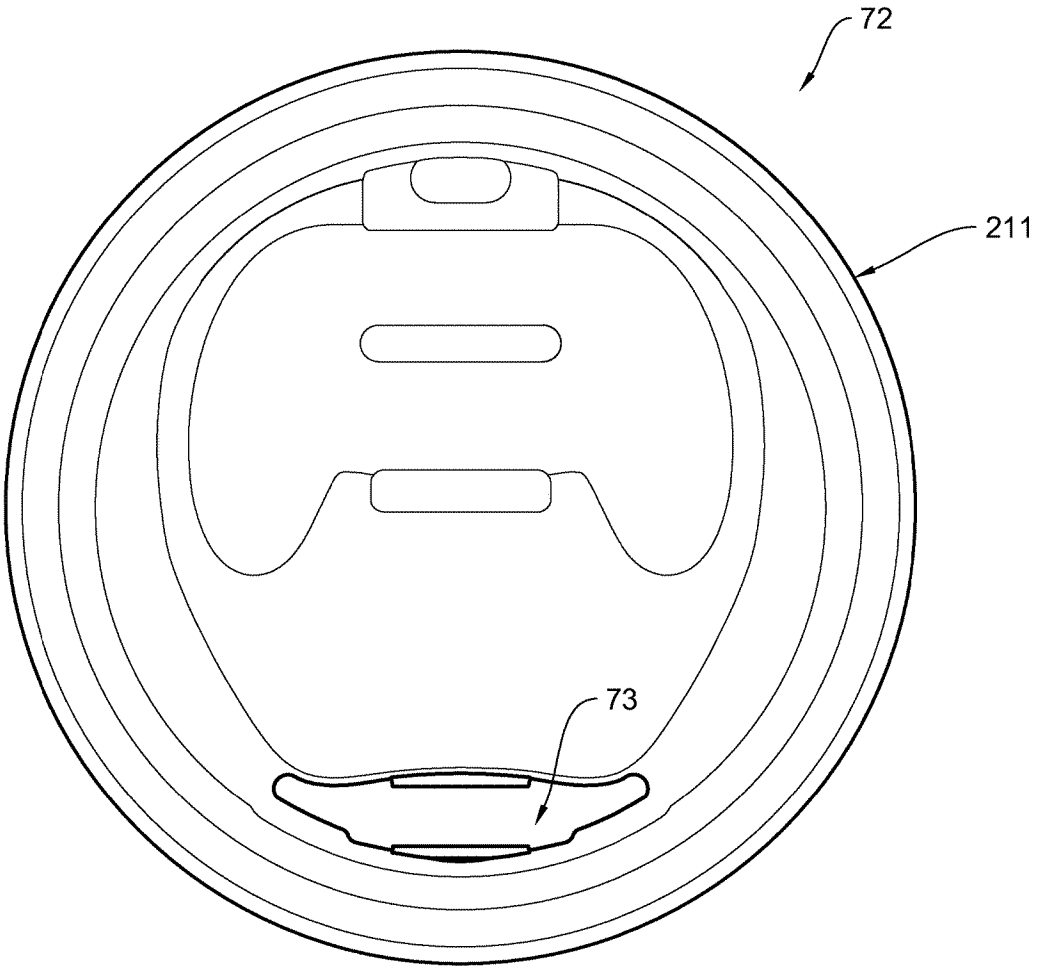
FIG. 40 is a bottom plan view of the eleventh lid construction according to the present invention showing a damming insert construction attached to the lid construction in inferior adjacency to the relatively narrow, laterally-extending primary beverage outlet.

Referencing FIGS. 39 and 40, the reader is directed to a top plan view of a eleventh lid construction 72 according to the present invention (i.e. a DART.RTM. brand lid utilized by Dunkin Brands Group, Inc.) showing a narrow laterally-extending (having a shape 205) primary beverage or consumable liquid outlet as at 15 in FIG. 39. FIG. 40 is a bottom plan view of the eleventh lid construction 72 according to the present invention showing a lower damming insert construction 73 attached to an upper lid body as at 211 in inferior adjacency to the narrow laterally-extending primary beverage or consumable liquid outlet 15 (not specifically illustrated in FIG. 40).

Figure 41:
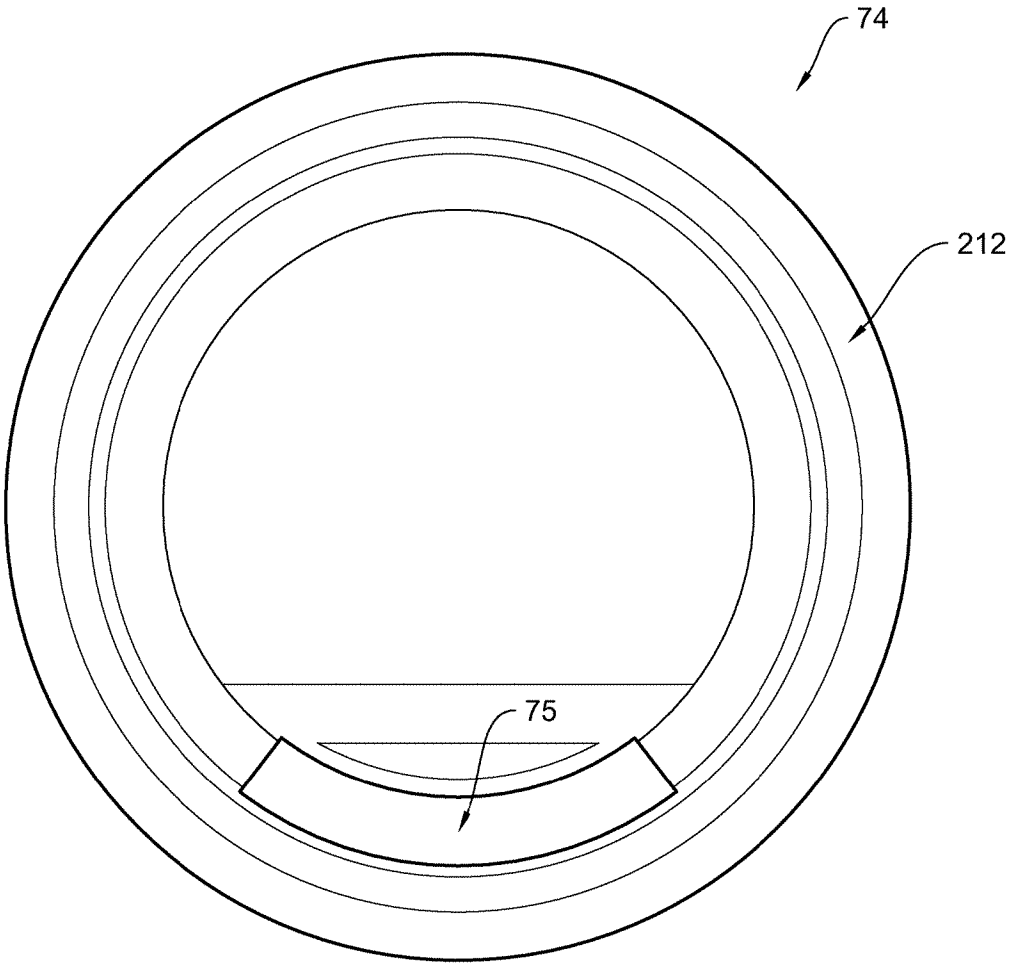
FIG. 41 is a bottom plan view of a twelfth lid construction according to the present invention showing a damming insert construction attached to the lid construction in inferior adjacency to the primary beverage outlet.
Figure 42:
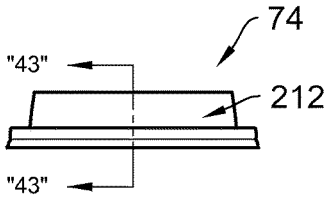
FIG. 42 is a reduced anterior edge elevational view of the twelfth lid construction according to the present invention.
Figure 43:
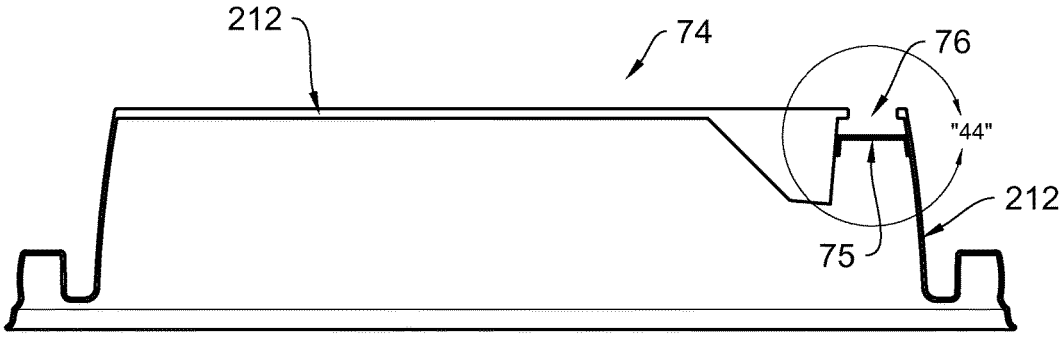
FIG. 43 is a longitudinal cross-sectional depiction of the of the twelfth lid construction as sectioned from FIG. 42.
Figure 44:
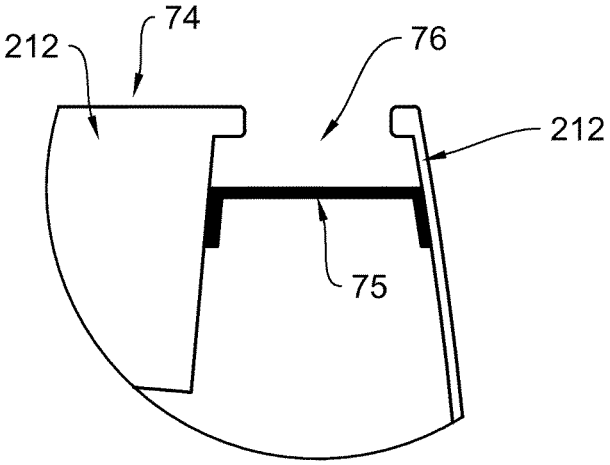
FIG. 44 is an enlarged fragmentary sectional depiction of the primary beverage outlet and damming insert junction site sectioned from FIG. 43.
Figure 48:
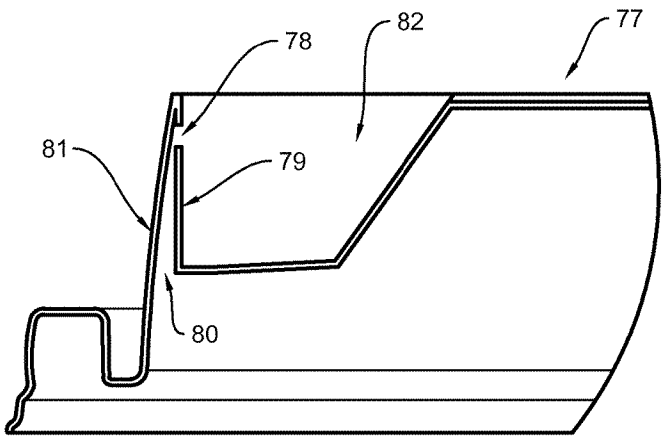
FIG. 48 is an enlarged fragmentary sectional view of the primary beverage outlet site of the thirteenth lid construction as sectioned from FIG. 47.
Figure 47:
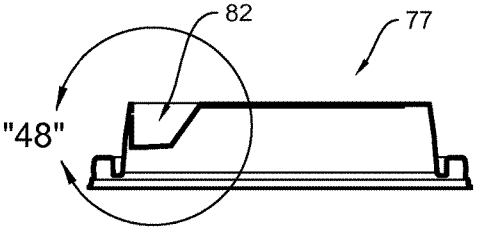
FIG. 47 is a longitudinal cross-sectional depiction of the thirteenth lid construction as sectioned from FIG. 46.
Figure 45:
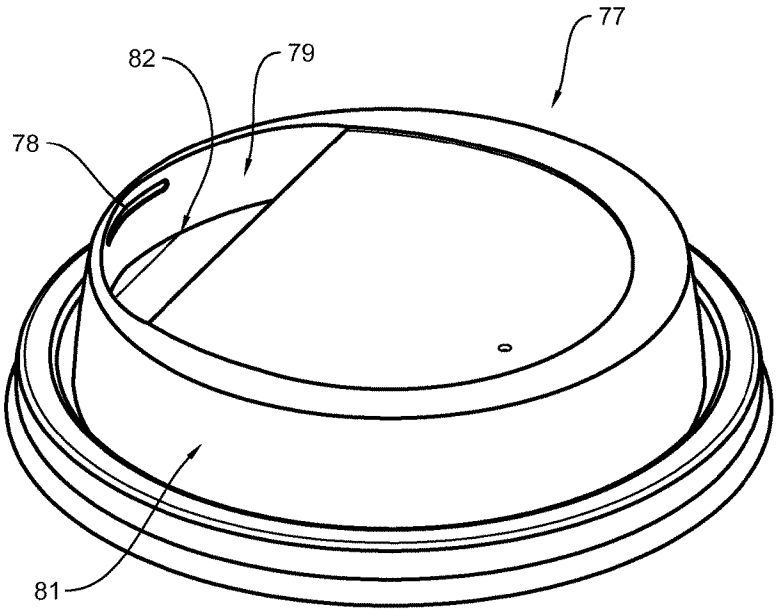
FIG. 45 is a top perspective view of a thirteenth lid construction according to the present invention.
Figure 46:
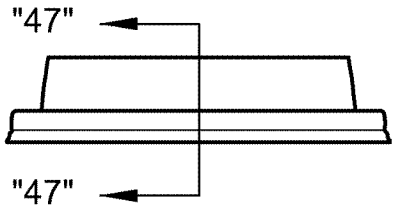
FIG. 46 is an anterior edge elevational view of the thirteenth lid construction according to the present invention.
Figure 52:
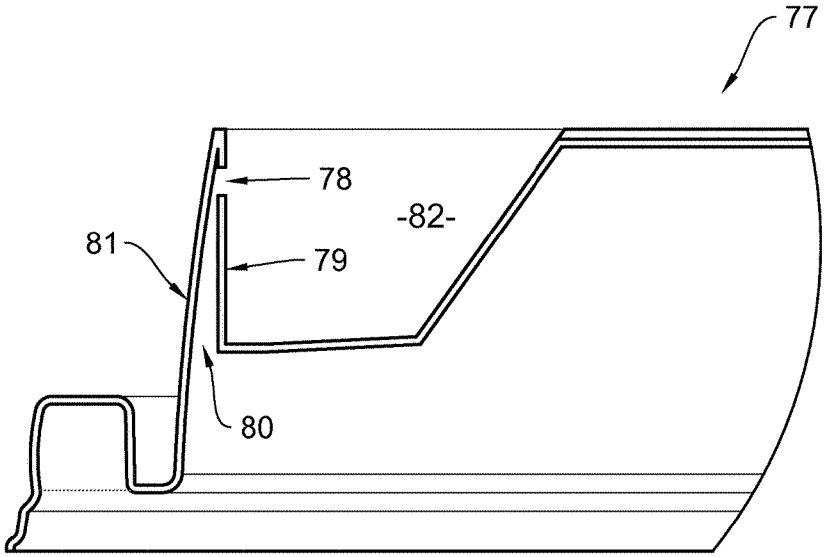
FIG. 52 is an enlarged fragmentary sectional view of the primary beverage outlet site of the thirteenth lid construction as sectioned from FIG. 51.
Figure 51:
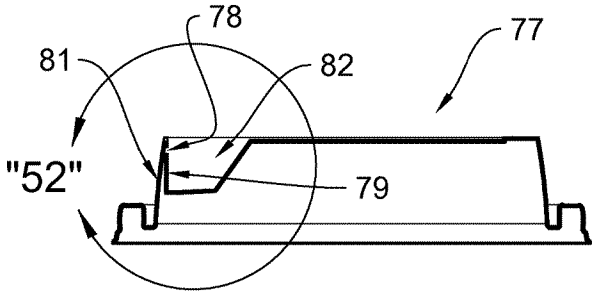
FIG. 51 is a longitudinal cross-sectional depiction of the thirteenth lid construction as sectioned from FIG. 50.
Figure 49:
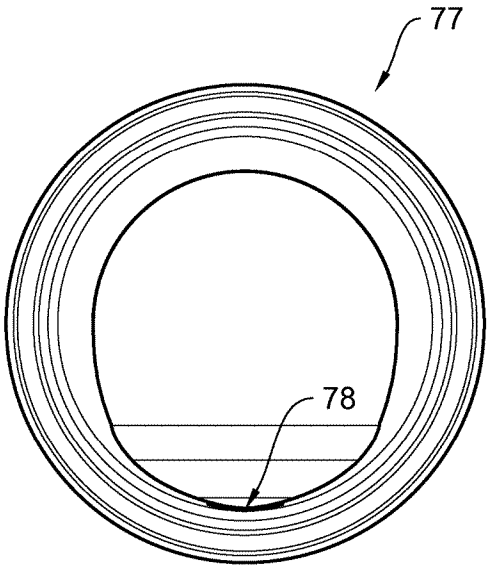
FIG. 49 is a bottom plan view the thirteenth lid construction according to the present invention referencing the primary beverage outlet formed in a vertical wall of the thirteenth lid construction.
Figure 50:
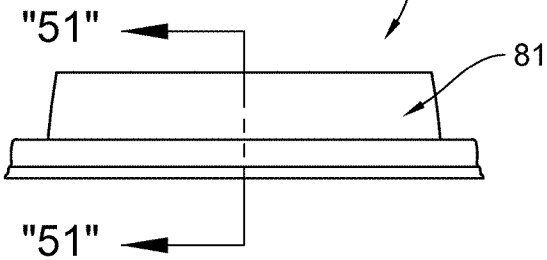
FIG. 50 is an anterior edge elevational view of the thirteenth lid construction according to the present invention.
Figure 56:
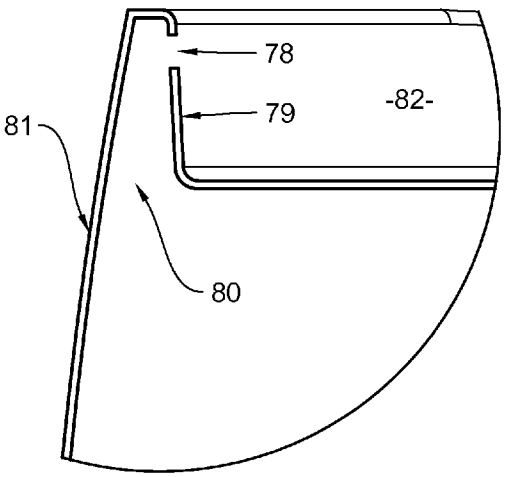
FIG. 56 is an enlarged fragmentary sectional view of the primary beverage outlet site of the fourteenth lid construction as sectioned from FIG. 55.
Figure 55:
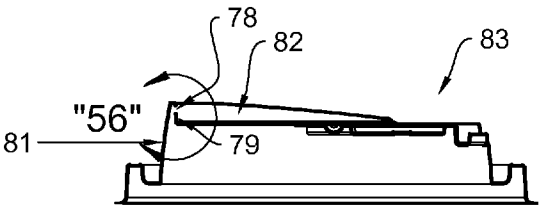
FIG. 55 is a longitudinal cross-sectional depiction of the fourteenth lid construction as sectioned from FIG. 54.
Figure 53:
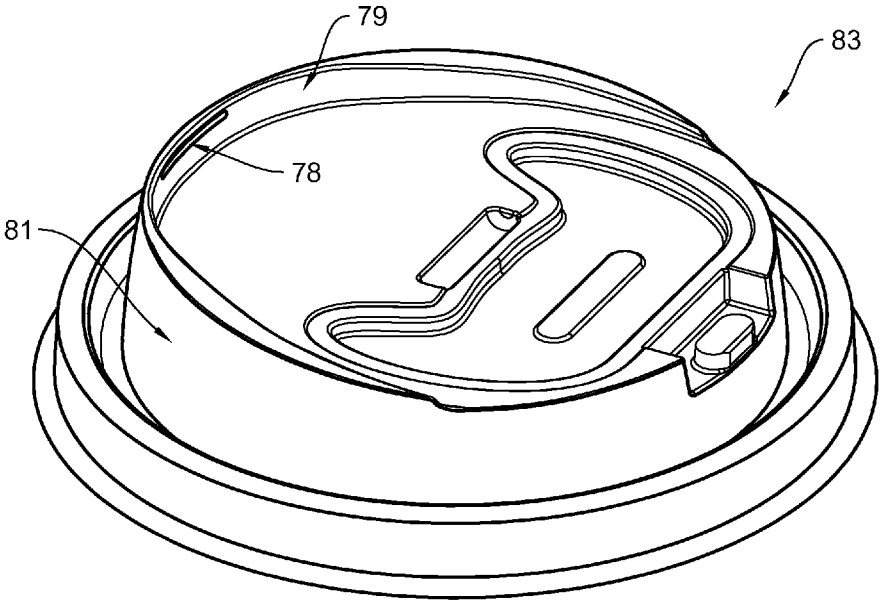
FIG. 53 is a top perspective view the fourteenth lid construction according to the present invention referencing the primary beverage outlet formed in a vertical wall of the fourteenth lid construction.
Figure 54:
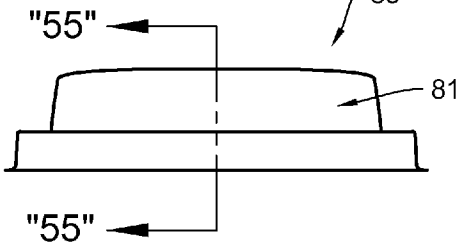
FIG. 54 is an anterior edge elevational view of the fourteenth lid construction according to the present invention.
Figure 58:
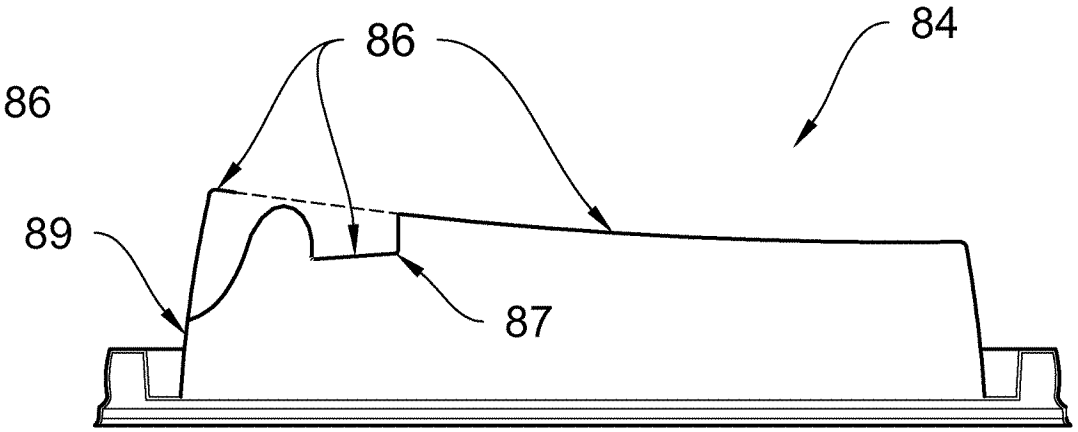
FIG. 58 is a longitudinal cross-sectional type depiction of the fifteenth lid construction according to the present invention.
Figure 57:
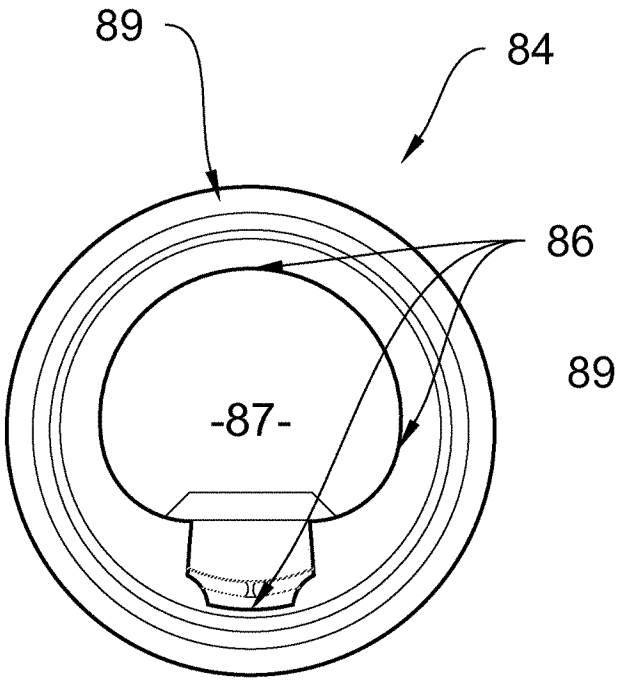
FIG. 57 is a bottom plan view depiction of a fifteenth lid construction according to the present invention showing a perimeter where a state of the art lid construction is cut and a damming insert according to the present invention is inserted.
Figure 59:
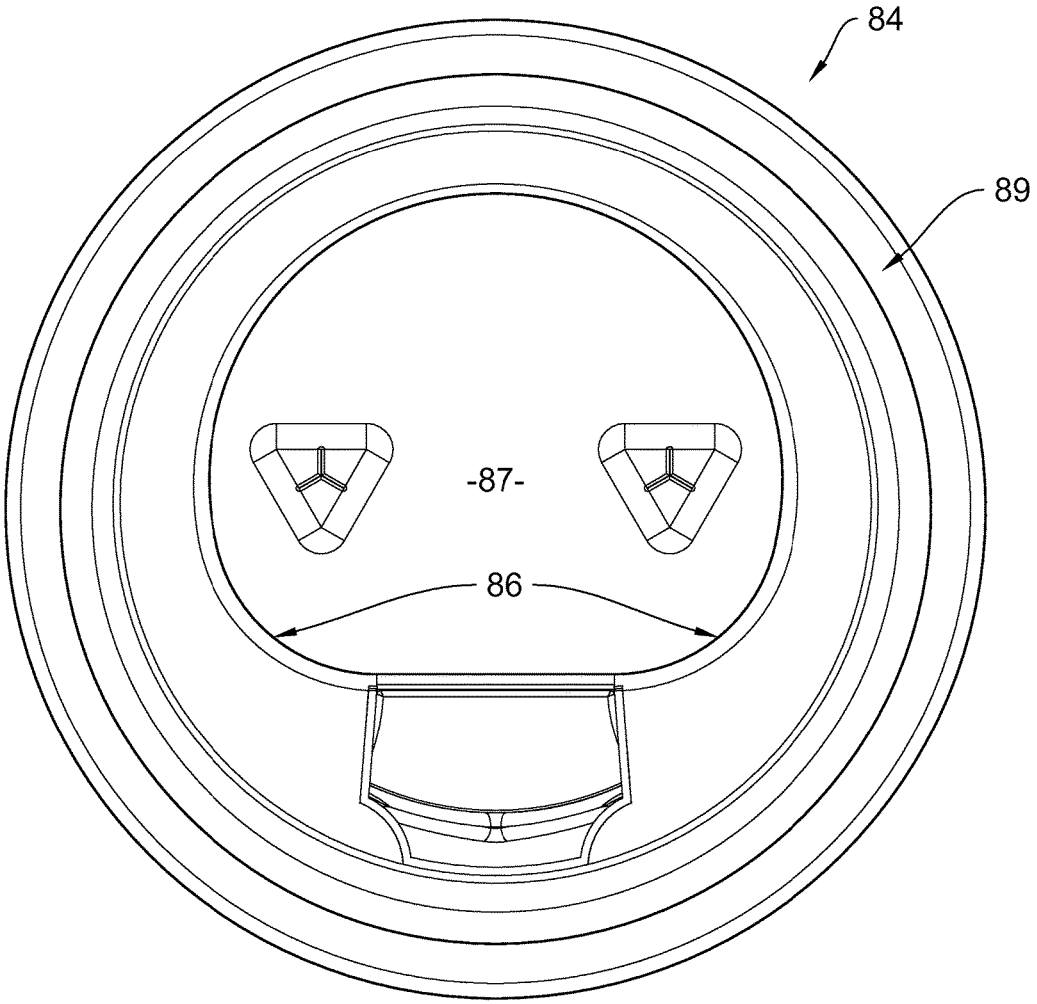
FIG. 59 is a bottom plan view the fifteenth lid construction according to the present invention.
Figure 60:
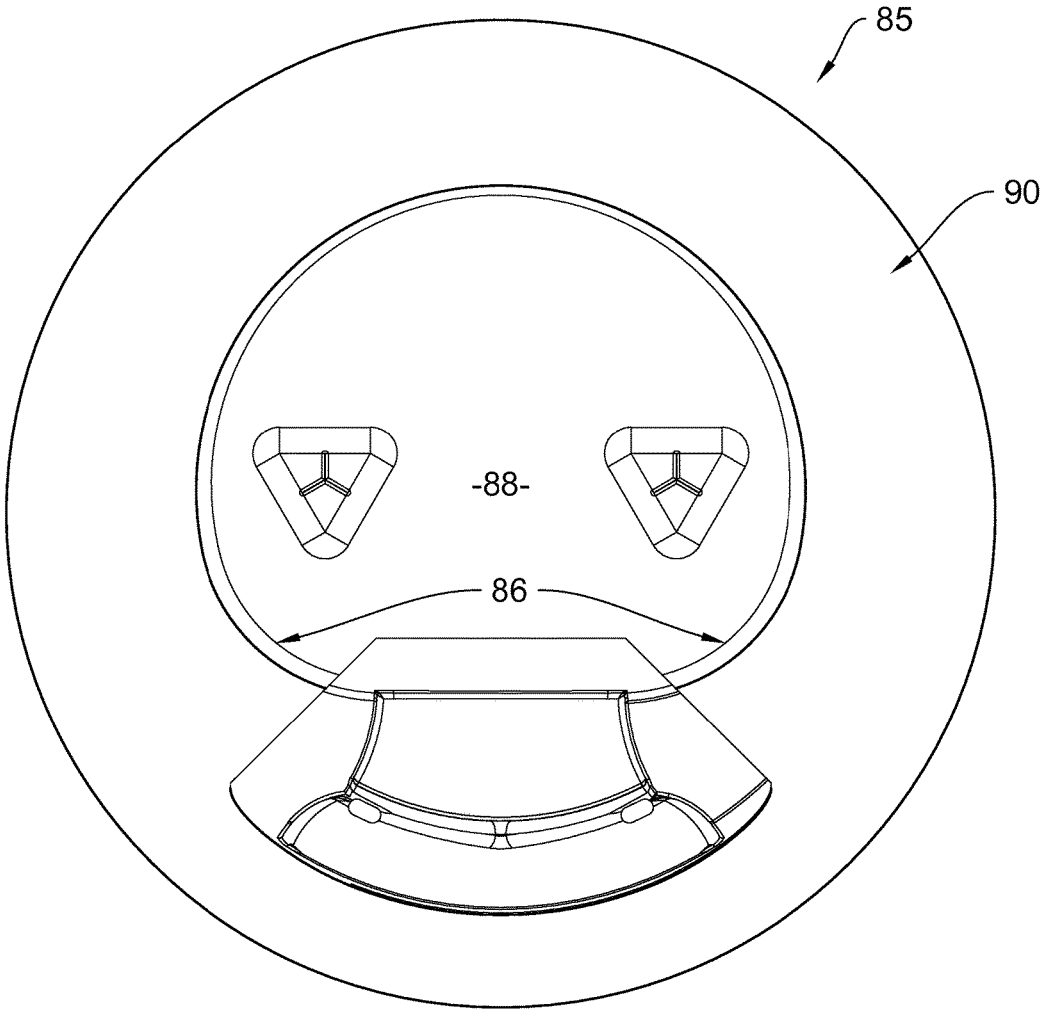
FIG. 60 is a bottom plan view a sixteenth lid construction according to the present invention.
Figure 64:
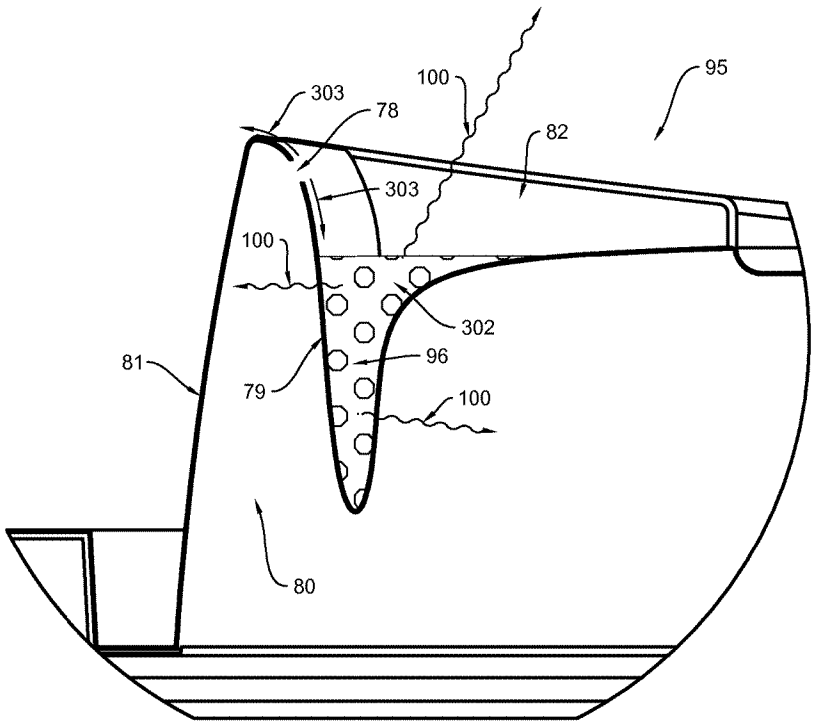
FIG. 64 is an enlarged fragmentary sectional view of the primary beverage outlet site of the seventeenth lid construction as sectioned from FIG. 63.
Figure 63:
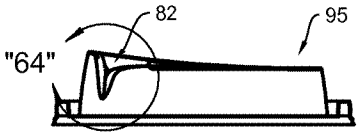
FIG. 63 is a longitudinal cross-sectional depiction of the seventeenth lid construction as sectioned from FIG. 62.
Figure 61:
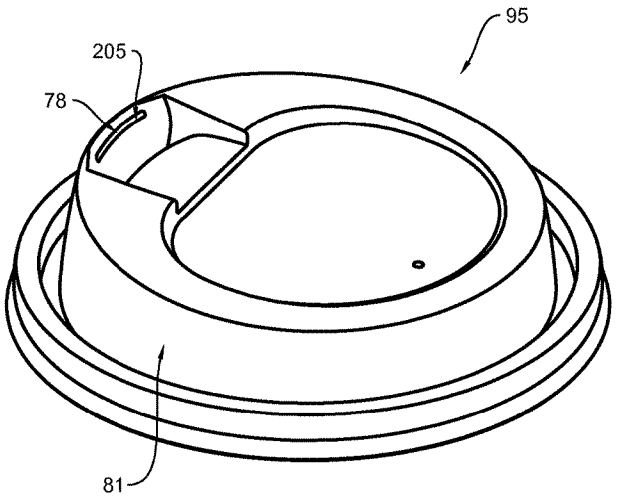
FIG. 61 is a top perspective view of a seventeenth lid construction according to the present invention.
Figure 62:
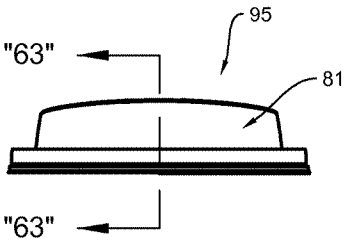
FIG. 62 is an anterior edge elevational view of the seventeenth lid construction according to the present invention.
Figure 68:
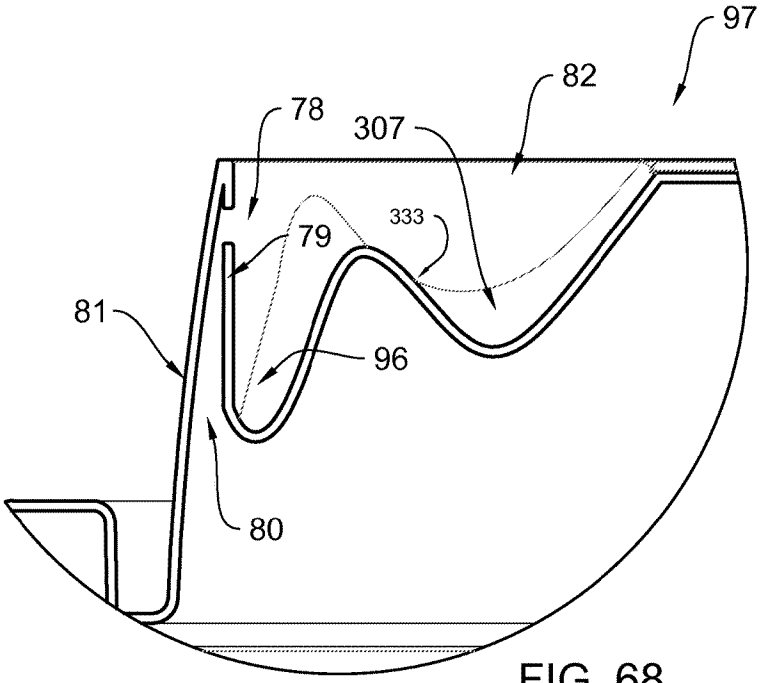
FIG. 68 is a first enlarged fragmentary sectional view of the primary beverage outlet site of the eighteenth lid construction as sectioned from FIG. 67.
Figure 67:
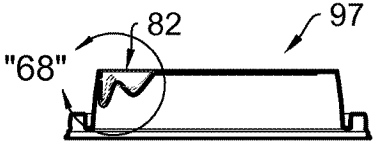
FIG. 67 is a first longitudinal cross-sectional depiction of the eighteenth lid construction as sectioned from FIG. 66.
Figure 66:
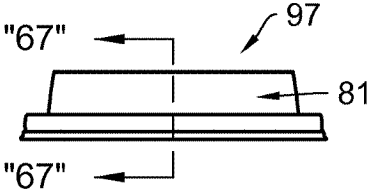
FIG. 66 is a first anterior edge elevational view of the eighteenth lid construction according to the present invention.
Figure 65:
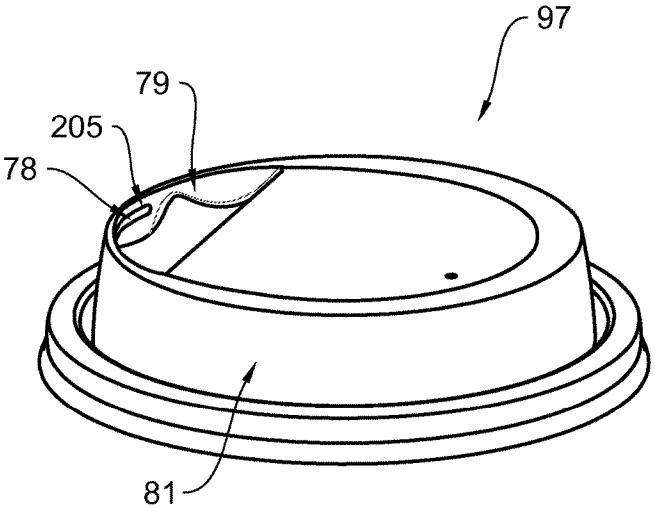
FIG. 65 is a first top perspective view of an eighteenth lid construction according to the present invention.
Figure 72:
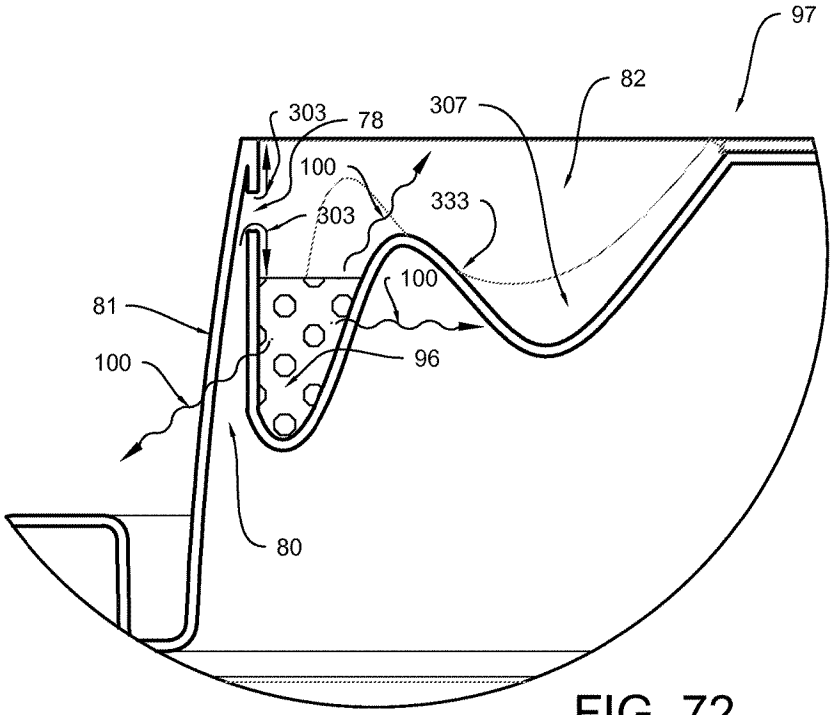
FIG. 72 is a second enlarged fragmentary sectional view of the primary beverage outlet site of the eighteenth lid construction as sectioned from FIG. 71.
Figure 71:
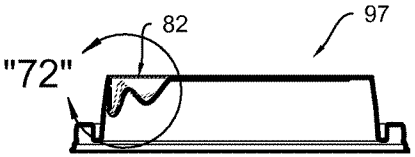
FIG. 71 is a second longitudinal cross-sectional depiction of the eighteenth lid construction as sectioned from FIG. 70.
Figure 70:
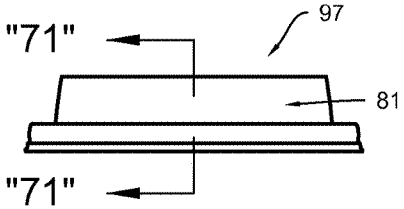
FIG. 70 is a second anterior edge elevational view of the eighteenth lid construction according to the present invention.
Figure 69:
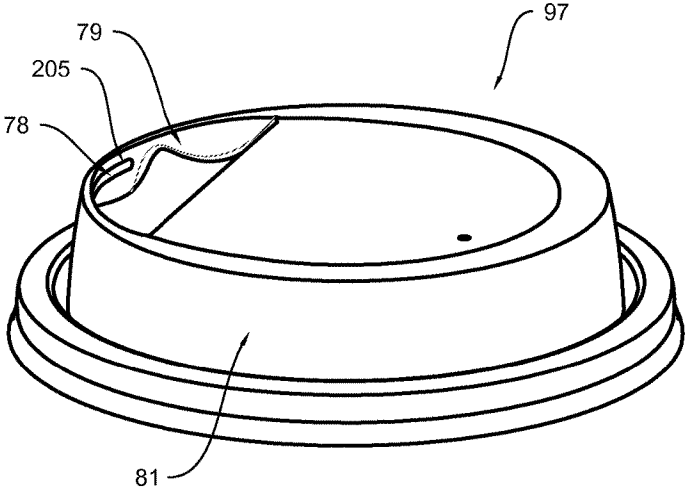
FIG. 69 is a second top perspective view of the eighteenth lid construction according to the present invention.

FIG. 41 is a bottom plan view of a twelfth lid construction 74 according to the present invention showing a lower damming insert construction 75 attached to an upper lid body 212 in inferior adjacency to the primary beverage or consumable liquid outlet (not specifically shown in FIG. 41). FIG. 42 is a reduced anterior edge elevational view of the twelfth lid construction 74 according to the present invention. FIG. 43 is a longitudinal cross-sectional depiction of the of the twelfth lid construction 74 as sectioned from FIG. 42 showing the damming insert 75 positioned in inferior adjacency to the primary beverage or consumable liquid outlet 76. FIG. 144 is an enlarged fragmentary sectional depiction of the primary beverage or consumable liquid outlet 76 and damming insert 75 situated in inferior adjacency to the outlet 76.

FIGS. 45-52, the reader is directed to a thirteenth lid construction 77 according to the present invention. The thirteenth lid construction 77 depicts a primary beverage or consumable liquid outlet 78 formed in an inner (substantially vertical) wall portion 79 of the thirteenth lid construction 77. Liquid progresses toward the primary beverage or consumable liquid outlet 78 through channel 80. FIGS. 45-52 attempt to depict SOLO® brand or type lid construction (s) with inner and outer walls 79 and 81 of the forming material formed in such a way that creates a significant flow-restricting damming channel 80 for hot beverage or consumable liquid to pass through to the main opening or primary beverage or consumable liquid outlet 78.

The primary beverage or consumable liquid outlet 78 is formed in the inner side of the inner wall 79 of indentation 82 made for a user's upper lip 43 to fit in and to draw air. The liquid dynamics created by such combination(s) of imbedded damming channel 80, side wall 79 and prolonged main opening or primary beverage or consumable liquid outlet 78 not only restrict hydraulic pressure but creates "waterfall" flow of consumable liquid which enables easier or greater mixing up with air intake and creates an additional cooling effect.

It is important to note that the space between outer wall 81 and inner wall 79 directly under the main or primary consumable liquid opening 78 is sufficiently narrow to significantly restrict of consumable liquid flow and extends laterally past the main or primary consumable liquid opening 78 just wide enough to restrict liquid flow from the sides of main opening 78.

Note further that the damming channel 80 is preferably made or formed as a single-piece lid construction. There is no separate damming insert used in combination with lid construction 77. The damming channel 80 is imbedded in the lid construction 77 during the process of forming the lid construction 77.

FIGS. 53-56 attempt to depict DART® brand or type lid construction(s) 83 substantially identical to the SOLO® brand or type lid construction(s) insofar as the lid constructions 83 also preferably comprise an inner lid walls as at 79 and an outer lid wall as at 81. The wall-forming material is preferably formed in such a way that the opposed walls 79 and 81 provide a significant flow-restricting damming channel 80 for hot beverage to pass through to main opening or primary beverage or consumable liquid outlet 78. The primary beverage or consumable liquid outlet 78 is formed in the inner side of the inner lid wall 79 and the indentation 82 is formed so as to receive an upper lip 43 for enabling the user's mouth to simultaneously draw air and liquid for effecting heat transfer from the liquid flow.

FIGS. 57-60 depict fifteenth and sixteenth lid constructions 84 and 85 respectively according to the present invention. The lid constructions 84 and 85 are preferably formed by removing central portions of state of the art lid constructions at a peripheral cut location as referenced at 86 for forming voids in the state of the art lid constructions. Damming insert constructions 87 and 88 may then be inserted into the aperture or void formed by the removal of centralized prior art lid portions and attached to the outer original peripheral lid portions 89 and 90. Lid constructions 84 and 85 minimize cost of plastic or forming material since the resulting construction(s) 84 and/or 85 comprise a single layer of material construction instead of two layers.

Referencing FIGS. 61-64, the reader is directed to a seventeenth lid construction 95 according to the present invention. The seventeenth lid construction 95 depicts a primary beverage or consumable liquid outlet 78 formed in an inner, substantially vertical lid wall 79 of the seventeenth lid construction 95. Consumable liquid progresses toward the primary beverage or consumable liquid outlet 78 through a damming channel 80. FIGS. 61-64 attempt to depict state of the art type lid construction(s) (e.g. those used and/or sold by way of the McDonald's Corporation) with inner lid wall 79 and outer lid wall 81 of the forming material formed in such a way that creates significantly restricting damming channel 80 for hot beverage or consumable liquid to pass through to main opening or primary beverage or consumable liquid outlet 78.

The primary beverage or consumable liquid outlet 78 is formed in the inner side of the inner lid wall 79 in adjacency to indentation 82 formed for receiving a user's upper lip 43 for air-drawing purposes as earlier described. The liquid dynamics created by such combination(s) of imbedded damming channel 80, inner lid wall 79 and prolonged main opening or primary beverage or consumable beverage outlet 78 (comprising shape 205) not only restrict hydraulic pressure but creates waterfall effect flow of liquid as at 303 which enables easier or greater mixing up with air intake and creates additional cooling effect.

It is important to note that the space between outer lid wall 81 and inner lid wall 79 directly under main opening 78 is sufficiently narrow to cause significant flow restriction of liquid and extends laterally past the main opening 78 to a sufficient degree to restrict liquid flow from the sides of main opening 78. Note further that this damming channel 80 is made or formed as a single piece lid construction. There is no separate damming insert used in combination with lid construction 95. The damming channel 80 is imbedded in the lid construction during the process of forming the lid construction 95.

Lid construction 95 further provides a primary liquid-trapping reservoir as at 96 for collecting or trapping liquid 302 after it has exited the primary beverage or consumable liquid outlet 78. Reservoir 96 collects liquid 302 after it cascades via a waterfall effect (as at 303) down inner lid wall 79 into the reservoir 96 and/or up the inner lid wall 79 into the user's mouth. The reader will note that when a user consumes the liquid 302, heat 100 is transferred from the liquid 302 prior to consumption as a means to prevent scalding of the user's mouth.

Referencing FIGS. 65-72, the reader is directed to an eighteenth lid construction 97 according to the present invention. The eighteenth lid construction 97 depicts a primary beverage or consumable liquid outlet 78 formed in an inner substantially vertical lid wall 79 of the eighteenth lid construction 97. Liquid progresses toward the primary beverage or consumable liquid outlet 78 through a damming channel 80. FIGS. 65-72 attempt to depict state of the art type SOLO® brand or type lid construction(s) with inner lid wall 79 and outer lid wall 81 of the forming material formed in such a way that the damming channel 80 significantly restricts liquid flow therethrough as it progress to the main opening or primary beverage or consumable liquid outlet 78.

The primary beverage or consumable liquid outlet 78 is formed in the inner side of the inner lid wall 79 and indentation 82 is formed so as to receive a user's upper lip 43 for air-drawing purposes as earlier described. The liquid dynamics created by such combination(s) of imbedded damming channel 80, inner lid wall 79 and prolonged main opening or primary beverage or consumable liquid outlet 78 having shape 205 not only restrict hydraulic pressure but create a waterfall effect flow of liquid as at 303 which enables easier or greater mixing up with air intake and creates additional cooling effect.

It is important to note that the space between outer lid wall 81 and inner lid wall 79 directly under main opening 78 is sufficiently narrow to significantly restrict liquid flow and extends laterally past the main opening 78 to a sufficient degree to restrict liquid flow from the sides of main opening 78. Note further that this damming channel 80 is made or formed as a single piece lid construction. There is no separate damming insert used in combination with lid construction 97. The damming channel 80 is imbedded in the lid construction 97 during the process of forming the lid construction 97.

Lid construction 97 further provides a liquid-trapping reservoir as at 96 and a relatively pronounced lip-receiving indentation as at 307 for receiving the upper lip 43 of a user's mouth. The lip-receiving indentation 307 basically functions to form-fit the lid construction 97 to the user's mouth for preventing spillage of liquid during liquid consumption. The indentation 307, further, however, collects liquid after it cascades via a waterfall effect (akin to effect 303) down inner indentation wall 333 into the indentation 307 thereby forming a secondary liquid-trapping reservoir. Heat 100 transfers from the variously pooled liquid prior to consumption as a means to prevent scalding of the user's mouth. Please note that waterfall effect as at arrows 303 may be directed either upwardly or downwardly along surface of inner lid wall 79 and inner indentation wall 333 depending on the angle of the lid construction 97.

Figure 74:
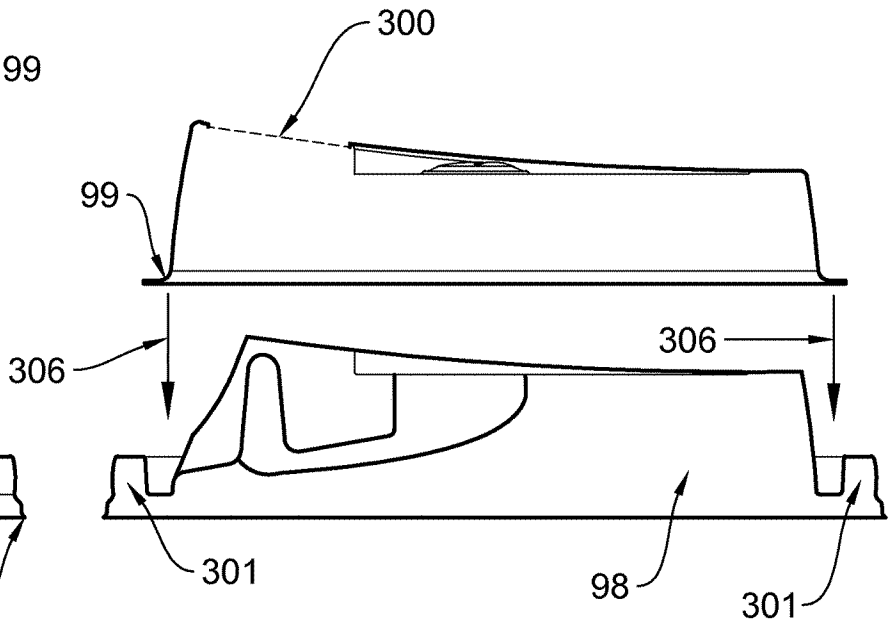
FIG. 74 is an exploded longitudinal cross-sectional type depiction of the combination assembly otherwise shown in FIG. 73 showing the liquid-damming lower lid construction and the mouth-interfacing upper lid construction, the lower and upper lid constructions being attachable such that the lower lid construction is attached to the upper lid construction for slowing liquid flow from the primary liquid outlet of the upper lid construction.
Figure 73:
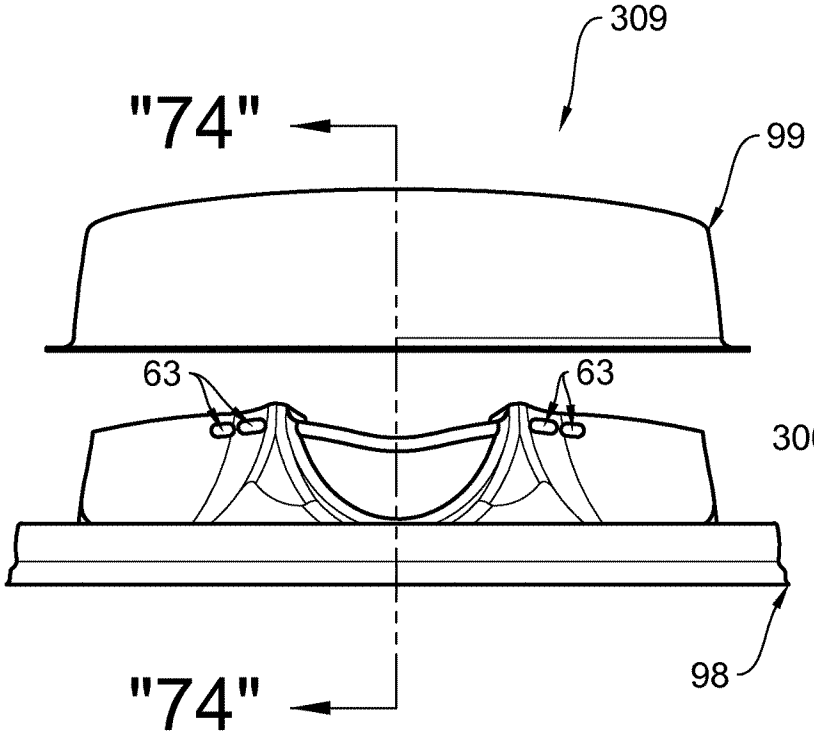
FIG. 73 is an exploded anterior view of a combination assembly comprising a liquid-damming lower lid construction and a mouth-interfacing upper lid construction, the lower and upper lid constructions being attachable such that the lower lid construction is attached to the upper lid construction for slowing liquid flow from the primary liquid outlet of the upper lid construction.
Figure 78:
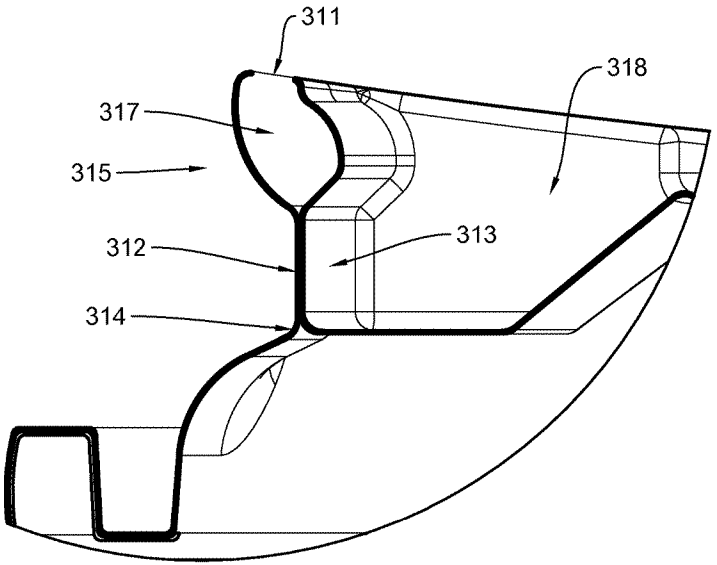
FIG. 78 is an enlarged fragmentary sectional view of the primary beverage outlet site of the nineteenth lid construction as sectioned from FIG. 77.
Figure 77:
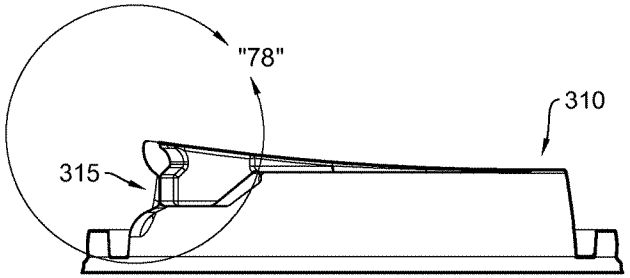
FIG. 77 is a longitudinal cross-sectional depiction of the nineteenth lid construction as sectioned from FIG. 76.
Figure 75:
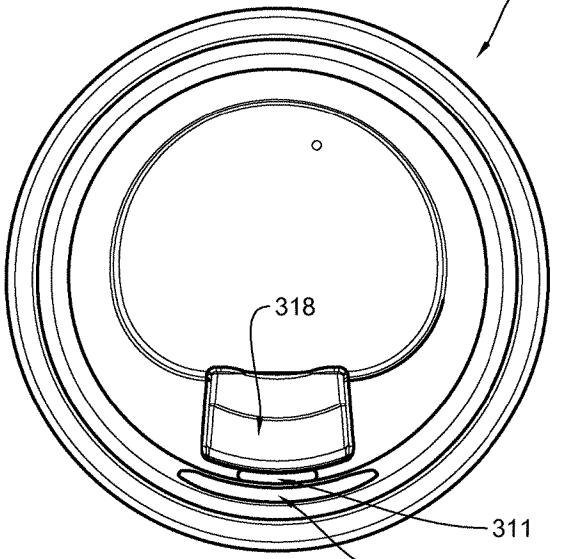
FIG. 75 is a top perspective view of a nineteenth lid construction according to the present invention.

Referencing FIGS. 73 and 74, the reader is directed to a certain method of lid construction for forming a combination lid assembly as at 309. The combination lid assembly 309 preferably comprises a liquid-damming lower lid construction as at 98 and a mouth-interfacing upper lid construction or body as at 99. The lower and upper lid constructions 98 and 99 are attachable such that the lower lid construction 98 is attached to the upper lid construction 99 for slowing liquid flow from the primary consumable liquid outlet as at 300 of the upper lid construction 99.

The lid assembly construction method supported by FIGS. 73-74 may be said to preferably comprise the steps of forming a lower damming insert construction (as at 98) and attaching an upper lid construction as at 99 to the lower damming insert construction 98, such that the upper lid construction is attached (as at arrows 306) to the (lower) damming insert construction 98 in superior adjacency thereto. The reader will please note that the damming insert construction 98 preferably comprises certain rim attachment means as exemplified by the rim receiving groove as at 301.

Referencing FIGS. 75-78, the reader is directed to a nineteenth lid construction 310 according to the present invention. The nineteenth lid construction 310 depicts a primary beverage or consumable liquid outlet 311 (preferably having a shape 205) formed in superior adjacency to a closed or collapsed outer-inner wall construction as at blockage site 312. In other words, an inner lid wall 313 is attached to an outer lid wall 314 at the blockage site 312 as preferably formed by sound welding, heat welding, or adhesive means, and thus nineteenth lid construction 310 may be said to preferably provide a permanent blockage site 312.

Figure 76:
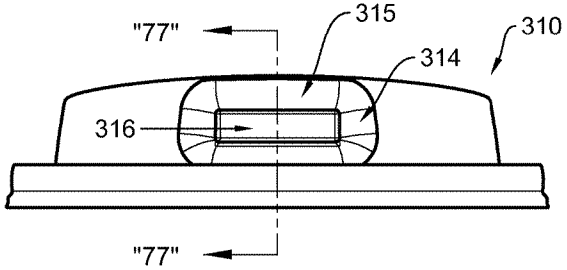
FIG. 76 is an anterior edge elevational view of the nineteenth lid construction according to the present invention.

Viewed anteriorly as generally depicted in FIG. 76, the nineteenth lid construction 310 appears to comprise an indentation as at 315. The blockage site 312 is in posterior adjacency to outer lid wall 314 at the central portion 316 of the indentation 315. A beverage or liquid damming channel 317 is formed in superior adjacency to the blockage site 312 in inferior adjacency to the primary beverage or consumable liquid outlet 311. An air intake indentation 318 is preferably formed in posterior adjacency to the outlet 311 for enabling air-drawing and heat transfer functions as earlier described.

Liquid flow around the blockage site 312 is very much akin to liquid flow patterns earlier discussed in connection with damming depressions 58. In this case the blockage site is situated inferior adjacency to the primary beverage or consumable beverage outlet 311 for directing beverage flow 104 around the blockage site 312 so as to delay the final outlet of beverage or consumable liquid for enabling heat 100 to transfer from the beverage or consumable liquid flow 104 during redirective movements analogous to movements 104' and 104", and for preventing inadvertent spillage as previously described. The reader is re-directed to FIGS. 25-28 for added details/disclosures relating to these movements. Liquid flow may thus be preferably redirected laterally around the blockage site 312 identified anteriorly as at collapsible central portion 316 through damming channel 317 and outlet via outlet 311 into the user's mouth.

Figure 79:
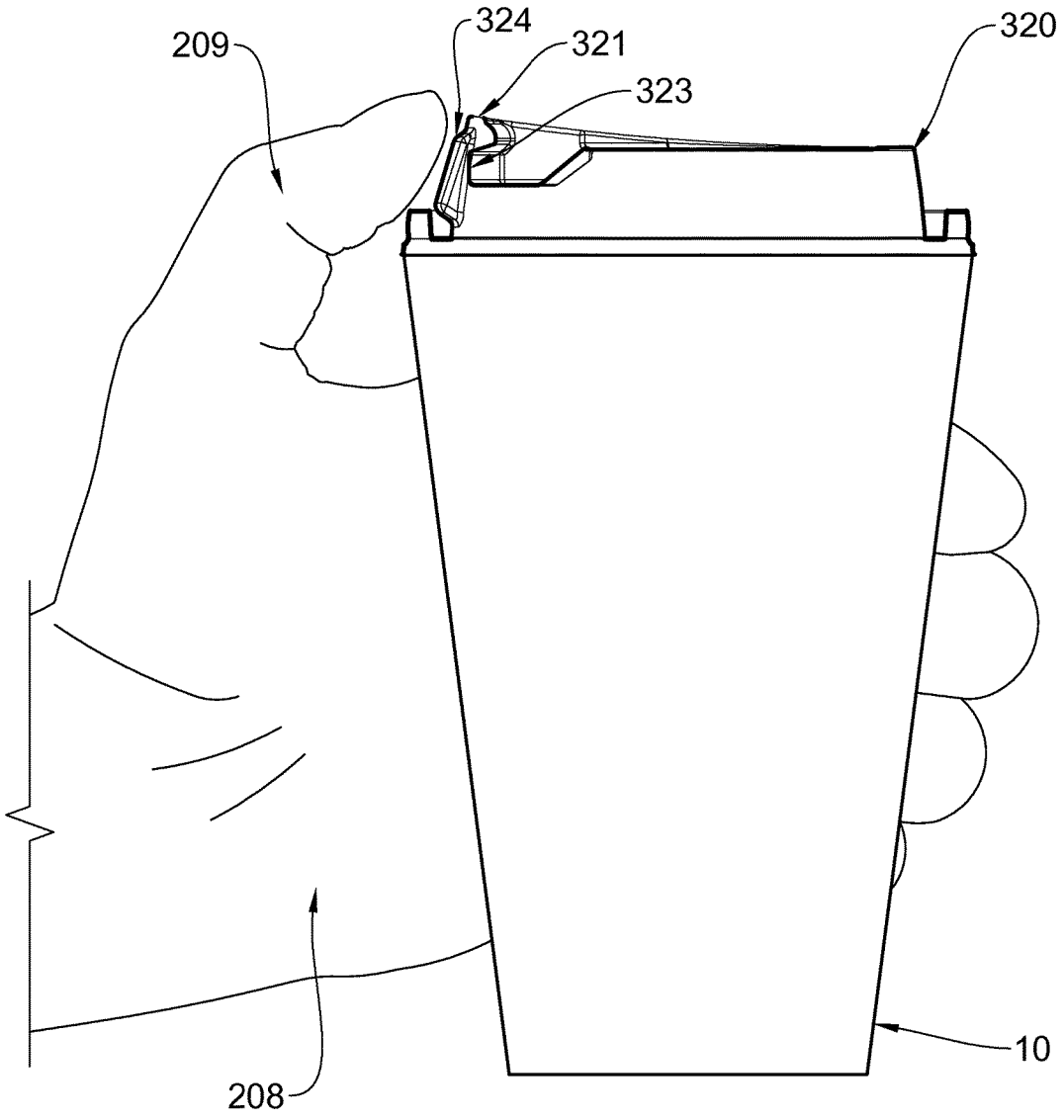
FIG. 79 is an enlarged first sequential fragmentary depiction of a user's hand grasping a beverage container outfitted with a twentieth lid construction according to the present invention depicting the user's thumb before the user's thumb presses outer lid wall.
Figure 80:
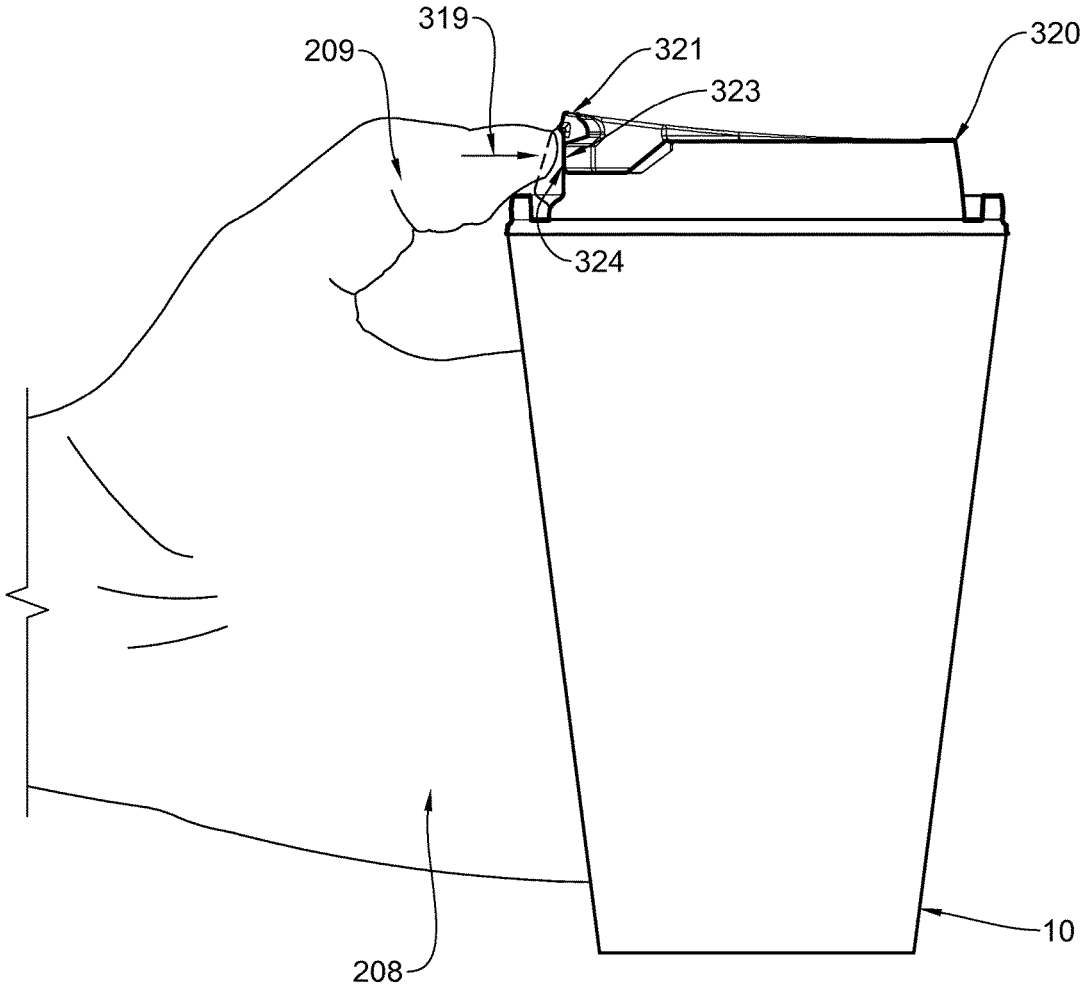
FIG. 80 is an enlarged second sequential fragmentary depiction of a user's hand grasping a beverage container outfitted with the twentieth lid construction according to the present invention depicting the user's thumb after the user's thumb presses and indents the outer lid wall.

Referencing FIGS. 79-80, the reader is directed to a twentieth lid construction 320 according to the present invention. The twentieth lid construction 320 depicts a primary beverage or consumable liquid outlet 321 (preferably having a shape 205) formed in superior adjacency to an optionally closable or collapsible outer wall construction 324, which collapsible outer wall construction 324 may thus optionally form a blockage site as at 322 by being manually depressed as at arrows 319 via a user's thumb 209 (or other digit) at a collapsible central portion 316 into engagement with the indented inner wall construction 323.

Figure 81:
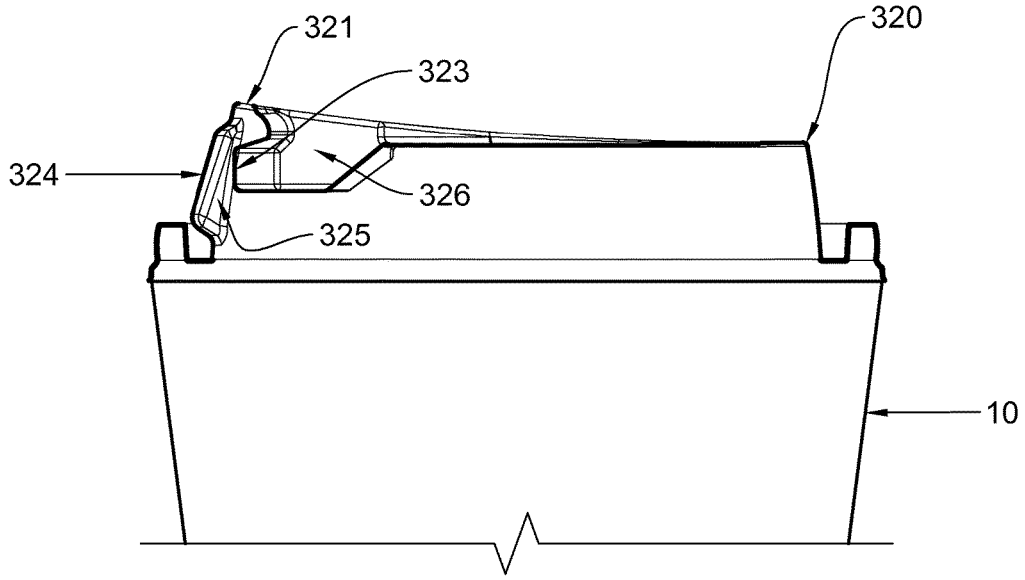
FIG. 81 is an enlarged first sequential fragmentary depiction of a fragmentary upper portion of a beverage container outfitted with the twentieth lid construction according to the present invention before an indentable portion of the outer lid wall is indented.
Figure 82:
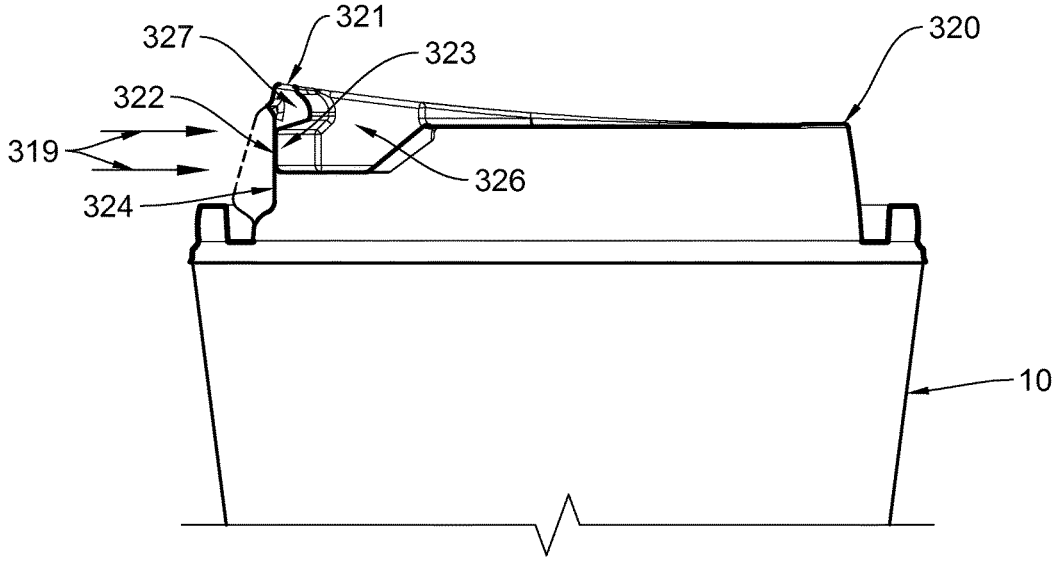
FIG. 82 is an enlarged second sequential fragmentary depiction of a fragmentary upper portion of a beverage container outfitted with the twentieth lid construction according to the present invention after the indentable portion of the outer lid wall is indented.
Figure 86:
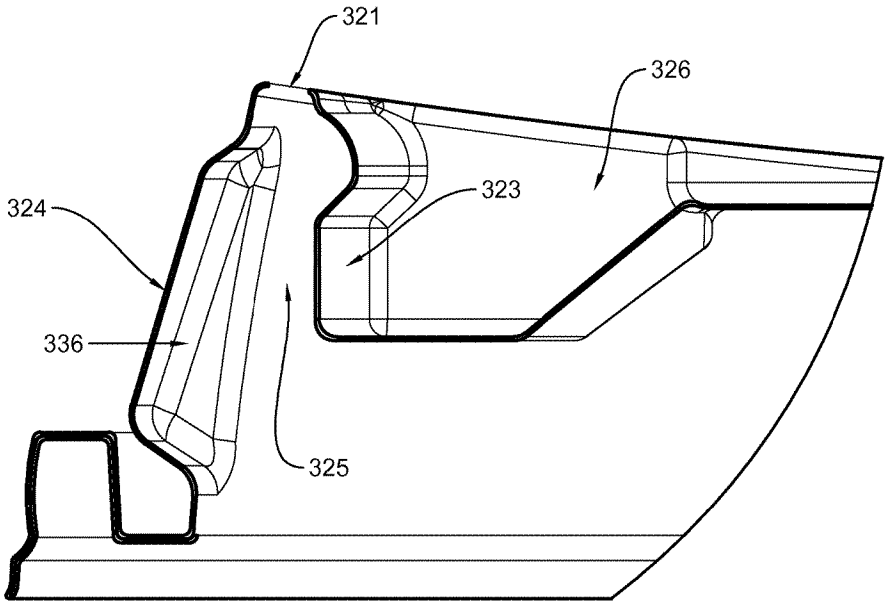
FIG. 86 is an enlarged fragmentary sectional view of the primary beverage outlet site of the twentieth lid construction as sectioned from FIG. 85.
Figure 85:
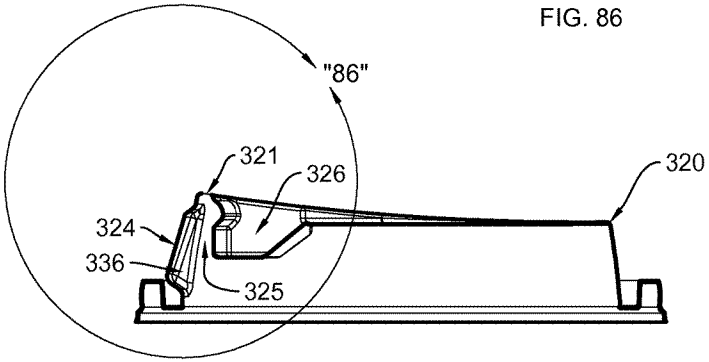
FIG. 85 is a longitudinal cross-sectional depiction of the twentieth lid construction as sectioned from FIG. 84.
Figure 83:
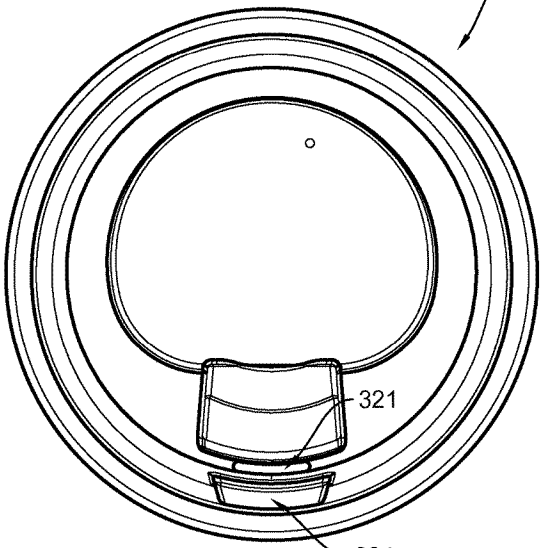
FIG. 83 is a top plan view of the twentieth lid construction according to the present invention before the indentable portion of the outer lid wall is indented.
Figure 84:
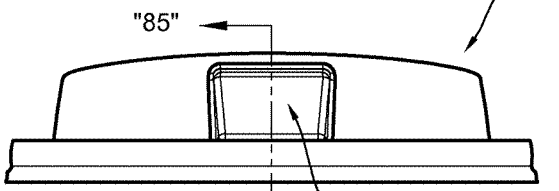
FIG. 84 is an anterior edge elevational view of the twentieth lid construction according to the present invention before the indentable portion of the outer lid wall is indented.
Figure 90:
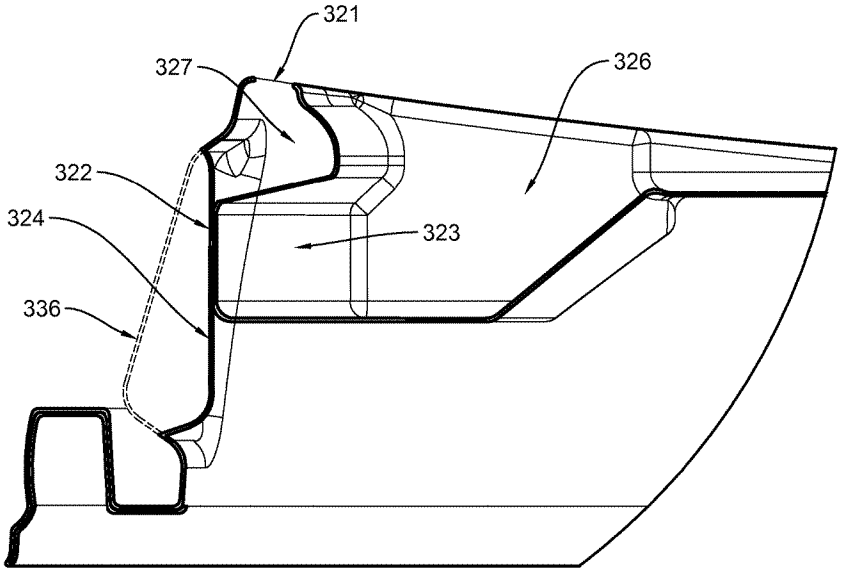
FIG. 90 is an enlarged fragmentary sectional view of the primary beverage outlet site of the twentieth lid construction as sectioned from FIG. 89.
Figure 89:
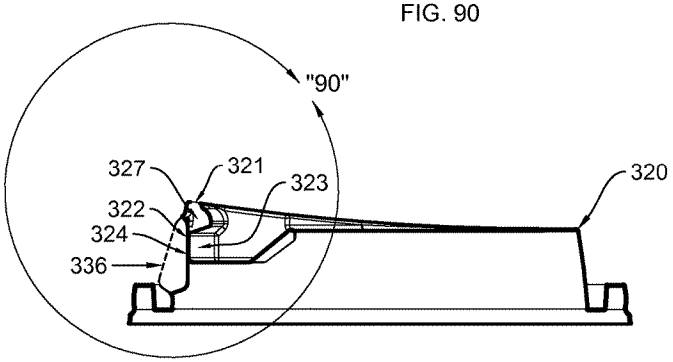
FIG. 89 is a longitudinal cross-sectional depiction of the twentieth lid construction as sectioned from FIG. 88.
Figure 87:
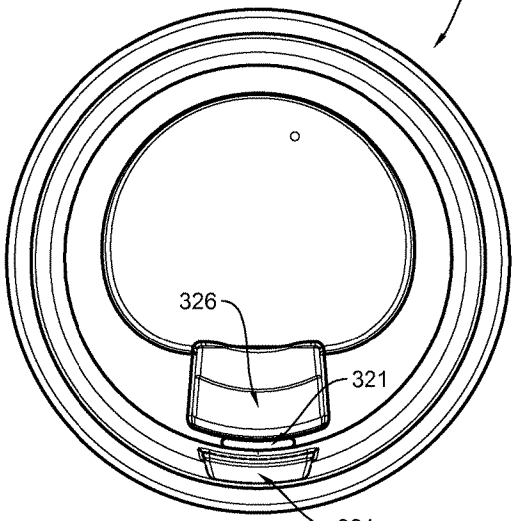
FIG. 87 is a top plan view of the twentieth lid construction according to the present invention after the indentable portion of the outer lid wall is indented.
Figure 88:
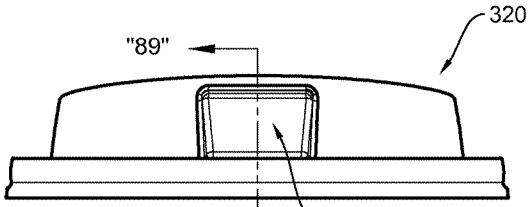
FIG. 88 is an anterior edge elevational view of the twentieth lid construction according to the present invention after the indentable portion of the outer lid wall is indented.
Figure 94:
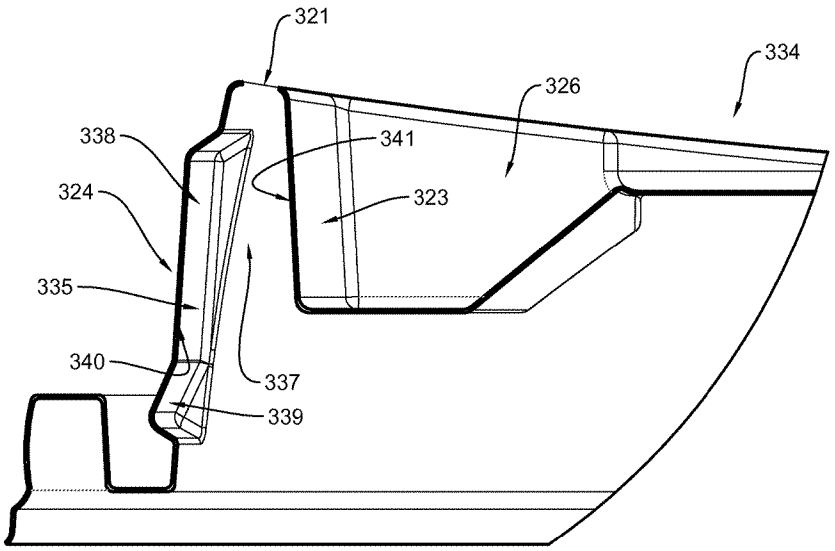
FIG. 94 is an enlarged fragmentary sectional view of the primary beverage outlet site of the twenty-first lid construction as sectioned from FIG. 93.
Figure 93:
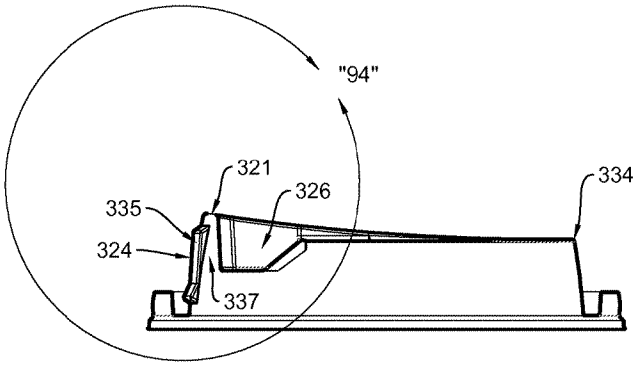
FIG. 93 is a longitudinal cross-sectional depiction of the twenty-first lid construction as sectioned from FIG. 92.
Figure 91:
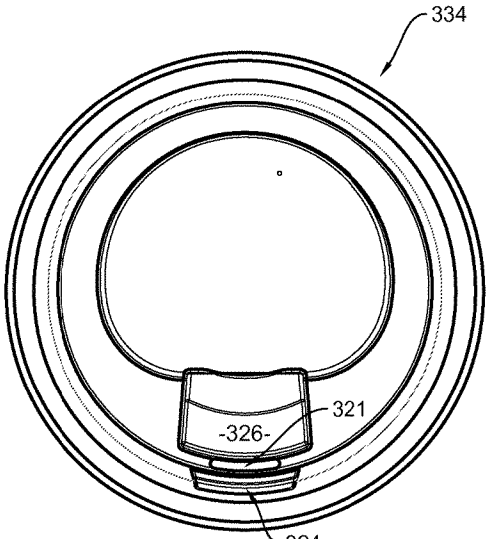
FIG. 91 is a top plan view of the twenty-first lid construction according to the present invention before the indentable portion of the outer lid wall is indented.
Figure 92:
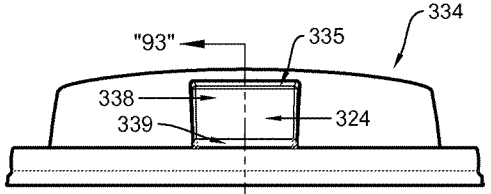
FIG. 92 is an anterior edge elevational view of the twenty-first lid construction according to the present invention before the indentable portion of the outer lid wall is indented.
Figure 98:
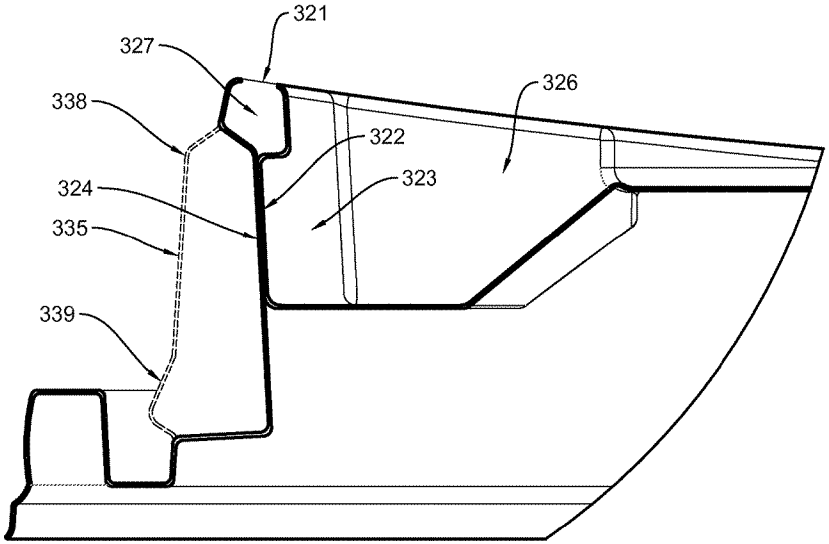
FIG. 98 is an enlarged fragmentary sectional view of the primary beverage outlet site of the twenty-first lid construction as sectioned from FIG. 97.
Figure 97:
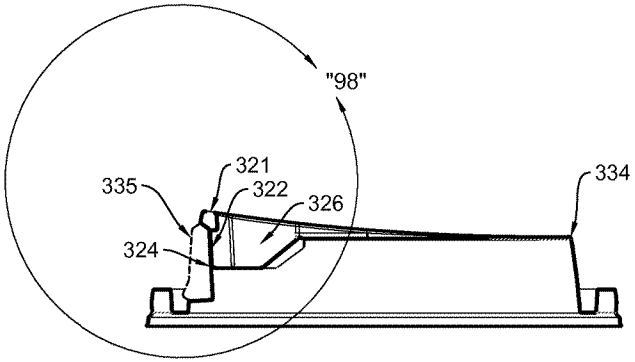
FIG. 97 is a longitudinal cross-sectional depiction of the twenty-first lid construction as sectioned from FIG. 96.
Figure 95:
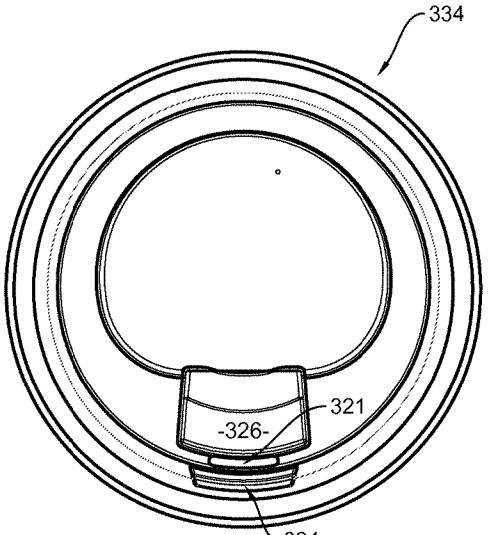
FIG. 95 is a top plan view of the twenty-first lid construction according to the present invention after the indentable portion of the outer lid wall is indented.
Figure 96:
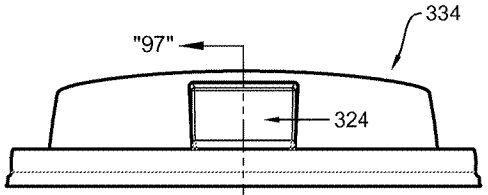
FIG. 96 is an anterior edge elevational view of the twenty-first lid construction according to the present invention after the indentable portion of the outer lid wall is indented.

In this regard, the reader may comparatively reference FIG. 79 versus FIG. 80 and FIG. 81 versus FIG. 82. FIG. 79 is an enlarged first sequential fragmentary depiction of a user's hand 208 grasping a beverage container 10 outfitted with a twentieth lid construction 320 according to the present invention depicting the user's thumb 209 before the user's thumb 209 presses collapsible outer lid wall construction 324.

FIG. 80 is an enlarged second sequential fragmentary depiction of the user's hand 208 grasping the beverage container 10 outfitted with the twentieth lid construction 320 according to the present invention depicting the user's thumb 209 after the user's thumb 209 presses (as at force arrows 319) and indents or collapses the outer lid wall construction 324 into engagement with the indented inner lid wall construction 323 so as to manually form blockage site 322.

FIGS. 81 and 82 depict the lid construction 320 in before and after collapsible outer lid wall construction 324 depression. FIGS. 83-86 depict a before depression state of the lid construction 320, and FIGS. 87-90 depict an after depression state of the lid construction 320. Referencing FIG. 86, the reader will there see an open flow channel 325 and an air draw indentation 326. Referencing FIG. 90, the reader will there see a closed flow channel or blockage site 322 with a damming channel 327 formed in superior adjacency to the blockage site 322 in inferior adjacency to the primary beverage or consumable liquid outlet 321. An air intake or draw indentation 326 is preferably formed in posterior adjacency to the outlet 321 for enabling air-drawing and heat transfer functions as earlier described.

Liquid flow around the blockage site 322 is very much akin to liquid flow patterns earlier discussed in connection with damming depressions 58. In this case the blockage site is situated inferior adjacency to the primary beverage or consumable beverage outlet 321 for directing beverage flow around the blockage site 322 so as to delay the final outlet of beverage or consumable liquid for enabling heat 100 to transfer from the beverage or consumable liquid flow during redirective movements analogous to movements 104' and 104", and for preventing inadvertent spillage as previously described. The reader is re-directed to FIGS. 25-28 for added details/disclosures relating to these movements. Liquid flow may thus be preferably redirected laterally around the blockage site 322 and outlet via outlet 321 into the user's mouth.

Referencing FIGS. 91-98, the reader will there see a twenty-first lid construction 334 according to the present invention. The twenty-first lid construction 334 according to the present invention is substantially identical to the twentieth lid construction 320 according to the present invention except for the pre-collapsed structure 335 of the collapsible outer lid wall 324.

The pre-collapsed structure 335 is relatively less pronounced as compared to pre-collapsed structure 336 of the twentieth lid construction 320 for enhancing nestability of a series of pre-collapsed lid constructions 334. The open flow channel 337 is also relatively slimmer as compared to open flow channel 325 for comparatively restricting liquid flow therethrough to a greater extent in lid construction 334 as compared to lid construction 320.

The pre-collapsed structure 335 of the outer lid wall construction 324 of lid construction 334 thus comprises a substantially vertical header portion (as compared to the lid rim 16) as at 338 and an obliquely angled footer portion 339, which footer portion is obliquely angled relative to the header portion 338. The pre-collapsed structure 335 thus basically functions to enable enhanced nestability of successive lid constructions and for providing a relatively narrow flow channel 337 defined by the inner surface of the header portion 340 and an inner surface 341 of the inner lid wall 323.

While the foregoing specifications set forth much specificity, the same should not be construed as setting forth limits to the invention but rather as setting forth certain preferred embodiments and features. The foregoing specifications are believed to support a number of inventive concepts, which concepts may be said to essentially define certain lid constructions for enhancing heat transfer from a relatively hot (container-contained) liquid, and for preventing inadvertent spillage as previously described.

The various lid constructions according to the present invention may be said to essentially comprise a lid rim as at 16; an outer lid wall as variously referenced; and an inner lid wall opposite the outer lid wall as variously referenced. A primary outlet as various referenced may be preferably formed in the inner lid wall. The lid rim preferably extends in a rim plane as at 120, and the primary outlet may preferably function to outlet liquid in directions substantially parallel to the rim plane 120. The various lid constructions being attachable to a liquid container as at 10, and the primary outlet basically functions to increase air with liquid or air-liquid turbulence for increasing heat transfer 100 from the liquid as said liquid exits the primary outlet.

A damming depression, formation, or structure as variously depicted and referenced may be preferably formed in adjacency to the primary outlet for redirecting liquid movement and enhancing heat transfer therefrom before it exits the primary outlet. The damming structure may preferably comprise a resilient portion, which resilient portion enables the damming structure to be placed into either an actuated position or a relaxed position. FIGS. 2, 3A, and 16, for example, depict an actuated position for providing a liquid outlet via the primary outlet. FIGS. 15 and 17, by contrast, generally depict the damming structure returned to a relaxed position.

The reader will thus understand that the primary outlet is formable by way of a spring-biasable material construction or damming structure as at 41, which spring-biasable material construction 41 is preferably displaceable intermediate a relaxed configuration and an actuated configuration such that the actuated configuration functions to provide a primary outlet. In certain preferred embodiments, the lid construction may further preferably comprise certain (lower) stop structure formed in inferior adjacency to the spring-biasable material construction.

A lower stop structure, as referenced at 37 for example, functions to prevent downward displacement of the spring-biasable material construction and thus to restrict (excessive) liquid flow. The spring-biasable material construction may be further preferably contoured or formed for cooperative engagement with a user's upper lip as at 43. The spring-biasable material construction may thus enable the user to more effectively depress the spring-biasable material construction by way of the user's upper lip.

The outer lid wall may preferably comprises a collapsible portion as generally and comparatively depicted in FIGS. 79-90, or may alternatively comprise a more permanently depressed or indented outer wall formation generally and comparatively depicted in FIGS. 75-78. The collapsible portion may be manually depressable for selectively and/or manually forming a damming structure as at blockage site 322.

The lid constructions according to the present invention may further preferably comprise a liquid-trapping reservoir as at 96. The liquid-trapping reservoir 96 may be preferably located in adjacency to the primary outlet for receiving and pooling liquid exiting the primary outlet, and basically functions to enable heat transfer from the pooled liquid prior to liquid consumption. Further, the lid constructions may preferably comprise a lip-receiving indentation as at 307. The lip-receiving indentation 307 is preferably located in adjacency to the primary liquid-trapping reservoir for (a) receiving and pooling liquid exiting the primary liquid-trapping reservoir 96 thereby forming a secondary liquid-trapping reservoir, and (b) form-fitting the lid construction to the upper lip 43 of a user's mouth for preventing spillage of liquid during liquid consumption.

Certain embodiments of the lid constructions further function to provide plural container access points, and thus may be said to preferably comprise a primary outlet as variously referenced, a secondary outlet as exemplified at 27 and a lid rim as at 16. The primary and secondary outlets are preferably formed opposite one another within the circular lid construction(s). The primary outlet comprises a first aperture, and the secondary outlet comprises a second aperture, which second aperture is preferably relatively larger than the first aperture for enabling a user to selectively access consumable material via the lid construction via a select outlet, the select outlet being selected from the group consisting of the primary and secondary outlets.

In this last regard, it is contemplated that the primary outlet may well function to dispense or outlet relatively low viscosity consumable material such as hot coffee and the like while the secondary outlet may well function to dispense or outlet relatively high viscosity consumable material such as soup or stew type material. These types of lid constructions may preferably further comprise a flap construction as at 30, which flap construction 30 may well function to selectively cover the secondary outlet as the user may elect.

The flap construction may preferably comprise certain means for selectively retaining the flap in an open position, which means may be exemplified by a gripping bump or protrusion as referenced at 31. The protrusion 31 preferably mates with structure at the opening 32 formed at the damming insert side 25 of the lid construction(s). The secondary outlet may be preferably formed in first lower material layer as referenced at 29, and the flap construction 30 may be preferably formed or hingedly connected to a second upper material layer as at 33.

Certain other lid constructions according to the present invention preferably comprise certain particularly formed damming formations as preferably exemplified by formations 58 for enhancing heat transfer from a relatively hot container-contained liquid. These lid constructions may be said to essentially comprise a lid rim, a primary outlet, and a damming formation, such that the damming formation is preferably located intermediate the lid rim and the primary outlet for redirecting liquid flow prior to outletting through the primary outlet. By redirecting liquid around the damming formation so formed, heat may be effecting transferred from the liquid prior to exiting the primary outlet and consumption by the user. The damming depressions or formations may either extend in a radially outward direction or a radially inward direction.

Certain other lid constructions according to the present invention comprise an upper lid construction and a lower damming insert. In these embodiments the upper lid construction comprises a primary outlet, and the lower damming insert is attached to the upper lid construction in inferior adjacency to the primary outlet for defining liquid-letting apertures intermediate the upper lid construction and lower damming insert. Together, the damming insert and liquid-letting apertures slow liquid flow prior to outletting through the primary outlet, and thus the damming insert(s) basically function to enhance or increase heat transfer(s) from the liquid prior to its exiting the primary outlet.

The present invention further contemplates certain lid construction methodologies whereby a central portion of a state of the art lid construction is removed to expose a central void in the state of the art lid construction; and a damming insert construction according to the present invention is utilized to fill that void for forming an improved lid construction. Further, the lid assembly construction according to the present invention may be said to comprise the steps of forming a damming insert construction (with optional container rim attachment means as at 301); and attaching a lid construction to the damming insert construction, the lid construction being attached to the damming insert construction in superior adjacency thereto as generally and comparatively depicted in FIGS. 73 and 74.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures, and the appended claims and drawings.

I claim:

1. A lid construction for enhancing heat transfer from a relatively hot liquid and preventing inadvertent spillage, the lid construction comprising:

a lid rim, a lid wall construction, and a liquid-trapping reservoir, the lid wall construction comprising an outer lid wall portion and an inner lid wall portion opposite the outer lid wall portion in anterior adjacency to the liquid-trapping reservoir, the liquid-trapping reservoir comprising a reservoir bottom, a primary outlet being formed in the inner lid wall portion in superior adjacency to the reservoir bottom, the lid rim extending in a rim plane, the primary outlet for outletting liquid in directions substantially parallel to the rim plane, the lid construction being attachable to a liquid container, the primary outlet for increasing (a) air-liquid turbulence and (b) heat transfer from liquid as said liquid exits the primary outlet, the liquid-trapping reservoir for pooling liquid in inferior adjacency to the primary beverage outlet.

2. The lid construction of claim 1 comprising a damming structure extending in inferior adjacency to the primary outlet, the damming structure for (a) redirecting liquid movement and enhancing heat transfer therefrom before it exits the primary outlet and (b) preventing inadvertent spillage.

3. The lid construction of claim 2 wherein the damming structure comprises a resilient portion, the resilient portion for enabling the damming structure to be placed into an actuated position and a relaxed position.

4. The lid construction of claim 2 wherein the outer lid wall portion comprises a collapsible portion, the collapsible portion being manually depressable for forming the damming structure.

5. The lid construction of claim 4 wherein the collapsible portion comprises a header portion and a footer portion, the header portion being substantially orthogonal to the rim plane and the footer portion being obliquely angled relative to the header portion for enabling enhanced nestability of successive lid constructions and for narrowing a flow channel defined by an inner surface of the header portion and an inner surface of the inner lid wall.

6. The lid construction of claim 2 wherein the liquid-trapping reservoir is located in adjacency to the damming structure for receiving and pooling liquid exiting the primary outlet, the liquid-trapping reservoir for enabling heat transfer from the pooled liquid prior to liquid consumption.

7. The lid construction of claim 6 comprising a lip-receiving indentation, the lip-receiving indentation being located in adjacency to the liquid-trapping reservoir for (a) receiving and pooling liquid exiting the liquid-trapping reservoir, and (b) form-fitting the lid construction to the user's mouth for preventing spillage of liquid during liquid consumption.

8. The lid construction of claim 1 wherein the primary outlet is formable by way of a spring-biasable material construction, the spring-biasable material construction being displaceable intermediate a relaxed configuration and an actuated configuration and comprising an attached end portion and an unattached end portion, the actuated configuration for providing the primary outlet via resilient displacement the unattached end portion.

9. The lid construction of claim 8 comprising lower stop structure, the lower stop structure for preventing downward displacement of the unattached end portion and thus for restricting liquid flow.

10. The lid construction of claim 8 wherein the unattached end portion is contoured upwardly to conform to a user's upper lip, the unattached end portion thus for enabling the user to resiliently depress the unattached end portion via the user's upper lip.

11. A lid construction for enhancing heat transfer from a relatively hot liquid and preventing inadvertent spillage, the lid construction comprising: a lid rim, an upright lid wall construction, and a primary outlet, the upright lid wall construction comprising an upright outer lid wall portion, an upright inner lid wall portion opposite the upright outer lid wall portion, and a lid indentation damming formation extending radially in inferior adjacency to the primary outlet substantially parallel to the lid rim, the upright outer lid wall portion extending in an outer portion plane and the upright inner lid wall portion extending in an inner portion plane, the lid indentation damming formation intersecting the inner and outer portion planes in inferior adjacency to the primary outlet, the lid indentation damming formation thus for (a) redirecting liquid flow prior to outletting through the primary outlet and (b) enhancing heat transfer from liquid prior to exiting the primary outlet.

12. The lid construction of claim 11 wherein the lid indentation damming formation extends in a select radial direction, the select radial direction being selected from the group consisting of a radially outward direction and a radially inward direction.

13. The lid construction of claim 11 comprising a collapsible portion, the collapsible portion being manually depressable for forming the lid indentation damming formation.

14. A two-element lid assembly for enhancing heat transfer from a relatively hot liquid and preventing inadvertent spillage, the two-element lid assembly comprising:

a first upper lid construction element, the first upper lid construction element comprising a primary outlet; and a second lower damming insert element, the second lower damming insert element being separately attachable to the first upper lid construction element in inferior adjacency to the primary outlet and comprising a forward, central, and upper liquid spillway and opposed lateral portions extending laterally and rearwardly from the forward, central, and upper liquid spillway, the forward, central, and upper liquid spillway comprising an upper sloped region and a lower sloped region, the upper sloped region being laterally bound by upright structures for defining at least one free-flow, liquid-letting pathway over the second lower damming insert element and under the first upper lid construction element in communication with the primary outlet for diverting liquid flow prior to outletting through the primary outlet, the second lower damming insert element thus for increasing heat transfer from said liquid prior to exiting the primary outlet.

15. The two-element lid assembly of claim 14 wherein the opposed lateral portions of the second lower damming insert element define a rim-receiving groove at undersides thereof for attaching the second lower damming insert element to an upper rim of a lid container.

16. A lid assembly construction method, the lid assembly construction method comprising the steps of:

forming a damming insert construction, the damming insert construction comprising a forward, central, and upper liquid spillway and opposed lateral portions extending laterally and rearwardly from the forward, central, and upper liquid spillway, the forward, central, and upper liquid spillway comprising an upper sloped region and a lower sloped region, the upper sloped region being laterally bound by upright structures and;

inserting the damming insert construction into an underside of a lid construction such that the opposed lateral portions extend laterally and rearwardly at a periphery of the lid construction, the lid construction comprising a primary outlet, the damming insert construction thereby positioning the central upper liquid spillway in inferior adjacency to the primary outlet, the central upper liquid spillway for structurally defining at least one free-flow, liquid-letting pathway over the damming insert construction and under the lid construction in communication with the primary outlet, the forward, central, and upper liquid spillway for diverting liquid flow prior to outletting through the primary outlet.

17. The lid assembly construction method of claim 16 wherein the opposed lateral portions of the damming insert construction define a rim-receiving groove at undersides thereof for attaching the damming insert construction to an upper rim of a lid container.

* * * * *